US011197517B2

(12) United States Patent
Manz et al.

(10) Patent No.: US 11,197,517 B2
(45) Date of Patent: Dec. 14, 2021

(54) SHOE UPPER FOR SPORTS SHOES

(71) Applicant: adidas AG, Herzogenaurach (DE)

(72) Inventors: Gerd Rainer Manz, Herzogenaurach (DE); Paul Leonard Michael Smith, Herzogenaurach (DE); Stuart David Reinhardt, Herzogenaurach (DE); Jan Hill, Herzogenaurach (DE); Clemens Paul Dyckmans, Herzogenaurach (DE); Carl Arnese, III, Herzogenaurach (DE); Alexander Taylor, Herzogenaurach (DE); Edward Robinson, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 565 days.

(21) Appl. No.: 15/086,713

(22) Filed: Mar. 31, 2016

(65) Prior Publication Data

US 2016/0286898 A1 Oct. 6, 2016

(30) Foreign Application Priority Data

Mar. 31, 2015 (DE) ..... 10 2015 205 751.8
Feb. 10, 2016 (DE) ..... 10 2016 201 973.2

(51) Int. Cl.
*A43B 23/02* (2006.01)

(52) U.S. Cl.
CPC ..... *A43B 23/0205* (2013.01); *A43B 23/026* (2013.01); *A43B 23/027* (2013.01);
(Continued)

(58) Field of Classification Search
CPC .. A43B 23/0205; A43B 23/026; A43B 23/027
(Continued)

(56) References Cited

U.S. PATENT DOCUMENTS 1,130,859 A 3/1915 Thomas
2,608,078 A 8/1952 Anderson
(Continued)

FOREIGN PATENT DOCUMENTS

CN 101125044 2/2008
CN 101632502 1/2010
(Continued)

OTHER PUBLICATIONS

European Application No. 16162800.3, Extended European Search Report dated Sep. 16, 2016, 9 pages.
(Continued)

*Primary Examiner* — Alissa J Tompkins
*Assistant Examiner* — Catherine M Ferreira
(74) *Attorney, Agent, or Firm* — Kilpatrick Townsend & Stockton LLP

(57) ABSTRACT

Described are shoe uppers for a sports shoe with a first layer with a first surface and an opposing second surface, a first yarn section with a first diameter, wherein the first yarn section is arranged on the first surface of the first layer, and a second yarn section with a second diameter, wherein the second yarn section is arranged on the first surface of the first layer. The first yarn section and the second yarn section have at least one parallel portion in which the first yarn section is substantially parallel to the second yarn section, and wherein a distance between the first yarn section and the second yarn section is smaller than a larger value of the first diameter and the second diameter.

21 Claims, 34 Drawing Sheets

(52) U.S. Cl.
CPC ..... *A43B 23/028* (2013.01); *A43B 23/0235* (2013.01); *A43B 23/0245* (2013.01); *A43B 23/0255* (2013.01); *A43B 23/0265* (2013.01); *A43B 23/0275* (2013.01)

(58) Field of Classification Search
USPC ..... 36/55, 45
See application file for complete search history.

(56) References Cited

U.S. PATENT DOCUMENTS

| | | | | |
|---|---|---|---|---|
| 5,615,562 | A | 4/1997 | Roell | |
| 7,870,681 | B2 * | 1/2011 | Meschter | A43B 3/26 36/45 |
| 8,959,959 | B1 | 2/2015 | Podhajny | |
| 2008/0022554 | A1 | 1/2008 | Meschter et al. | |
| 2010/0018075 | A1 * | 1/2010 | Meschter | A43D 111/00 36/45 |
| 2010/0154256 | A1 | 6/2010 | Dua | |
| 2010/0251491 | A1 | 10/2010 | Dojan et al. | |
| 2011/0041359 | A1 * | 2/2011 | Dojan | A43B 23/025 36/47 |
| 2013/0186506 | A1 | 7/2013 | Cross et al. | |
| 2015/0101133 | A1 | 4/2015 | Manz et al. | |
| 2015/0101134 | A1 | 4/2015 | Manz et al. | |

FOREIGN PATENT DOCUMENTS

| | | |
|---|---|---|
| CN | 102497793 | 6/2012 |
| DE | 10234653 | 1/2004 |
| DE | 102005034401 | 2/2007 |
| DE | 202009018763 | 2/2013 |
| DE | 202014105090 | 10/2014 |
| DE | 102013107803 | 1/2015 |
| DE | 102013221018 | 4/2015 |
| DE | 102013221020 | 4/2015 |
| EP | 1553220 | 7/2005 |
| EP | 1813159 | 8/2007 |
| EP | 1916323 | 4/2008 |
| EP | 2790545 | 10/2014 |
| JP | 0938 | 1/1997 |
| JP | 2009538198 | 11/2009 |
| JP | 2013502301 | 1/2013 |
| JP | 2014514194 | 6/2014 |
| WO | 2010011414 | 1/2010 |

OTHER PUBLICATIONS

European Application No. 16162800.3, Office Action dated Nov. 30, 2017, 6 pages.
Japanese Application No. 2016-068923, Office Action dated Jul. 17, 2018, 9 pages (5 pages of Original Document and 4 pages of English Translation).
Chinese Patent Application No. 201610201273.1, Office Action, dated Jun. 19, 2020, 17 pages (machine English translation provided).
German Patent Application No. 102016201973.2, Office Action, dated May 27, 2019, 9 pages (machine English translation provided).
European Patent Application No. 19162027.7, Office Action, dated May 8, 2020, 5 pages.
European Patent Application No. 19162027.7, Office Action, dated Nov. 4, 2020, 5 pages.
Japanese Patent Application No. 2019-014772, Office Action dated Jan. 5, 2021, 4 pages (English machine translation provided).
European Patent Application No. 19162027.7, Extended European Search Report dated Aug. 8, 2019, 8 pages.
Japanese Patent Application No. 2016-068923, Office Action dated Jul. 2, 2019, 8 pages (English machine translation included).
German Patent Application No. 102016201973.2, Office Action dated Sep. 26, 2016, 12 pages (English machine translation included).
German Patent Application No. 102016201973.2, Office Action dated May 27, 2019, 10 pages (English machine translation included).
Chinese Application No. 201610201273.1, Office Action dated Jun. 29, 2017, 12 pages (6 pages of Original Document and 6 pages of English Translation).
German Application No. 102015205751.8, Office Action dated Jan. 28, 2016, 5 pages (No English translation available. A summary of the Office Action is provided in the Transmittal Letter submitted herewith).

* cited by examiner

SHOE UPPER FOR SPORTS SHOES

CROSS REFERENCE TO RELATED APPLICATION

This application is related to and claims priority benefits from German Patent Application No. DE 10 2015 205 751.8, filed on Mar. 31, 2015, entitled SHOE UPPER FOR SPORTS SHOES ("the '751 application"), and is related to and claims priority benefits from European Patent Application No. DE 10 2016 201 973.2, filed on Feb. 10, 2016, entitled SHOE UPPER FOR SPORTS SHOES ("the '973 application"). The '751 and '973 applications are hereby incorporated herein in their entireties by this reference.

FIELD OF THE INVENTION

The present invention relates to a shoe upper for a sports shoe, a sports shoe, and a method for manufacturing a shoe upper for a sports shoe.

BACKGROUND

Sports shoes usually comprise an upper and a sole secured to that. Whereas the sole often consists of just one material (e.g. rubber or leather) or of only few materials, various materials are often used in a shoe upper for different areas of the foot fulfilling different functions. For example, the heel and toe area of a shoe upper is often reinforced because especially high loads occur in these areas. As a result, there is a plurality of individual parts, with a typical shoe upper for a sports shoe possibly comprising more than 15 parts. During manufacture, it is therefore particularly the assembly of these parts which is time-consuming and often carried out by manual labor.

A high amount of waste is furthermore created in the manufacture of conventional sports shoes due to the cutting of the individual parts. This material can usually no longer be used for the manufacture of sports shoes and therefore constitutes production waste or is recycled—if possible.

When cutting parts for a shoe upper out of a sheet of material (e.g. woven fabric or mesh), orientation furthermore has to be taken into consideration, since stretchability depends on the direction especially in textile materials. So as to ensure that stretchability between the individual parts of the shoe upper does not vary too greatly, the parts always have to be cut out of the sheet of material in the same orientation, whereby the manufacturing efforts increases. Furthermore, this additionally increases the produced waste, since it is usually not possible to arrange the cuts in such a way that it will be possible to cut the greatest number of parts possible from a sheet.

Therefore, the present invention is based on the problem of providing a shoe upper for a sports shoe which is provided at selected locations with certain functions like e.g. stiffness, stability and abrasion resistance, and which may generally be manufactured in a simple manner and cost effectively.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a shoe upper for a sports shoe comprises a first layer with a first surface and an opposing second surface, a first yarn section with a first diameter, wherein the first yarn section is arranged on the first surface of the first layer, and a second yarn section with a second diameter, wherein the second yarn section is arranged on the first surface of the first layer, wherein the first yarn section and the second yarn section comprise at least one parallel portion in which the first yarn section is substantially parallel to the second yarn section, and wherein a distance between the first yarn section and the second yarn section is smaller than a larger value of the first diameter and the second diameter.

In some embodiments, the distance between the first yarn section and the second yarn section is smaller than half the larger value of the first diameter and the second diameter. The distance between the first yarn section and the second yarn section may further be smaller than one third of the larger value of the first diameter and the second diameter.

In certain embodiments, the first yarn section and the second yarn section contact each other. The first yarn section and the second yarn section may contact each other over an entire length of the at least one parallel portion. The entire length of the at least one parallel portion may be at least 1 cm.

In some embodiments, the first yarn section and the second yarn section are sections of a single continuous yarn. The first yarn section and the second yarn section are sections of two distinct yarns.

According to some embodiments, the shoe upper further comprises a plurality of first yarn sections and second yarn sections with corresponding substantially parallel portions. The substantially parallel portions may be arranged in a row and the distance between the respective first yarn sections and the respective second yarn sections decreases along the row.

In certain embodiments, the shoe upper further comprises a first area in which the first yarn section and the second yarn section are arranged, comprising a yarn density of 5 to 20 yarns per centimeter. The shoe upper may further comprise a plurality of areas with different yarn densities. The yarn density of the plurality of areas may increase in a certain direction along a surface of the shoe upper.

In certain embodiments, the first diameter and the second diameter are between 0.3 mm and 2 mm.

In some embodiments, the first layer may comprise a first yarn, and the first yarn section and the second yarn section may be formed on a second yarn arranged in a second layer, wherein the first layer is arranged partially above the second layer.

In some embodiments, at least one reinforcing element is arranged between the first layer and the second layer.

In some embodiments, the first yarn and/or the second yarn may be a melting yarn. In further embodiments, the first yarn and/or the second yarn may be a filament yarn.

According to some embodiments, a shoe comprises a shoe upper as described above.

According to certain embodiments of the present invention, a method of manufacturing a shoe upper comprising a first layer with a first surface an opposing second surface, a first yarn section with a first diameter, and a second yarn section with a second diameter, comprises arranging the first yarn section on the first surface of the first layer; arranging the second yarn section on the first surface of the first layer, such that the first yarn section and the second yarn section comprise at least one parallel portion in which the first yarn section is substantially parallel to the second yarn section, and such that a distance between the first yarn section and the second yarn section is smaller than the larger of the first diameter and the second diameter.

BRIEF DESCRIPTION OF THE DRAWINGS

In the following detailed description, embodiments of the invention are described referring to the following figures.

BRIEF DESCRIPTION

Figure 1:
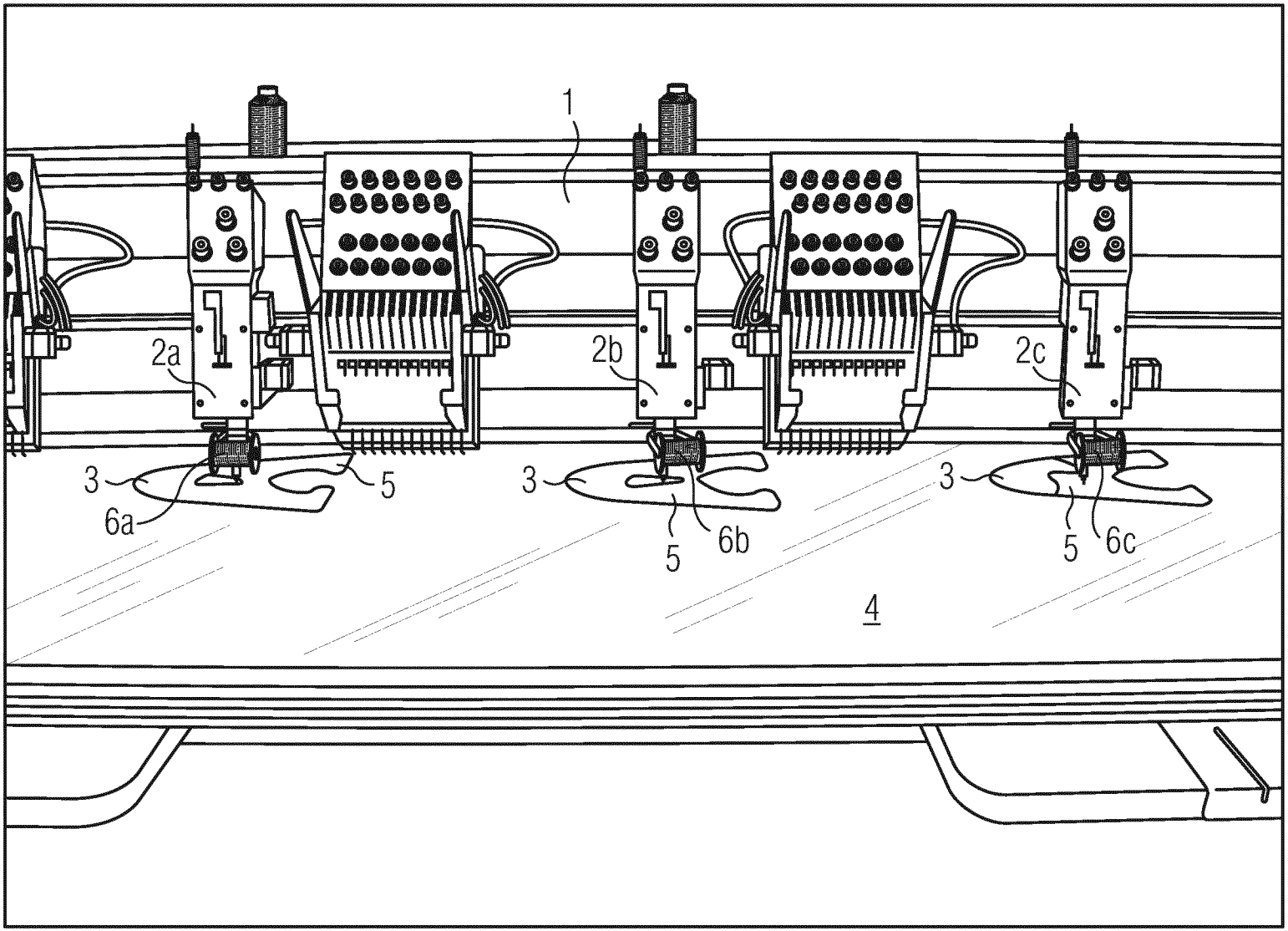
FIG. 1 is an image of an embroidery machine that is carrying out a method according to certain embodiments of the present invention.

According to a first aspect of the present invention, this problem is solved by a shoe upper for a sports shoe, comprising: (a.) a first layer with a first surface and an opposing second surface; (b.) a first yarn section with a first diameter, wherein the first yarn section is arranged on the first surface of the first layer; (c.) a second yarn section with a second diameter, wherein the second yarn section is arranged on the first surface of the first layer; (d.) wherein the first yarn section and the second yarn section comprise at least one parallel portion in which the first yarn section is substantially parallel to the second yarn section, and (e.) wherein the distance between the first yarn section and the second yarn section is smaller than the larger of the first diameter and the second diameter.

The shoe upper according to the invention comprises a first layer. To provide functions such as for example stiffness, stability and abrasion resistance, two yarn sections are arranged on a surface of the first layer. The exemplarily mentioned functions are achieved by having the two yarn sections comprise a parallel portion in which both yarn sections are substantially parallel. By this parallel arrangement the stretchability may for example be limited in a certain direction on the shoe upper, the abrasion resistance may be increased and the stability may be improved. Thereby, "substantially parallel" means within usual manufacturing tolerances. In particular, a relative angle between the first yarn section and the second yarn section of below 7°, in particular below 2°, further in particular below 1° is considered as parallel in the context of the present invention. Thus, if "parallel" is used herein, "substantially parallel" is meant in the above sense.

Furthermore, as both parallel yarn portions may be arranged and oriented almost freely on the shoe upper, for example the stretchability of the shoe upper may be predetermined in almost any arbitrary location and in an arbitrary direction. For example, the stretchability may be reduced to a minimum in the area of the heel by an substantially vertical arrangement of the yarn section in order to provide support to the heel during the push-off movement of the foot. In the area of the toe joints the roll-off movement of the foot may be supported by a corresponding parallel arrangement of the yarn sections causing a certain stretchability of the shoe upper.

The distance between the first yarn section and the second yarn section is furthermore smaller than the larger and the first diameter the second diameter. For example, if the yarn in the first yarn section comprises a diameter of 1 mm and in the second yarn section of 1.2 mm, the distance according to the invention between both yarn sections in the parallel portion is smaller than 1.2 mm. By the relatively small distance between both yarn sections the first layer is for example locally reinforced, the durability is increased and the abrasion resistance is improved.

Generally, in the context of the present invention the cutting and subsequent applying of material to provide the shoe upper locally with functions like for example stiffness, stability and abrasion resistance may be dispensed with when manufacturing the shoe upper, because these functions are fulfilled by arranging the yarn according to the solution provided by the invention. Thereby, the waste is reduced and the manufacturing is simplified and/or cost effective. Generally, in the context of the present invention yarn may also be arranged on the second surface of the first layer.

The first surface of the first layer may be facing towards the foot or facing away from the foot.

The usage of yarn for manufacturing a shoe upper is described in the German patent application DE 10 2015 205 751.8 of the present applicant. The content of the patent application DE 10 2015 205 751.8 is hereby incorporated by reference in its entirety.

Generally, in the context of the present invention, any type of yarn may be used. Examples of yarns may for example be: threads, filaments, fibers, cables, slivers, roving, single yarns, plies yarns, cords, braids, bands or ropes.

Generally, in the context of the present invention, yarns and/or sewing threads of any type of material may be used; for example: nylon, polyester, polyacrylic, silk, cotton, carbon, glass, basalt, aramids (e.g., para-aramid fibers and meta-aramid fibers), ultra-high molecular weight polyethylene, liquid crystal polymer, copper, aluminum, steel, biomaterials such as proteins (e.g. spider silk). Some yarns may include different materials above, or multiple yarns of different materials may be placed together on a carrier layer with the same stitches of sewing thread.

Also, the first layer may be any type of material in the context of the present invention. Examples of materials will be given below.

The present invention allows anisotropic flexibility of the shoe upper with a better flexion around a direction parallel to the parallel yarns than flexion around a direction orthogonal to the parallel yarns. This anisotropic flexibility may be beneficial at certain locations of a shoe upper, e.g. above the toes, where flexibility is needed around a transverse direction, but stability around a longitudinal direction.

The distance between the first yarn section and the second yarn section may be smaller than half the larger of the first diameter and the second diameter. For example, if the yarn in the first yarn section has a diameter of 1 mm and in the second yarn section of 1.2 mm, then according to the invention the distance between both yarn sections in the parallel portion is smaller than 0.6 mm. By the relatively small distance between both yarn sections the first layer is for example locally reinforced, the durability is increased and the abrasion resistance is improved.

The distance between the first yarn section and the second yarn section may be smaller than one third of the larger of the first diameter and the second diameter. For example, if the yarn in the first yarn section has a diameter of 1 mm and in the second yarn section of 1.2 mm, then according to the invention the distance between both yarn sections in the parallel portion is smaller than 0.4 mm. By the relatively small distance between both yarn sections the first layer is for example locally reinforced, the durability is increased and the abrasion resistance is improved.

The first yarn section and the second yarn section may contact each other according to the invention. The first yarn section and the second yarn section may contact each other the over the entire length of the parallel portion. Thereby, a maximum of for example stiffness, stability and abrasion resistance is achieved.

The length of the parallel portion may at least be 1 cm. Thereby, the exemplarily mentioned functions stiffness, stability and abrasion resistance may be provided over a relatively long area. In particular, the length of the parallel portion may at least be 2.5 cm and may further be at least 3 cm.

The first yarn section and the second yarn section may be sections of a single continuous yarn. Such a yarn may for example be arranged on the first layer in a fully automated fashion by a machine, as described herein in detail. Thereby, the shoe upper may be manufactured especially simply, cost effectively and quickly.

The single yarn may be folded between the first yarn section and the second yarn section. The single yarn may be folded with an angle of 180°. In this way, a parallel arrangement of the first yarn section and the second yarn section in the parallel portion is achieved.

Alternatively, the first yarn section and the second yarn section may be sections of two distinct yarns. These yarns may for example comprise different characteristics like for example diameter, moisture transport, thermal insulation, tensile strength, etc. In this way, several functions may be provided on a location of the shoe upper. For example a first yarn, on which the first yarn section is arranged, may be very abrasion resistant, while a second yarn on which the second yarn section is arranged, may have good moisture transport properties to transport moisture from the inner of the shoe to the outside. In a further example, the first yarn may be a relatively inelastic yarn to further improve the stiffness of the shoe upper. The second yarn could be a rubberized yarn which increases friction for example with a sports ball to allow for a better ball control.

The shoe upper may comprise a plurality of first yarn sections and second yarn sections with parallel sections as described before. For example a first and second yarn section with a parallel portion as described before may be arranged in a heel area. Additionally, a further first yarn section and a further second yarn section with a parallel portion as described before may be arranged in a heel area. Thus, the shoe upper may be provided with functions at specific, defined locations.

The shoe upper may have at least three, in particular five, further in particular at least 10 corresponding first yarn sections and second yarn sections each with parallel portions as described before.

If the shoe upper comprises a plurality of corresponding first and second yarn sections, respectively, the parallel portions may be arranged in a row and the distance between the respective first yarn section and the respective second yarn sections may decrease along the row. In this way, the stability, abrasion resistance, stiffness, etc. is continuously increased. In contrast for example to a separate reinforcement like for example a heel counter or toe counter made for example from plastics, an abrupt transition which is often perceived as uncomfortable is avoided.

The shoe upper may further comprise at least a first area in which the first yarn section and the second yarn section are arranged, wherein the first area comprises a yarn density of 5 to 20, in particular of 7 to 15, further in particular of 9 to 11, for example of 10 yarns per centimeter. With these yarn densities, the desired functions, e.g. stiffness, abrasion resistance, stability, etc. may be achieved.

The shoe upper may comprise a plurality of areas with different yarn densities. In this way the yarn density may be adapted to the corresponding functional requirements. For example, the yarn density in the particularly stressed heel area and toe area may be relatively high, whereas in a medial area the yarn density may be relatively low. Furthermore, it is also possible that the shoe upper comprises areas without yarn.

The yarn density of the areas may increase in a certain direction along the surface of the shoe upper. In this way, the stability, abrasion resistance, stiffness, etc. is continuously increased. As a result, an abrupt transition is avoided which is often perceived as uncomfortable, as compared to, for example a separate stiffening like for example a toe or heel counter made from e.g. plastics.

The first diameter and the second diameter may be between 0.3 mm and 2 mm, in particular between 0.8 mm and 1.3 mm, in particular about 1 mm, for example 0.9 mm or 1.1 mm. Yarn diameters within these ranges have shown to be advantageous for achieving the desired functions.

The first yarn section and the second yarn section may be arranged in a heel area, an area of the foot opening, a lacing area, or a toe area of the shoe upper. In particular in these areas certain functions like e.g. stiffness, abrasion resistance and low stretchability are often desired which may be very simply provided according to the invention.

The yarn or the yarns, respectively, forming the first yarn section and/or the second yarn section may be sewn to the first layer. Sewing may be performed in a fully automated manner by means of a suitable machine as described herein in detail. Generally, in the context of the present invention the first yarn section and the second yarn section may be connected to the first layer in a different way, e.g. by gluing.

The first yarn section and the second yarn section may be sewn to each other. In this way the stability within the parallel portion may be increased even more.

A sewing thread may be used for sewing. Thus, the desired properties of the shoe upper are defined by the yarn of both yarn sections, whereas the sewing thread may be chosen such that it fixes the yarn or the several yarns as good as possible and may be manipulated in a simple way. The swing thread may be thinner than the yarn or the yarns, respectively, of the first and second yarn sections.

In general, in the context of the present invention, the sewing thread may be any type of thread.

The sewing thread may be a thread that dissolves in water. In this way, the sewing thread may hold the yarns in place during manufacturing and be removed afterwards. The yarns may be arranged in such a way that they provide stability to the shoe upper without the sewing thread. For example, the yarns may be joined to each other by glue, by partial melting of the yarns or they may be braided together.

The sewing thread may be a melting thread. Thus, the sewing thread may melt by the application of heat and firmly bond the yarns together when cooling down. This may for example allow for use of yarns made from filaments, i.e. bundles of filaments which are not twisted (or not braided). The filaments would then be locally fixed relatively to each other by the molten sewing thread. It should be noted that the use of untwisted filaments is made possible by the present invention, namely by sewing the filament bundles to a first layer or carrier layer with or without a melting sewing thread.

Two sewing threads could be used in a parallel arrangement. The first sewing thread could be a non-melting thread, whereas the second sewing thread could be a melting thread. In this way, the second thread may melt when applying heat and firmly hold the yarns when cooling down and also join the first sewing thread to the yarns. As another example, one sewing thread may have a high tensile strength to ensure the attachment of the yarns while another sewing thread would have a high friction to improve the grip of the shoe upper for example on a ball.

In the context of the present invention and its variations which will be described below, the first layer or carrier layer may be any type of layer, such as in particular a polymer layer, a non-woven layer, a textile layer, a woven layer, a knitted layer, a mesh, etc.

Also, in the context of the present invention and its variations, yarns may be present in certain locations (or areas) of a shoe upper or apparel, whereas in other locations, no yarn is present. Also, different yarns with different properties may be used in different locations of the apparel or shoe upper, to provide different functions to those different areas. Also, the thickness of the yarns may be varied in different locations.

The first layer may comprise yarn. Yarn may for example be sewn onto a carrier layer by means of a suitable machine as described in the above mentioned patent application DE 10 2015 205 751.8.

The carrier layer may be dissolvable, such that the shoe upper is formed substantially by yarn. This improves breathability of the shoe upper, since the exchange of air and moisture is impaired less. Additionally, the shoe becomes lighter, since the weight of the carrier layer is removed.

The carrier layer may be dissolved in a solution and the material of the carrier layer may subsequently be recycled. For example, the solution may evaporate such that the material of the carrier layer remains. In this way, the material of the dissolvable carrier layer may be recycled many times.

Alternatively, the first layer may also be a weft knit, warp knit, a textile, leather or artificial leather. These materials already roughly specify certain properties of the shoe upper, such as stretchability, stability or breathability/water permeability. The specific functions of the shoe upper are defined by the arrangement of the first and second yarn sections and further such yarn sections if needed. It is only the arrangement of the yarn or yarns in a first and second yarn section with a parallel portion which provides the shoe upper with the desired properties of the finished sports shoe, defining its stretchability, stiffness, stability and breathability, for example.

The first layer may comprise a first yarn, and the first yarn section and the second yarn section may be formed on a second yarn arranged in a second layer, wherein the first layer and the second layer may be arranged partially above each other. By using two layers the shoe may be provided with specific properties in a targeted fashion. For example, the first layer may comprise a relatively inelastic yarn to further improve the stiffness of the shoe upper. The second layer could comprise a rubberized yarn which increases friction for example with a sports ball to allow for a better ball control. In a further example a melting yarn may be used in the toe area, in the heel area, on a lateral or medial side or in an arbitrary area of the shoe upper in the second layer to provide these layers with stability in a targeted fashion by melting yarn in these areas such that certain melting areas are created. In another example, a very abrasion resistant yarn is used in the second layer to increase the durability of the shoe upper.

The first yarn may be sewn to the second yarn. In this way, the two yarns are tightly fixed to one another and the shoe upper is provided with stability.

The first yarn may be sewn substantially along the entire length of the first yarn to the second yarn. In this regard, "substantially" means with the exception of manufacturing tolerances and possibly unavoidable yarn-feed residues. In this way, the first yarn and the second yarn are fixed with respect to one another and the shoe upper is given the desired shape.

The first yarn and/or the second yarn may be sewn onto itself. The first yarn may be sewn onto itself substantially along its entire length. In this regard, "substantially" means with the exception of manufacturing tolerances and possibly unavoidable yarn-feed residues. For example, the first yarn and/or the second yarn may be folded by 180° to form two parallel sections which are sewn onto each other. Stability and rigidity of the shoe upper are increased by these steps.

The first layer may be arranged substantially in the entire shoe upper. The second layer may be arranged in selected locations of the shoe upper. In further embodiments of the invention, the second layer is arranged in the heel area, in the toe area or in the area of the shin, on a lateral or medial side. Generally, the second layer can be arranged in a specific area of the shoe upper. Due to this, the first layer may for example define the shape of the shoe upper, while the second layer can provide for example reinforcement in selected locations.

At least one reinforcing element may be arranged between the first layer and the second layer. The reinforcing element may be a heel counter, toe counter, shin guard, lateral or medial reinforcing element. Generally, the reinforcing element may be arranged in any desired area of the shoe upper. The reinforcing element may be made from plastic, textile, leather or artificial leather. In this way, the shoe upper can be reinforced without its optical appearance being impaired. The reinforcement can simply be placed over a finished first layer during the manufacturing process and the second layer can then be arranged above it.

The first yarn and the second yarn may be arranged to create at least one tunnel or pocket. A reinforcing element could be pushed into the tunnel or pocket, for example.

The first yarn may be a melting yarn. In addition or alternatively, the second yarn may be a melting yarn. Thus, the shoe upper can be reinforced easily by melting the melting yarn by the application of heat and subsequently stiffening as it cools down. Subsequent reinforcement, e.g. by parts which are glued on, is thus not necessary. Nonetheless, subsequently gluing, sewing or welding parts, e.g. a heel or toe counter, onto the shoe upper is not precluded.

The first and/or the second yarn may be a filament yarn. Filament yarns are particularly suitable for the targeted reinforcement of the shoe upper or for reducing stretchability of the shoe upper. Due to integrating the filament yarn, an additional step of reinforcing or reducing stretchability can be omitted.

The filament yarn may comprise carbon fibers. Carbon fibers enable a particularly strong and durable reinforcement of the shoe upper.

The yarn used in the context of the present invention may be a yarn based on basalt.

The first yarn or the second yarn may be a reflecting yarn. Reflecting yarns improve visibility of the shoe upper in darkness, thus contributing to the safety of the wearer. The reflecting yarn may be arranged in very specific areas of the shoe upper. For example, the reflecting yarn may be arranged on a lateral and/or medial side of the shoe upper in order to improve safety when crossing a road, by the headlights of approaching cars being reflected. Generally, a reflecting yarn can be arranged in the entire shoe upper. It is conceivable that the shoe upper almost exclusively comprises reflecting yarn. It is also possible for certain areas of the shoe upper to be highlighted optically by a reflecting yarn. An area comprising an additional reinforcement could be highlighted optically by a reflecting yarn, for example.

The first yarn or the second yarn may be based on Kevlar®. Kevlar® is based on aromatic polyamides (also referred to as aramids) and is usually used in form of fibers. The fibers have the distinction of comprising very high rigidity, high impact resistance, high fracture strain, good vibration reduction as well as resistance with respect to acids and alkaline solutions.

Basically, the yarn used in the context of the present invention may comprise fibers or may be made from fibers, respectively. Also, it is possible that the yarn itself is made from thin yarns which are for example twisted or twined.

The first yarn and/or the second yarn may be stiffened with resin. The shoe upper can be made extremely resilient by resin especially in combination with filament yarns such as carbon.

The first yarn section and the second yarn section may be applied to the first layer by means of UV-glue. UV-glue is activated by being irradiated with UV light and glues the yarn or the yarns in the places in which the glue was applied. In this way, certain areas of the shoe upper can be subsequently stiffened, reinforced or made more watertight. Moreover, use of a melting yarn can be dispensed with. The UV glue can be applied to the shoe upper by spraying on, coating with a doctor knife, laying on, printing on, sintering, ironing on or spreading.

The first layer may substantially be arranged in the entire shoe upper. Thereby, the first layer may define the shape of the shoe upper, whereas the second layer provides for certain functions, e.g. for reinforcement, stiffness, low stretchability, abrasion resistance, etc. in selected locations.

The first layer may substantially define the shape of the shoe upper. Thus, the first layer determines the shape of the shoe upper and substantially, i.e. except for manufacturing tolerances, forms the shoe upper.

A further aspect of the present invention relates to a shoe comprising a shoe upper according to the invention as described herein.

A still further aspect of the present invention relates to a method of manufacturing a shoe upper as described herein. The method comprises the steps: (a.) Providing a first layer with a first surface and an opposing second surface; (b.) Providing a first yarn section with a first diameter on the first surface of the first layer; (c.) Providing a second yarn section with a second diameter on the first side of the first layer, (d.) such that the first yarn section and the second yarn section comprise at least one parallel portion in which the first yarn section is substantially parallel to the second yarn section, and (e.) such that the distance between the first yarn section and the second yarn section is smaller than the larger of the first diameter and the second diameter.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments and variations of the present invention will be described in more detail below.

A first aspect of the present invention relates to a shoe upper for a sports shoe, comprising: (a.) a first layer with a first surface and an opposing second surface; (b.) a first yarn section with a first diameter, wherein the first yarn section is arranged on the first surface of the first layer; (c.) a second yarn section with a second diameter, wherein the second yarn section is arranged on the first surface of the first layer; (d.) wherein the first yarn section and the second yarn section comprise at least one parallel portion in which the first yarn section is substantially parallel to the second yarn section, and (e.) wherein the distance between the first yarn section and the second yarn section is smaller than the larger of the first diameter and the second diameter.

The shoe upper according to the invention may generally be manufactured on an embroidery machine. An embroidery machine allows machine sewing in or sewing on of yarn on woven fabrics, weft knits, warp knits, or other carrier layers through which a needle of the embroidery machine can pass.

FIG. 1 shows a multi-head industrial embroidery machine 1 by way of example as it may be used for manufacturing a shoe upper 3 and as it may generally be used in the context of the present invention and its variations which will be described below. Such a shoe upper three may be a shoe upper according to the invention, also, if possibly not all features essential to the invention may be visible in FIG. 1. Embroidery heads 2*a*, 2*b* and 2*c*, each of which is involved in the manufacture of one shoe upper 3, respectively, can be seen in FIG. 1. The embroidery machine can generally be equipped with any desired number of embroidery heads. The embroidery heads 2*a*, 2*b* and 2*c* are at least moveable in a horizontal plane, for example electro-mechanically or pneumatically, and they enable any desired positioning of the needle and the yarn.

In a first step, a carrier layer is provided, which is almost transparent and labeled with reference number 4 in FIG. 1. This can be foil, woven fabric, textile, leather, artificial leather or plastic. Generally, any type of extensive structure through which a needle can pass during embroidery can be used.

It is also conceivable that the carrier layer 4 is a foil which dissolves at least partially under certain conditions, for example when it gets into contact with water. Then, the result of the manufacturing method will be a shoe upper 3 which no longer comprises the carrier layer 4 at all or at least no longer completely comprises it. In that case, the shoe upper 3 is substantially formed from a yarn 5 or the multiple yarns 5. For example, the yarn or the yarns five may form the first layer of the shoe upper. In addition or alternatively, the yarn or the yarns 5 may also form the first and/or the second yarn section.

Basically, as illustrated in FIG. 1, for manufacturing a shoe upper according to the invention, the first layer may be manufacture on the carrier layer 4 from yarn by means of the embroidery machine 1 first as described below. Subsequently, the first yarn section and the second yarn section may be arranged on this first layer by means of the embroidery machine 1.

The carrier layer 4 may be coiled up on a roll, for example, and it is uncoiled at least partially and positioned under one or multiple embroidery heads 2*a*, 2*b* and 2*c* for the manufacturing method to be carried out.

The exemplary manufacturing method further comprises a step of arranging a yarn 5 or multiple yarns 5 on the carrier layer 4. According to the invention, a single yarn 5 or multiple yarns 5 can be used. When using multiple yarns 5, they can differ as regards their material properties, diameter, color, etc. The yarn 5 or the yarns 5 can be supplied to an embroidery head 2*a*, 2*b*, 2*c* via a respective yarn supply roll 6*a*, 6*b*, 6*c*.

When a yarn 5 is arranged on the carrier layer 4, it can come into contact with the latter. Generally, however, the step of arranging a yarn 5 does not necessarily involve the yarn 5 having to come into contact with the carrier layer 4. For example—as will still be explained later with regard to FIG. 3 —, a first yarn 5*a* which may form the first layer for example, may be arranged on a carrier layer 4, first of all. Said yarn 5*a* comes into contact with the carrier layer 4. A second yarn 5*b* which may for example form the first yarn section and/or the second yarn section is then arranged above the first yarn 5*a*. Although said second yarn 5*b* does not come into contact with the carrier layer 4 directly, it is arranged on the carrier layer 4.

As can be seen in FIG. 1, each of the three embroidery heads 2*a*, 2*b* and 2*c* arranges one or multiple yarns 5 for one shoe upper 3, respectively. In this regard, in certain embodiments, as best illustrated in FIG. 1, the shape of the respective shoe upper 3 is defined by the yarn 5 or the multiple yarns 5. However, this is not compulsory in the context of the present invention. Thus, as illustrated in FIG. 1, the yarn 5 or the yarns 5 specify the shape of the shoe upper 3 and fill it substantially, i.e. with the exception of unavoidable manufacturing tolerances. There is substantially, i.e. with the exception of unavoidable manufacturing tolerances, no yarn 5 outside the shoe upper 3.

Figure 2:
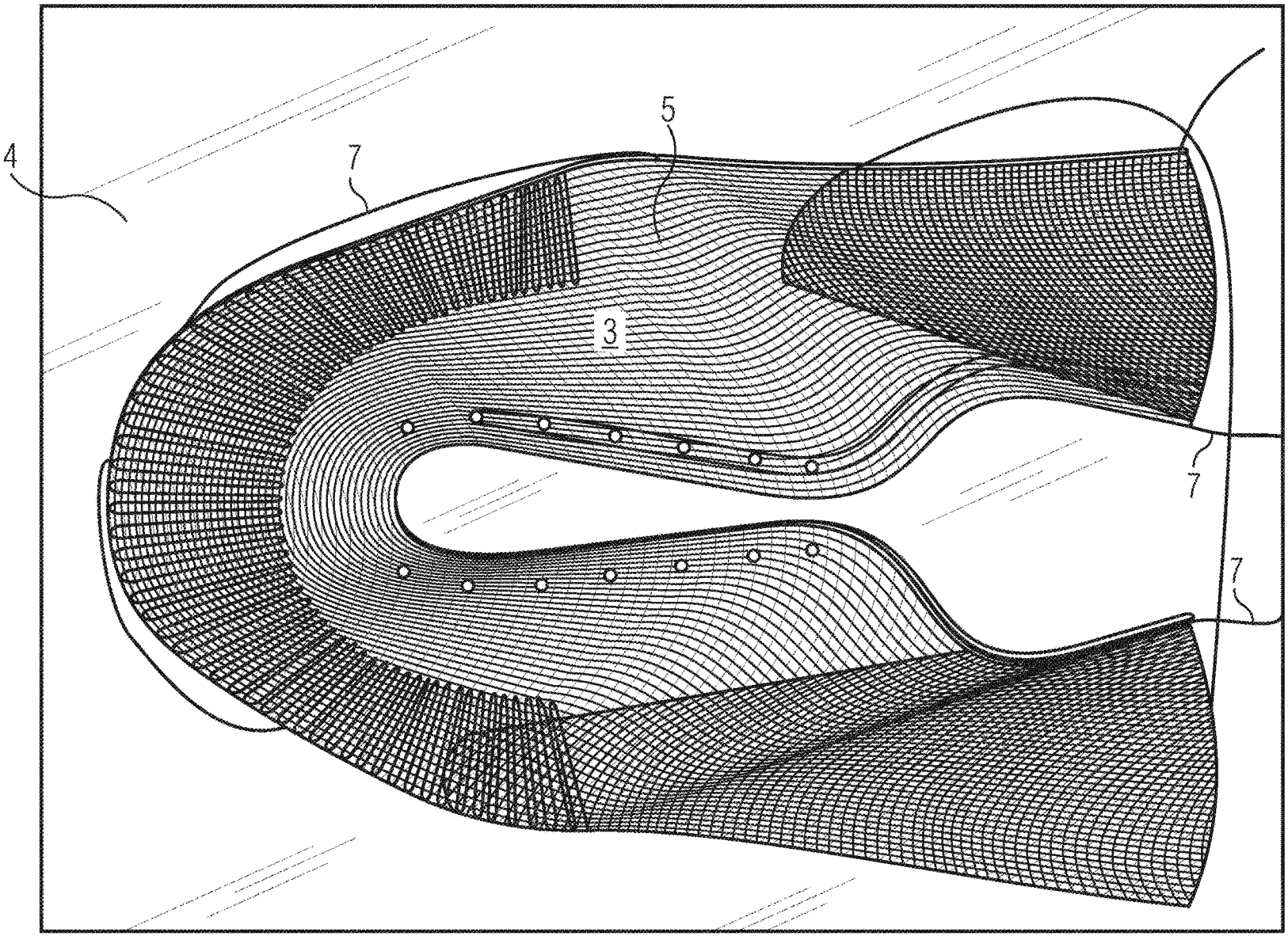
FIG. 2 is a top view of a shoe upper, according to certain embodiments of the present invention.

FIG. 2 is an exemplary top view of a shoe upper 3 manufactured by means of the method described above. Such a shoe upper three may be a shoe upper according to the invention, also, if, possibly not all features essential to the invention may be visible in FIG. 2. The shape of the shoe upper 3 is prescribed by the yarn 5. The thread residues which cannot be avoided due to the thread feeder, three of which are labeled with reference number 7 by way of example, can be removed by cutting them off, for example. Cutting off can be carried out by means of high-frequency alternating current or laser, for example.

The yarn 5 or the yarns 5 can be based on natural fibers, such as cotton, or on synthetic fibers, such as nylon, polyester, mixtures of natural and synthetic fibers, mixtures of polyester and nylon, etc. Moreover, the yarn 5 or the yarns 5 can be melting yarn. The melting yarn can be melted at least partially by warming at least a part of the shoe upper 3. During subsequent cooling, the melting yarn hardens, providing the shoe upper 3 with stability.

In certain embodiments, as best illustrated in FIG. 2, the yarn 5 is furthermore arranged in two layers. In this regard, the first, bottom layer fills the shape of the shoe upper and defines it. A second layer in the heel and toe areas of the shoe upper is arranged above said first layer and reinforces it in said areas. Generally, the second layer can also be arranged in other areas of the shoe upper, for example on a lateral and/or medial side. The first and/or the second yarn section may be arranged in the second layer.

It is also conceivable that the yarn 5 or the yarns 5 are filament yarn. Such yarn may comprise carbon fibers, for example. The filament yarn can be stiffened by subsequent treatment with resin, e.g. an epoxy-based one, UV glue or the use of melting yarns. Further examples of fibers, yarns and threads which can be used in the context of the present invention will still be explained in the sections "Fibers" and "Yarns and threads".

The exemplary manufacturing method further comprises the step of sewing the yarn 5 or at least one of multiple yarns 5 to the carrier layer 4. For this purpose, a thread (not discernible in the figures) is guided through the carrier layer 4 and around the yarn 5 or the yarns 5 by means of a needle of an embroidery head 2*a*, 2*b* or 2*c* such that the yarn 5 or the yarns 5 are fixed to the carrier layer 4. In this regard, the stitches can be placed at a distance of from merely a few millimeters to several centimeters.

The thread can generally be thinner than the yarn or the yarns 5. It is also conceivable that the thread has the same or a larger diameter than the yarn 5 or the yarns 5. A sewing thread can be used as the thread. This can be based on natural fibers, such as cotton, or on synthetic fibers, such as nylon, polyester, mixtures of natural and synthetic fibers, mixtures of polyester and nylon, etc. Examples of fibers, yarns and threads to be used will still be explained in the sections "Fibers" and "Yarns and threads".

The yarn 5 or the yarns 5 can be sewn up with the carrier layer 4 substantially along their entire length, i.e. with the exception of manufacturing tolerances and possibly unavoidable yarn-feed residues.

Figure 3:
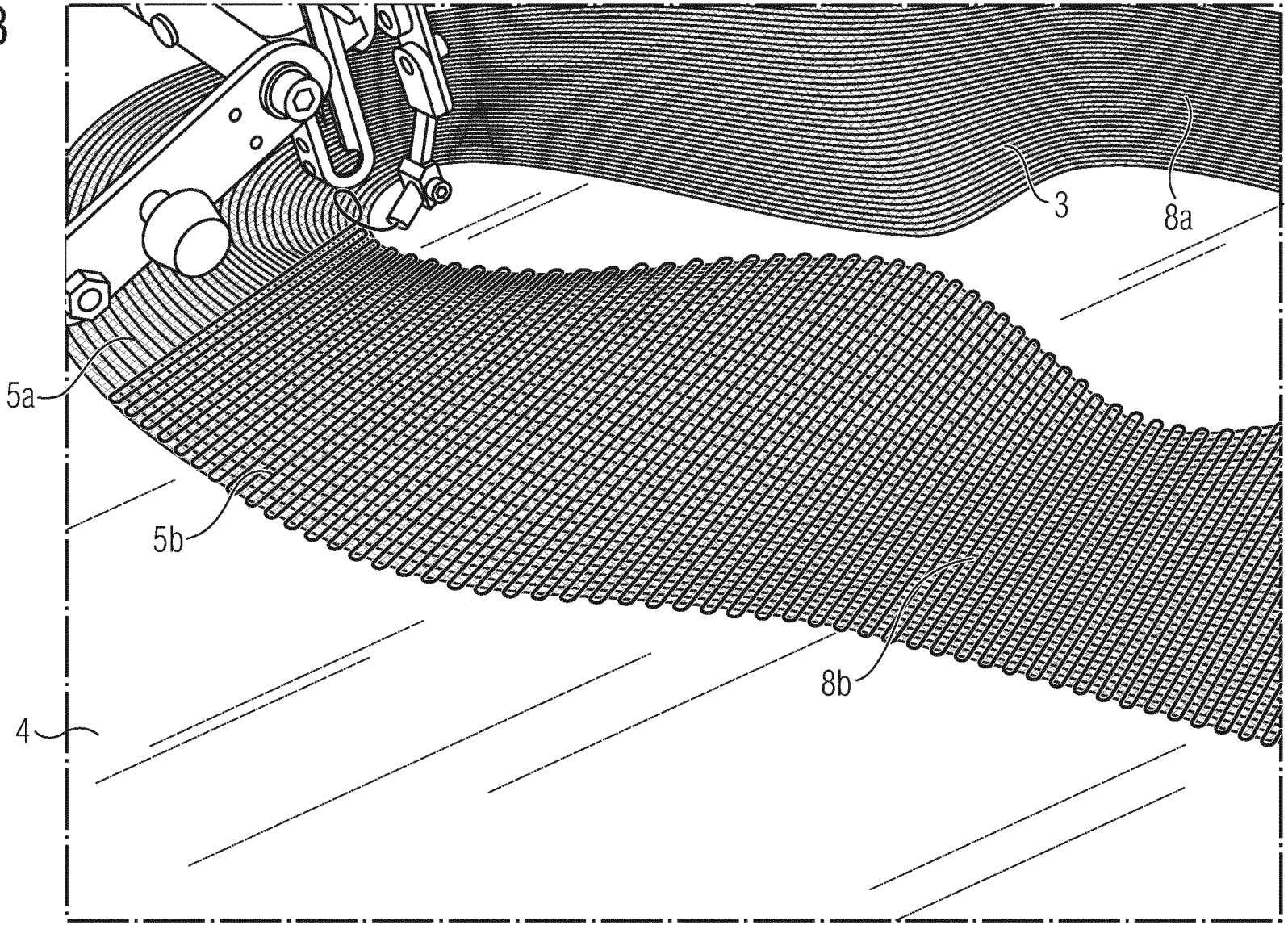
FIG. 3 is a top view of a shoe upper, according to additional embodiments of the present invention.

As was already mentioned, multiple yarns 5 can be used when carrying out the manufacturing method. In certain embodiments, as best illustrated in FIG. 3, a first yarn 5*a* and a second yarn 5*b* are used. The first yarn 5*a* and the second yarn 5*b* are arranged on the carrier layer 4. Although the second yarn 5*b* does not come into contact with the carrier layer 4 directly, it is arranged on the carrier layer 4, as was already explained.

When using multiple yarns 5, they can be sewn up with each other. For example, certain embodiments, as best illustrated in FIG. 3, the first yarn 5*a* is sewn up with the second yarn 5*b*. With respect to multiple yarns 5 being sewn up with each other, the statements made with regard to sewing up with the carrier layer 4 apply analogously. For example, as illustrated in FIG. 3, the yarn 5*a* can be sewn up with the yarn 5*b* substantially along the entire length, i.e. with the exception of manufacturing tolerances and possibly unavoidable yarn-feed residues. Such a shoe upper 3 may be a shoe upper according to the invention, also, if possibly not all features essential to the invention may be visible in FIG. 3.

For sewing the yarns 5 up with each other, the same thread can be used as for sewing the yarns 5 up with the carrier layer. With regard to certain embodiments, as best illustrated in FIG. 3, for example, the yarn 5*a* and the yarn 5*b* can be sewn up with the carrier layer 4 and the yarn 5*a* with the yarn 5*b* simultaneously with a single thread stitch. However, it is also possible that only the yarn 5*a* is sewn up with the carrier layer 4 and that the yarn 5*b* is sewn up with the yarn 5*a* but not with the carrier layer 4. For sewing the yarns 5 up with each other, it is also possible to use another thread than for sewing a yarn 5 up with the carrier layer 4.

A yarn 5 can also be sewn up with itself. If the yarn 5 is arranged in loops or circumferentially on the carrier layer 4, as suggested in FIG. 3, for example, then adjacent locations of the yarn 5 can be sewn up with each other. This can occur substantially along the entire length of the yarn 5, i.e. with the exception of manufacturing tolerances and possibly unavoidable yarn residues, or alternatively only in pre-specified areas of the shoe upper 3.

As was shown in FIG. 3, in case of use of multiple yarns 5, they can be arranged in layers. As illustrated in FIG. 3, the first yarn 5*a* forms a first layer 8*a*, which substantially corresponds to the shape of the shoe upper 3, i.e. with the exception of manufacturing tolerances and possibly unavoidable yarn residues, whereas the second yarn 5*b* forms a second layer 8*b* arranged above the first layer 8*a*. Thus, the first layer 8*a* is arranged substantially in the entire shoe upper 3, whereas the second layer 8*b* is arranged in a partial area of the shoe upper 3.

As shown in FIG. 3, the second layer 8*b* is arranged substantially, i.e. with the exception of manufacturing tolerances and possibly unavoidable yarn residues, completely above the first layer 8*a*. However, it is also conceivable that the second layer 8*b* is arranged partially above the first layer 8*a* and is in direct contact with the carrier layer 4 in another area, for example.

Figure 4A:
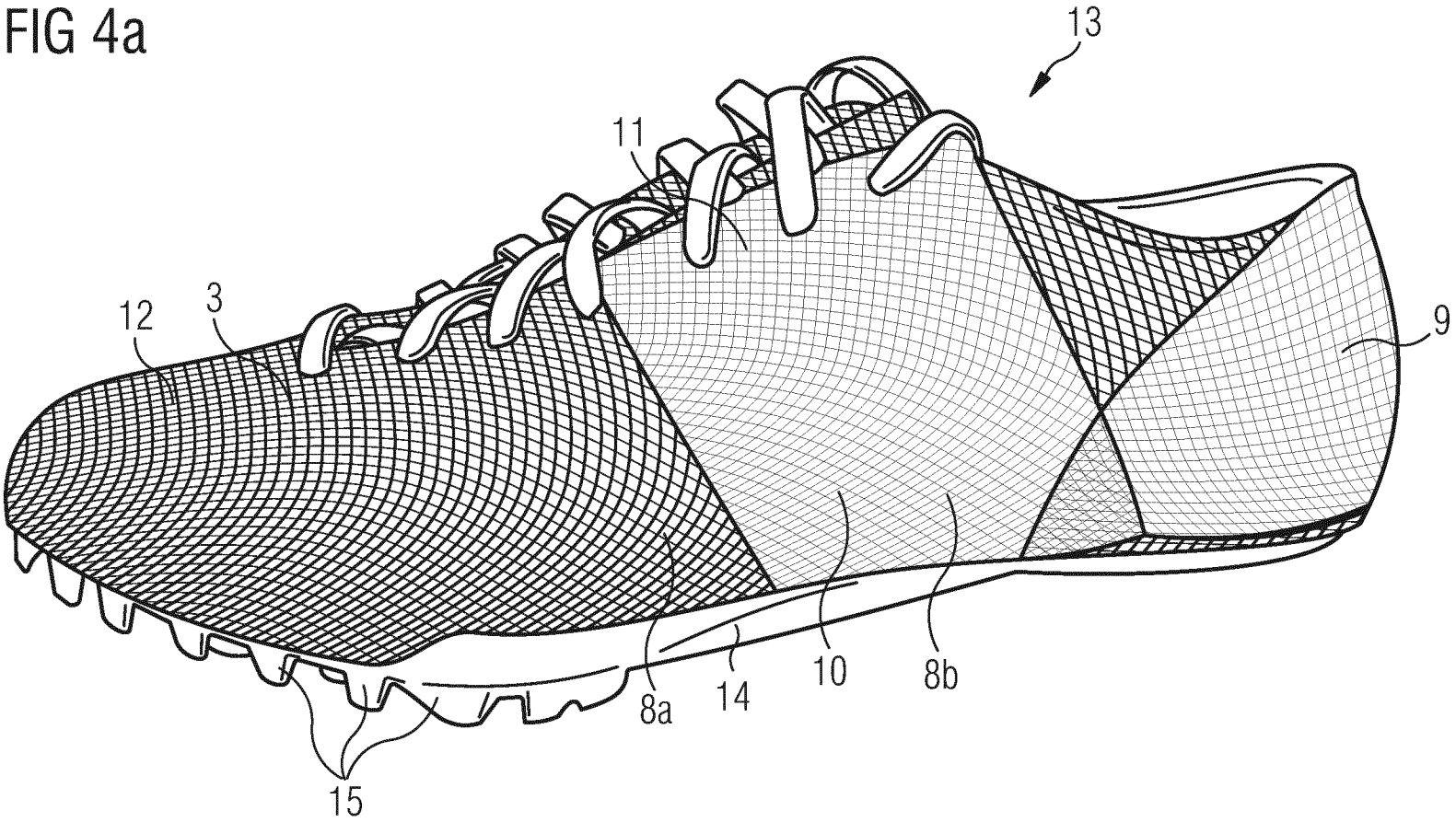
FIG. 4*a* is a side view of a sports shoe, according to certain embodiments of the present invention.

The second layer 8*b* can be arranged in selected places of the shoe upper 3. For example, in certain embodiments, as best illustrated in FIG. 4*a*, which will still be explained in more detail, a second layer 8*b* is arranged above a first layer 8*a* only in the heel area 9 and in the midfoot area 10. In shoe uppers according to the invention which extend beyond the ankle (not shown in the figures), it is also conceivable that a second layer is arranged in the area of the shin. Basically, the first yarn section and/or the second yarn section may be arranged in the second layer.

Figure 5:
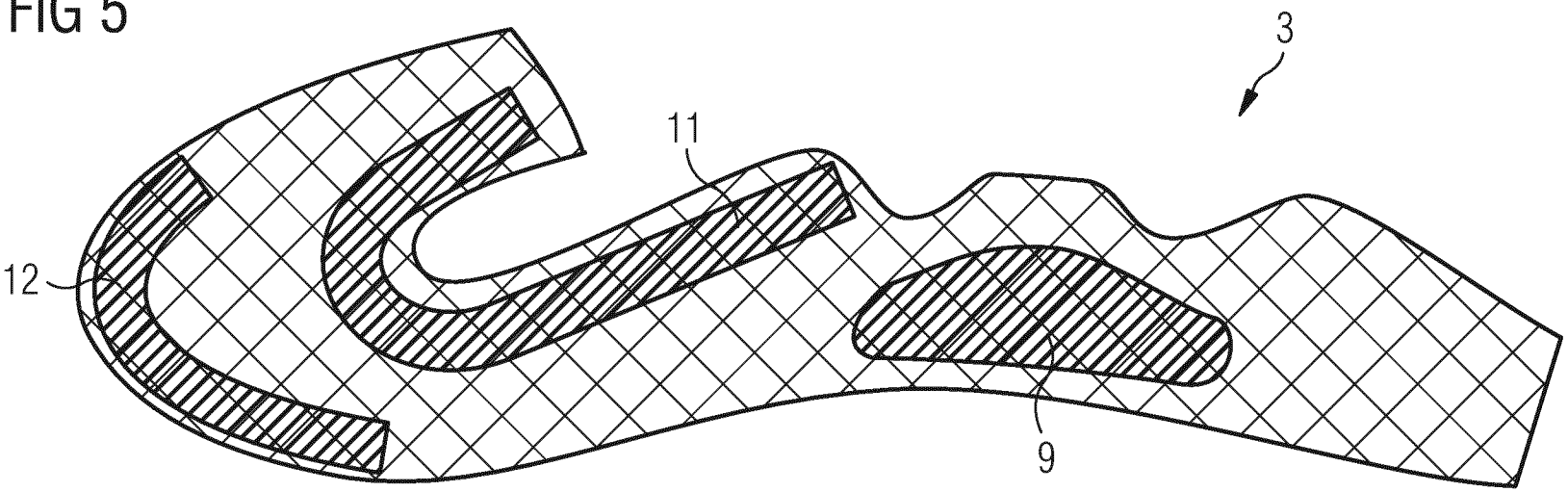
FIG. 5 is a schematic view of a shoe upper, according to certain embodiments of the present invention.

At least one reinforcing element can be arranged between the first layer 8*a* and the second layer 8*b*. In the schematic view of FIG. 5, for example, a reinforcement was arranged above a first layer in the heel area 9, in the area 11 of the lace eyelets and in the toe area 12, respectively, and a second layer was then arranged above that. The reinforcing element could also be a shin guard if the shoe upper extends beyond the ankle (not shown in the figures). Such a shoe upper 3 may be a shoe upper according to the invention, also, if possibly not all features essential to the invention may be visible in FIG. 5. For example, the first yarn section and/or the second yarn section may be arranged in the second layer.

Other shoe components, such as eyelets, decoration elements, decoration stripes, abrasion protection elements, rib elements, stiffening elements, supporting elements, cushioning elements and fiber elements can generally also be arranged between the first layer 8*a* and the second layer 8*b* additionally or alternatively. For example, lace eyelets, through which the laces are threaded, could be arranged between the first layer 8*a* and the second layer 8*b*. The eyelets could be tightly connected with the yarn of the first layer 8*a* and the second layer 8*b* using melting yarn or a polymer coating. Alternatively, the eyelets could be fixed by means of UV glue (or other glue).

Another example is arranging a heel counter between the first layer 8*a* and the second layer 8*b* in the heel area of the shoe upper. The heel area of the shoe upper is subject to particularly high mechanical stress due to the rolling-off motion of the foot, so that the shoes are frequently reinforced with a heel counter in the heel area. According to the invention, a heel counter can be integrated into the shoe upper by the heel counter being arranged between the two layers. Additionally or alternatively, a toe counter can also be arranged between the two layers. The shoe upper can generally be reinforced by additional reinforcing elements in arbitrary locations.

A still further example is arranging support for the midfoot area between the first layer 8*a* and the second layer 8*b*. The midfoot area of the human foot requires support by the footwear so as to avoid lowering of the midfoot. A corresponding supporting element could be arranged between the two layers and fixed by melting yarn or glue (e.g. UV glue), for example. It is also conceivable that the supporting element is welded to and or sewn up with the first layer 8*a* and/or the second layer 8*b*.

Generally, additional components can be placed between the two layers manually, semi-automatically or fully-automatically (e.g. by means of a robot arm). For example, the first layer 8*a* and the second layer 8*b* can form a tunnel or a pocket into which an additional component is pushed. It is also possible that the additional component is sewn up with, glued (e.g. by means of UV glue) or welded to the first layer 8*a* and/or the second layer 8*b* manually or automatically. Alternatively, melting yarns can be used for fixing.

Reinforcing elements and other shoe components can be arranged on the shoe upper 3 by machine and largely fully-automatically by a processing station, as described in the German patent applications of the present applicant with application numbers 10 2013 221 018 and 10 2013 221 020, for example.

The at least one reinforcing element can be manufactured from plastic, textile, leather, artificial leather or metal. It can be cut out from these materials or it can be molded or injection-molded, e.g. in case of plastic. The use of composites, e.g. on the basis of carbon fibers, glass fibers, etc. or of corresponding non-woven materials is also possible.

Targeted stiffening of the shoe upper 3 can also be achieved by applying resin or polymer, as will be explained in the section "Polymer coating". Alternatively, UV glue or melting yarn can be used for stiffening, as was already described above.

Figure 6:
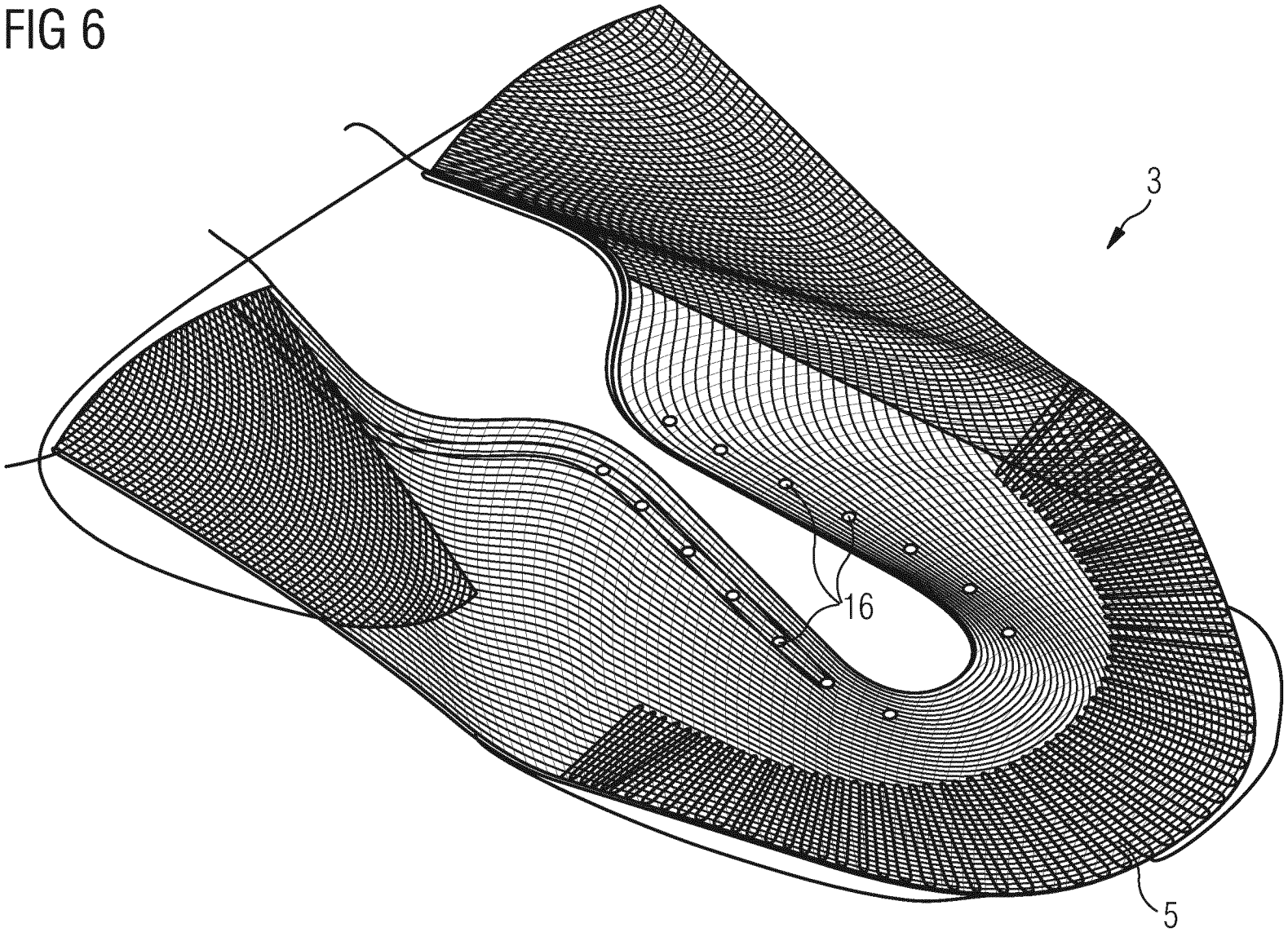
FIG. 6 is a top view of a shoe upper, according to further embodiments of the present invention.

FIG. 6 shows further embodiments of a shoe upper 3, which be obtained by the method may described above. Such a shoe upper 3 may be a shoe upper according to the invention, also, if possibly not all features essential to the invention may be visible in FIG. 6. In these embodiments, the shoe upper 3 comprises lace eyelets, three of which are labeled with reference number 16 by way of example. One or several lace/s can be pulled through the lace eyelets 16 so as to be able to lace up the finished sports shoe, as shown in FIG. 4*a* by way of example.

In certain embodiments, as best illustrated in FIG. 6, the lace eyelets 16 are formed directly when the yarn or the yarns 5 is/are arranged, i.e. no yarn 5 is arranged in the position of the respective lace eyelet 16, so that a corresponding opening remains which forms the lace eyelet 16. It is conceivable that the opening is additionally reinforced with the yarn 5 at its edge, so as to prevent fraying. Alternatively or additionally, the edge of the opening can be sewn up with the yarn used for sewing up the yarn 5 or for sewing up multiple yarns 5.

In further embodiments, the lace eyelets are formed subsequently in the shoe upper 3, e.g. by die-cutting. Additionally, the lace eyelets could be reinforced with an eyelet made from metal or plastic so as to prevent fraying. Said additional eyelet could be pressed into the shoe upper 3.

It is conceivable that apart from lace eyelets 16, other openings in the shoe upper 3 are also formed, e.g. ventilation openings. These openings can also be formed directly when arranging the yarn or the yarns 5 or alternatively subsequently, e.g. by die-cutting.

Generally, the manufacturing method for the shoe upper 3 according to the invention described herein allows simple and cost-efficient personalization by the shape of the shoe upper 3 being adjusted to the foot of a wearer of the finished sports shoe by arranging the yarn or the yarns 5 accordingly. The width of the shoe upper can be adjusted to the shape of the foot, for example. The foot of the wearer can be measured for this purpose, e.g. by means of a 3D scanner. Alternatively, the foot could be measured manually, using a measuring tape. The determined measurements could then be transformed into a program for an embroidery machine by corresponding software. This could occur in the embroidery machine or in a separate computer. The program is then read into the embroidery machine and the latter manufactures the shoe upper 3 in accordance with the previously determined measurements of the foot.

However, optical personalization by a corresponding selection of colors of the yarns or decoration in the way of embroidery is also conceivable. Yarns of different colors could be used for this. It is also conceivable to use reflecting yarns in certain areas of the shoe upper in order to achieve an optical effect in darkness when light shines thereon. Moreover, fluorescent or phosphorescent yarns can be used. Fluorescent yarns glow when irradiated with IV light, for example, as is frequently used in discotheques. Phosphorescent yarns continue to glow after they have been irradiated with light and can thus be "charged". Thus, a shoe with phosphorescent yarn can glow in the dark of its own accord.

Generally, yarns with optical properties can be used only in certain areas of the shoe upper or in the entire shoe upper.

Exemplary embodiments of a sports shoe 13 comprising a shoe upper 3 described above are best illustrated in FIG. 4*a*. Such a shoe upper 3 may be a shoe upper according to the invention, also, if possibly not all features essential to the invention are visible in FIG. 4*a*. The sports shoe 13 comprises a shoe upper 3 and a sole. The statements made in this description with regard to the shoe upper 3 and its manufacture apply.

The sole structure 14 comprises an outsole. In some embodiments, the sole structure 14 furthermore comprises a midsole and an insole, if applicable. The insole can either be removable or firmly connected to the shoe. As illustrated in FIG. 4*a*, the sole structure 14 comprises studs, three of which are labeled with reference number 15 by way of example. The sole structure 14 can be connected to the shoe upper 3 by sewing, gluing, welding (particularly ultrasonic welding) or similar connecting techniques.

Figure 4B:
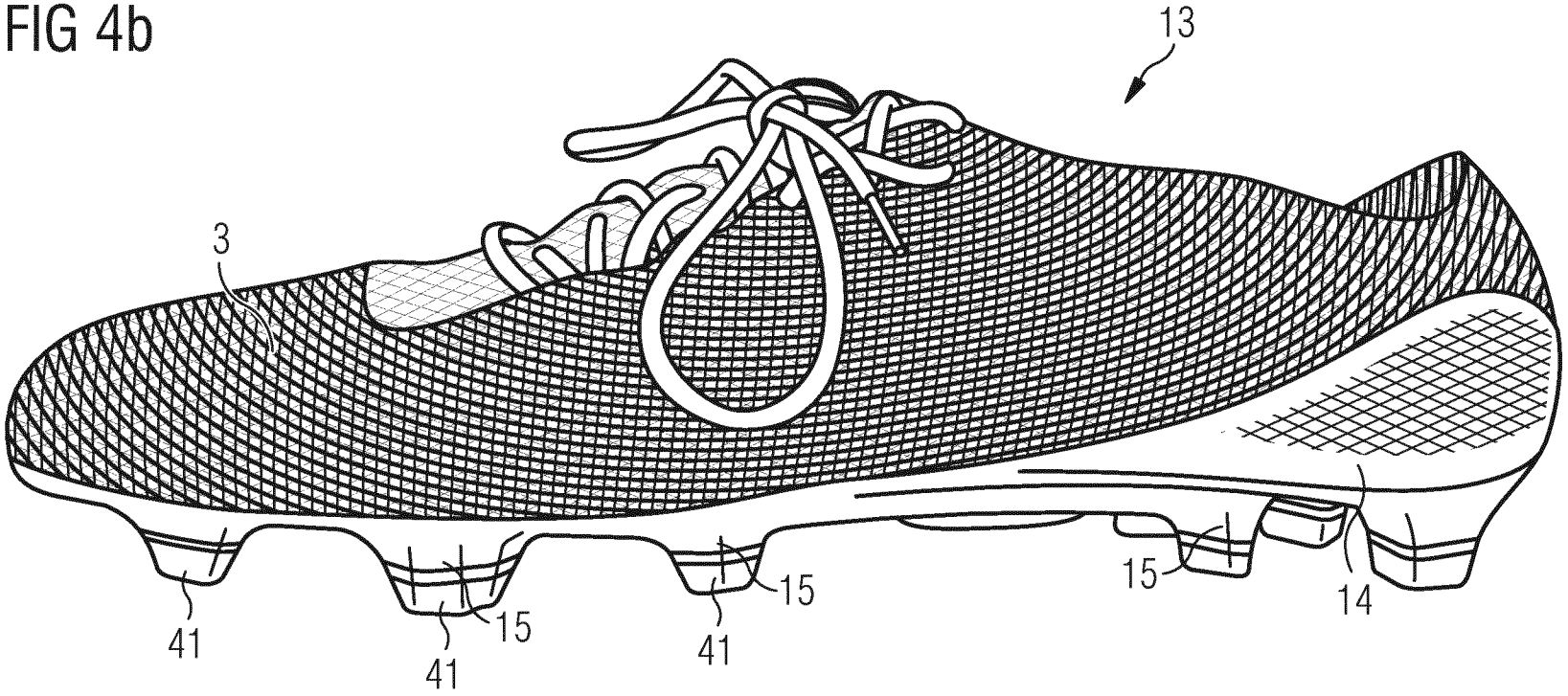
FIG. 4*b* is a side view of a sports shoe, according to further embodiments of the present invention.

FIG. 4*b* best illustrates further embodiments of a sport shoe 13. This is a soccer shoe. Accordingly, the shoe 13 comprises studs, three of which are labeled with reference number 15 by way of example. The studs 15 are attached to a sole plate 14 which is rather stiff. As illustrated in FIG. 4*b*, the studs are firmly connected to the sole plate 14. However, it is also conceivable that they are screwing studs which are screwed into the sole plate 14. As shown in FIG. 4*b*, the studs comprise transparent ends, three of which are labeled with reference number 41 by way of example. The ends 41 are injection-molded to the base of the studs 15. However, it is also conceivable that the ends are glued on or welded on.

Figure 4C:
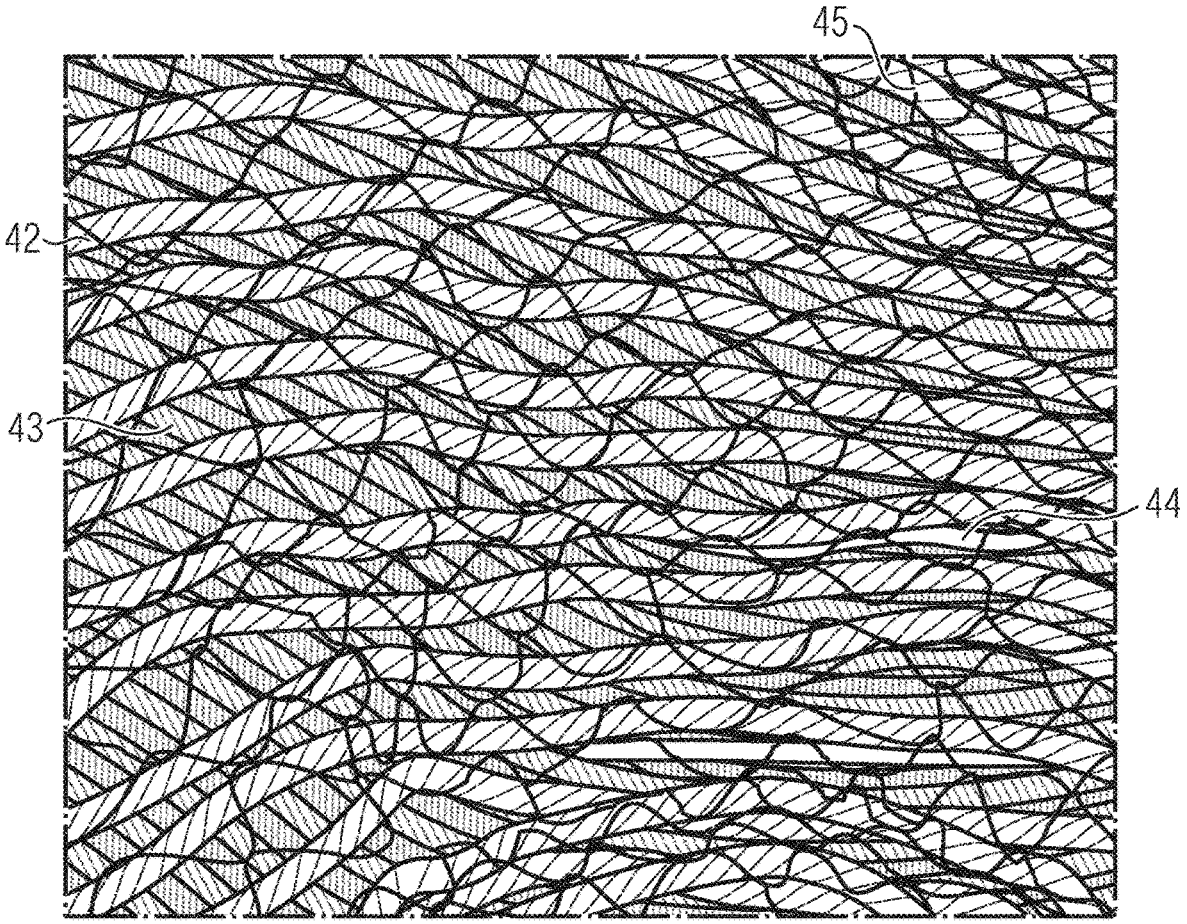
FIG. 4*c* is a detailed view of the sports shoe of FIG. 4*b*.

A shoe upper 3 manufactured as described above is attached to the sole plate 14. Such a shoe upper 3 may be a shoe upper according to the invention, also, if possibly not all features essential to the invention are visible in FIG. 4*b*. The shoe upper 3 is glued to the sole plate 14. However, it is also conceivable that the shoe upper 3 is welded or sewn to the sole plate 14. As shown in FIG. 4*b*, the shoe upper comprises three layers of yarns, as can be seen in the detailed view of FIG. 4*c*. The first layer is formed by a yarn 42. This layer is the outermost layer. A layer lying below it is formed by the yarn 43. This is the middle layer. The bottommost layer is formed by the yarn 44. The yarns 42, 43 and 44 are kept together by a thread 45.

As shown in FIG. 4*b*, the three layers overlap along the entire shoe upper 3. However, it is also conceivable that the three layers overlap merely in partial areas of the shoe upper 3, e.g. where contact with a football usually occurs, that is, above the toes and in the area of the instep, for example. In this way, the shoe upper 3 could become stiffer and thicker by the three-layer construction in these areas.

The three-layer construction of the shoe upper 3 furthermore provides the necessary stability and stiffness of the shoe upper 3. Moreover, the shoe upper 3 could be stiffened and reinforced by means of melting yarn, a polymer coating, UV glue or resin. It is also conceivable that reinforcing elements are arranged between the layers formed by the yarns 42, 43 and 44, as was already described.

It is also possible that the yarns 42, 43 and 44 differ with regard to their properties. For example, the yarn 43 could be a melting yarn which liquefies under application of heat and connects the layers formed by the yarns 42 and 44 to each other when it cools down subsequently. The yarn 42 of the outermost layer could be a rubberized yarn or rubber yarn which increases friction with the ball so as to enable good control of the ball. The yarn 44 of the innermost layer could be a moisture-absorbing yarn which transports moisture away from the foot.

Instead of three layers, less layers of yarns or more layers of yarns could also be used.

The statements made with regard to the other embodiments generally apply analogously with regard to the shoe upper 3, as best illustrated in FIG. 4*b*.

Fibers

The yarns 5 or threads used in the context of the present invention usually comprise fibers. A flexible structure which is rather thin in relation to its length is referred to as a fiber. Very long fibers, of virtually unlimited length with regard to their use, are referred to as filaments. Fibers are spun or twisted into threads or yarn 5. Fibers can also be long, however, and twirled into a yarn 5. Fibers can consist of natural or synthetic materials. Natural fibers are environmentally friendly, since they are compostable. Natural fibers include cotton, wool, alpaca, hemp, coconut fibers or silk, for example. Synthetic fibers include polymer-based fibers such as nylon, polyester, elastane or spandex, Kevlar®, or polyethersulfones, which can be produced as classic fibers or as high-performance fibers or technical fibers.

It is conceivable that a shoe upper according to the invention is assembled from various parts, with a shoe upper according to the invention comprising natural yarn 5 made from natural fibers and a removable part, e.g. the insole, comprising plastic, for example. In this manner, both parts can be disposed of separately. In this example, the shoe upper could be directed to compostable waste, whereas the insole could be directed to recycling of reusable materials, for example.

Figure 7:
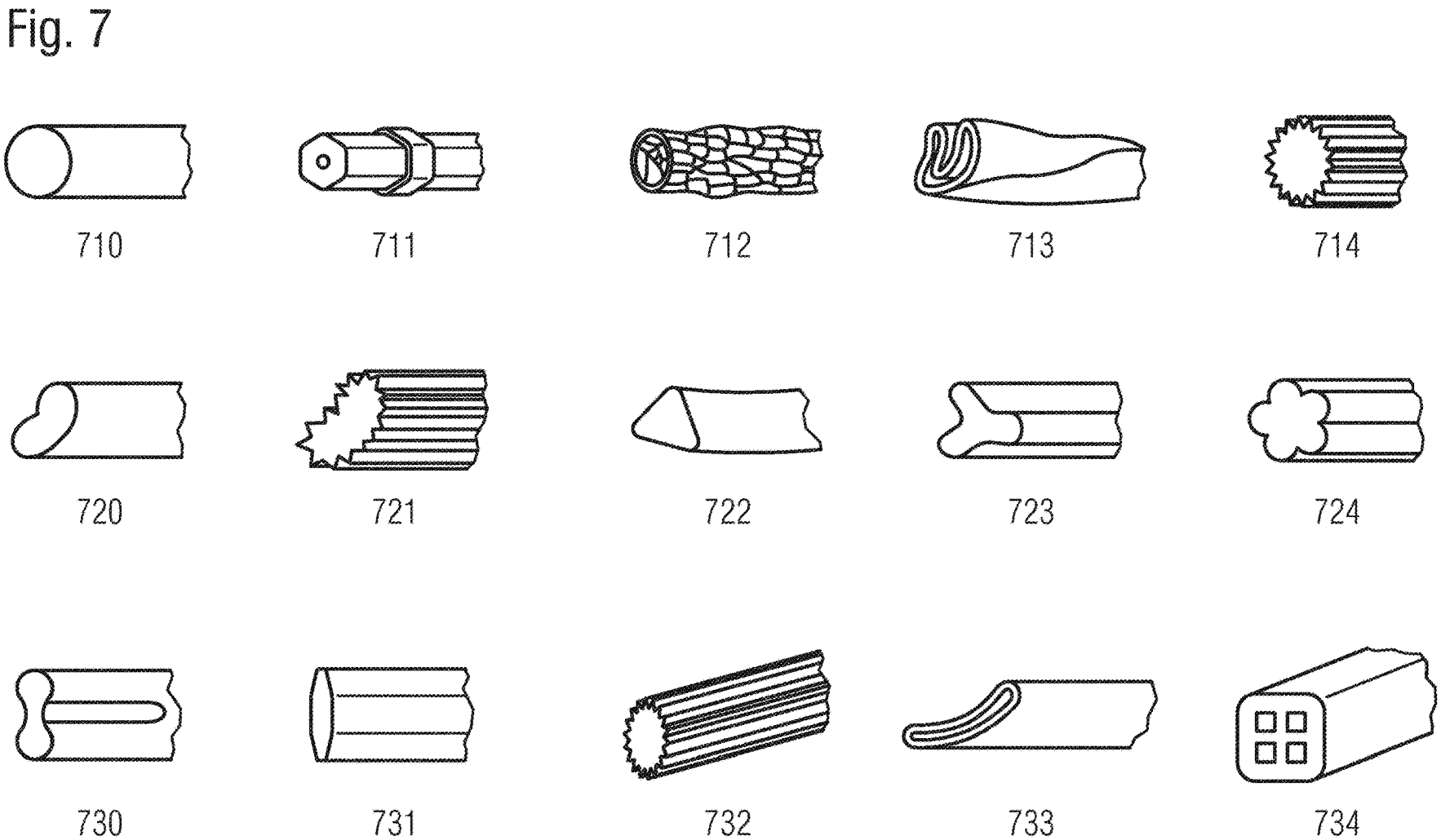
FIG. 7 is a partial view of fibers for yarns that may be used in certain embodiments of the present invention.

The mechanical and physical properties of a fiber and the yarn 5 manufactured therefrom are also determined by the fiber's cross-section, as illustrated in FIG. 7. These different cross-sections, their properties and examples of materials having such cross-sections will be explained in the following.

A fiber having the circular cross-section 710 can either be solid or hollow. A solid fiber is the most frequent type, it allows easy bending and is soft to the touch. A fiber as a hollow circle with the same weight/length ratio as the solid fiber has a larger cross-section and is more resistant to bending. Examples of fibers with a circular cross-section are nylon, polyester and Lyocell.

A fiber having the bone-shaped cross-section 730 has the property of wicking moisture. Examples of materials for such fibers are acrylic and spandex. The concave areas in the middle of the fiber support the passing on of moisture in the longitudinal direction by means of capillary action, with moisture being rapidly wicked and distributed from a certain place.

The following further cross-sections are illustrated in FIG. 7:

polygonal cross-section 711 with flowers; example: flax;

oval to round cross-section 712 with overlapping sections; example: wool;

flat, oval cross-section 713 with expansion and convolution; example: cotton;

circular, serrated cross-section 714 with partial striations; example: rayon;

Lima bean cross-section 720; smooth surface;

serrated Lima bean cross-section 721, example: Avril® rayon;

triangular cross-section 722 with rounded edges; example: silk;

trilobal star cross-section 723; like triangular fiber with a shinier appearance;

clubbed cross-section 724 with partial striations; sparkling appearance; example: acetate;

flat and broad cross-section 731; example: acetate in another design;

star-shaped or concertina cross-section 732;

cross-section 733 in the shape of a collapsed tube with a hollow center; and square cross-section with voids 734; example: AnsoIV nylon.

Individual fibers with their properties relevant for the present invention will be described below:

Aramid fibers: good resistance to abrasion and organic solvents; non-conductive; temperature-resistant up to 500° C.; low flammability.

Para-aramid fibers: known under trade names Kevlar®, Techova and Twaron®; outstanding strength-to-weight properties; high Young's modulus and high tensile strength (higher than in meta-aramides); low stretching and low elongation at break (approx. 3.5%).

Meta-aramides: known under trade names Numex, Teijinconex®, New Star™, X-Fiper®.

Dyneema fibers: highest impact strength of any known thermoplastics; highly resistant to corrosive chemicals, with the exception of oxidizing acids; extremely low moisture absorption; very low coefficient of friction, which is significantly lower than that of nylon and acetate and comparable to Teflon; self-lubricating; highly resistant to abrasion (15 times more resistant to abrasion than steel); better abrasion resistance than Teflon; nontoxic.

Carbon fiber: an extremely thin fiber about 0.005-0.010 mm in diameter, composed substantially of carbon atoms; highly stable with regard to size; one yarn is formed from several thousand carbon fibers; high tensile strength; low weight; low thermal expansion; thermal conductivity and electric conductivity.

Glass fiber: high ratio of surface area to weight; by trapping air within them, blocks of glass fibers provide good thermal insulation; thermal conductivity of 0.05 W/(m×K); the thinnest fibers are the most stable because the thinner fibers are more ductile; the properties of the glass fibers are the same along the fiber and across its cross-section since glass has an amorphous structure; correlation between the bending diameter of the fiber and the fiber diameter; thermal, electrical and sound insulation; higher stretching before it breaks than carbon fibers.

Basaltic fibers can also be used in the context of the present invention.

Yarns and Threads

In the context of the present invention a plurality of different yarns or threads can be used. As was already defined, a structure of one or several fibers which is long in relation to its diameter is referred to as a yarn.

Functional yarns are capable of transporting moisture and thus of absorbing sweat and moisture. They can be electrically conducting, self-cleaning, thermally regulating and insulating, flame resistant and UV-absorbing, and can enable reflections of infrared radiation. They can be suitable for being used as sensors. Antibacterial yarns, such as silver yarns, for example, prevent odor formation.

Metallic yarns and threads may be used in the context of the present invention and its variations to allow for electric conductivity, for example for transporting signals from a sensor.

Stainless steel yarn contains fibers made of a blend of nylon or polyester and steel. Its properties include high abrasion resistance, high cut resistance, high thermal abrasion, high thermal and electrical conductivity, high tensile strength and high weight. Gold or bronze yarns can also be used in the context of the present invention.

In shoe uppers according to the invention, electrically conducting yarns 5 can be used for the integration of electronic devices. These yarns may, for example, forward electrical impulses from sensors to devices for processing the impulses, or the yarns can function as sensors themselves, and measure electric currents on the skin or physiological magnetic fields, for example. Examples of the use of textile-based electrodes can be found in European patent application EP 1 916 323.

Melting yarns can be a mixture of a thermoplastic yarn and a non-thermoplastic yarn. There are substantially three types of melting yarn: a thermoplastic yarn surrounded by a non-thermoplastic yarn; a non-thermoplastic yarn surrounded by thermoplastic yarn; and pure melting yarn of a thermoplastic material. After being heated to the melting temperature, the thermoplastic yarn fuses with the non-thermoplastic yarn (e.g. polyester or nylon) and/or with other non-thermoplastic yarns in the shoe upper and stiffens it in certain areas. The melting temperature of the thermoplastic yarn is determined accordingly and it is usually lower than that of the non-thermoplastic yarn in case of a mixed yarn. In order to improve the bond between thermoplastic yarn and the non-thermoplastic yarn, it is possible for the surface of the non-thermoplastic yarn to be texturized.

Melting of the melting yarn usually occurs subject to pressure, preferably at a temperature of 110 to 150° C., particularly preferably at 130° C. The thermoplastic yarn melts at least partially in the process and usually fuses with the non-thermoplastic yarn. After pressing, the shoe upper is cooled, so that the bond is hardened and fixed. Due to this, the shoe upper is fixed in a predefined three-dimensional shape. The melting yarn may be arranged in the entire shoe upper or only in selective areas.

In certain embodiments, the melting yarn can be arranged between two layers of non-thermoplastic yarn of a shoe upper 3 according to the invention. In doing so, the melting yarn can simply be placed between the layers. Arrangement between the layers has the advantage that the mold does not become dirty during pressing and molding, since there is no direct contact between the melting yarn and the mold.

A shrinking yarn is a dual-component yarn. The outer component is a shrinking material, which shrinks when a defined temperature is exceeded. The inner component is a non-shrinking yarn, such as polyester or nylon. Shrinking increases the stiffness of the textile material.

A further yarn for use with the present invention is constituted by glowing or reflecting yarns and so-called "intelligent" yarns. Examples of intelligent yarns are yarns which react to moisture, heat or cold and alter their properties accordingly, e.g. contract or change their volume and thus increase permeability to air. Yarns made from piezo fibers or yarns coated with a piezo-electrical substance are able to convert kinetic energy or changes in pressure into electricity, which can provide energy to sensors, transmitters or accumulators, for example.

Yarns can furthermore generally be finished, e.g. coated, in order to maintain certain properties, such as stretching, water resistance/water repellence, color or moisture resistance.

In the context of the present invention and its variations, yarns made from filaments may be used. These filaments may be twisted or may be used untwisted in the form of filament bundles. They may also be very slightly twisted, for example of about 1 to 3 twist per inch. The present invention and its variations may be applied to such bundles of filaments. For example a bundle of filaments may be used which comprise between 2 and 2900 filaments, or more particularly between 200 and 960 filaments, in particular between 48 filaments and 384 filaments. Such bundle of filaments may have a total linear mass density of between 190 Deniers and 9800 Deniers, or more particularly of between 280 Deniers and 6500 Deniers, in particular of between 420 Deniers and 3360 Deniers. Each filament may have a total linear mass density of between 3 Deniers and 25 Deniers, in particular of between 6 and 15 Deniers, for example of 10.4 Deniers.

The average diameter of a bundle of filaments used in the context of the present invention and its variations may be between 0.3 mm and 2 mm, in particular between 0.8 mm and 1.3 mm, in particular about 1 mm, for example 0.9 mm or 1.1 mm.

Also, multifilaments, monofilaments and single filaments may be used as yarns or threads, such as sewing threads.

Polymer Coating

For certain applications and requirements, e.g. in certain areas of a shoe upper according to the present invention, it is necessary to reduce flexibility and stretchability of the shoe upper in order to achieve sufficient stability.

For that purpose, a polymer layer can be applied to one side or both sides of shoe uppers according to the invention, but generally also to other textile materials. Such a polymer layer causes a reinforcement and/or stiffening. In a shoe upper in accordance with the present invention, it may, for example, serve the purpose of supporting and/or stiffening and/or reducing elasticity in the toe area 12, in the heel area 9, along the lace eyelets 16, on lateral and/or medial surfaces or in other areas. Furthermore, elasticity and particularly stretchability are reduced. Moreover, the polymer layer protects the shoe upper 3 against abrasion. Furthermore, it is possible to give the shoe upper 3 a three-dimensional shape by means of the polymer coating by compression-molding. The polymer coating may be thermoplastic urethane (TPU), for example.

In the first step of polymer coating, the polymer material is applied to one side of the shoe upper 3. It can also be applied on both sides, however. The material can be applied by spraying on, coating with a doctor knife, laying on, printing on, sintering, ironing on or spreading. If it is polymer material in the form of a film, the latter is placed on the shoe upper 3 and connected with it by means of heat and pressure, for example. The most important method of applying is spraying on. This can be carried out by a tool similar to a spray gun. Spraying on enables the polymer material to be applied evenly in thin layers. Moreover, spraying on is a fast method. Effect pigments such as color pigments, for example, can be mixed into the polymer coating.

The polymer is applied in at least one layer with a thickness of preferably 0.2-1 mm. One or several layers can be applied, with it being possible for the layers to be of different thicknesses and/or colors. For example, a shoe upper can comprise a polymer coating with a thickness of 0.01 to 5 mm. Furthermore, in some shoe uppers 3, the thickness of the polymer coating can be in the range of 0.05 to 2 mm. Between neighboring areas of a shoe upper 3 with polymer coating of various thicknesses there can be continuous transitions from areas with a thin polymer coating to areas with a thick polymer coating. In the same manner, different polymer materials can be used in different areas, as will be described in the following.

During application, the polymer material attaches itself to the points of contact or points of intersection, respectively, of the yarn 5 or the yarns 5, on the one hand, and to the gaps between the yarn 5 or the yarns 5, on the other hand, forming a closed polymer surface on the shoe upper 3 after the processing steps described in the following. However, in case of larger recesses in the textile structure, this closed polymer surface can also be intermittent, e.g. so as to enable airing. This also depends on the thickness of the applied material: The more thinly the polymer material is applied, the easier it is for the closed polymer surface to be intermittent. Moreover, the polymer material can also penetrate the yarn 5 or the yarns 5 and soak it or them, and it thus contributes to its or their stiffening.

After application of the polymer material, the shoe upper 3 is pressed in a press under heat and pressure at least partially. The polymer material liquefies in this step and fuses with the yarn 5 or the yarns 5 of the shoe upper 3.

In a further optional step, the shoe upper 3 can be pressed into a three-dimensional shape in a machine for compression-molding. For example, the heel area 9 or the toe area 12 of a shoe upper 3 can be shaped three-dimensionally over a cobbler's last. Alternatively, the shoe upper 3 can also be directly fitted to a foot.

After pressing and molding, the reaction time until complete stiffening can be one to two days, depending on the polymer material used.

The following polymer materials can be used: polyester; polyester-urethane pre-polymer; acrylate; acetate; reactive polyolefins; co-polyester; polyamide; co-polyamide; reactive systems (mainly polyurethane systems reactive with $H_2O$ or $O_2$); polyurethanes; thermoplastic polyurethanes; polymeric dispersions.

The described polymer coating can be used sensibly wherever support functions, stiffening, increased abrasion resistance, elimination of tension, increase of comfort, increase of friction and/or fitting to prescribed three-dimensional geometries are desired. It is also conceivable that the shoe upper 3 according to the present invention is fitted to the individual shape of the foot of the wearer, by polymer material being applied to the shoe upper 3 and then adapting to the shape of the foot subject to heat.

In addition or alternatively to a reinforcing polymer coating, a shoe upper 3 according to the invention can also be equipped with a water-repellant coating in order to prevent or at least reduce the ingress of moisture. In this regard, the water-repellant coating can be applied to the entire shoe upper 3 or only to a part thereof, e.g. in the toe area 12. Water-repellant coatings can be based on hydrophobic materials such as polytetrafluoroethylene (PTFE), wax or paraffin. A commercially available coating is Scotchgard™ by 3M.

Further additionally or alternatively, the shoe upper 3 can be equipped with UV glue. UV glue is activated by being irradiated with UV light and glues the yarn or the yarns in the places in which the glue was applied. In this way, certain areas of the shoe upper can be subsequently stiffened, reinforced or made more watertight. Moreover, use of a melting yarn can be dispensed with. The UV glue can be applied to the shoe upper by spraying on, coating with a doctor knife, laying on, printing on, sintering, ironing on or spreading.

Thermoplastic Textile

A further possibility of reinforcing a shoe upper 3 in the context of the present invention is using a thermoplastic textile. This is a thermoplastic woven fabric, thermoplastic knitted fabric or thermoplastic non-woven material. A thermoplastic textile melts at least partially subject to heat and stiffens as it cools down. A thermoplastic textile can, for example, be applied to the surface of the shoe upper 3 according to the invention by applying pressure and heat. When it cools down, the thermoplastic textile stiffens and specifically reinforces the shoe upper 3 in the area in which it was placed, for example.

The thermoplastic textile can specifically be manufactured for the reinforcement in its shape, thickness and structure. Additionally, its properties can be varied in certain areas. The stitch structure, the knitting stitch and/or the yarn used can be varied such that different properties are achieved in different areas.

According to certain embodiments, a thermoplastic textile is a weft-knitted fabric or warp-knitted fabric made from thermoplastic yarn. Additionally, the thermoplastic textile can also comprise a non-thermoplastic yarn. The thermoplastic textile can be applied to a shoe upper 3 according to the invention by pressure or heat, for example.

A woven fabric whose weft and/or warp threads are thermoplastic comprise further embodiments of a thermoplastic textile. Different yarns can be used in the weft direction and the warp direction of the thermoplastic woven fabric, so as to achieve different properties, such as stretchability, in the weft direction and the warp direction.

A spacer weft-knitted fabric or spacer warp-knitted fabric made from thermoplastic material comprise further embodiments of a thermoplastic textile. In this regard, only one layer can be thermoplastic, for example, so as to be attached to the shoe upper 3 according to the invention, for example.

Alternatively, both layers are thermoplastic, e.g. in order to connect the sole 14 to the shoe upper 3.

A thermoplastic textile can be connected with the surface to be reinforced only partially, i.e. in certain areas, subject to pressure and heat so that only certain areas or only a certain area of the thermoplastic textile connects to the surface. Other areas or another area do not connect, so that the permeability for air and/or moisture is maintained there, for example. The function and/or the design of the shoe upper according to the invention can be modified by this.

Shoe Upper

Figure 8:
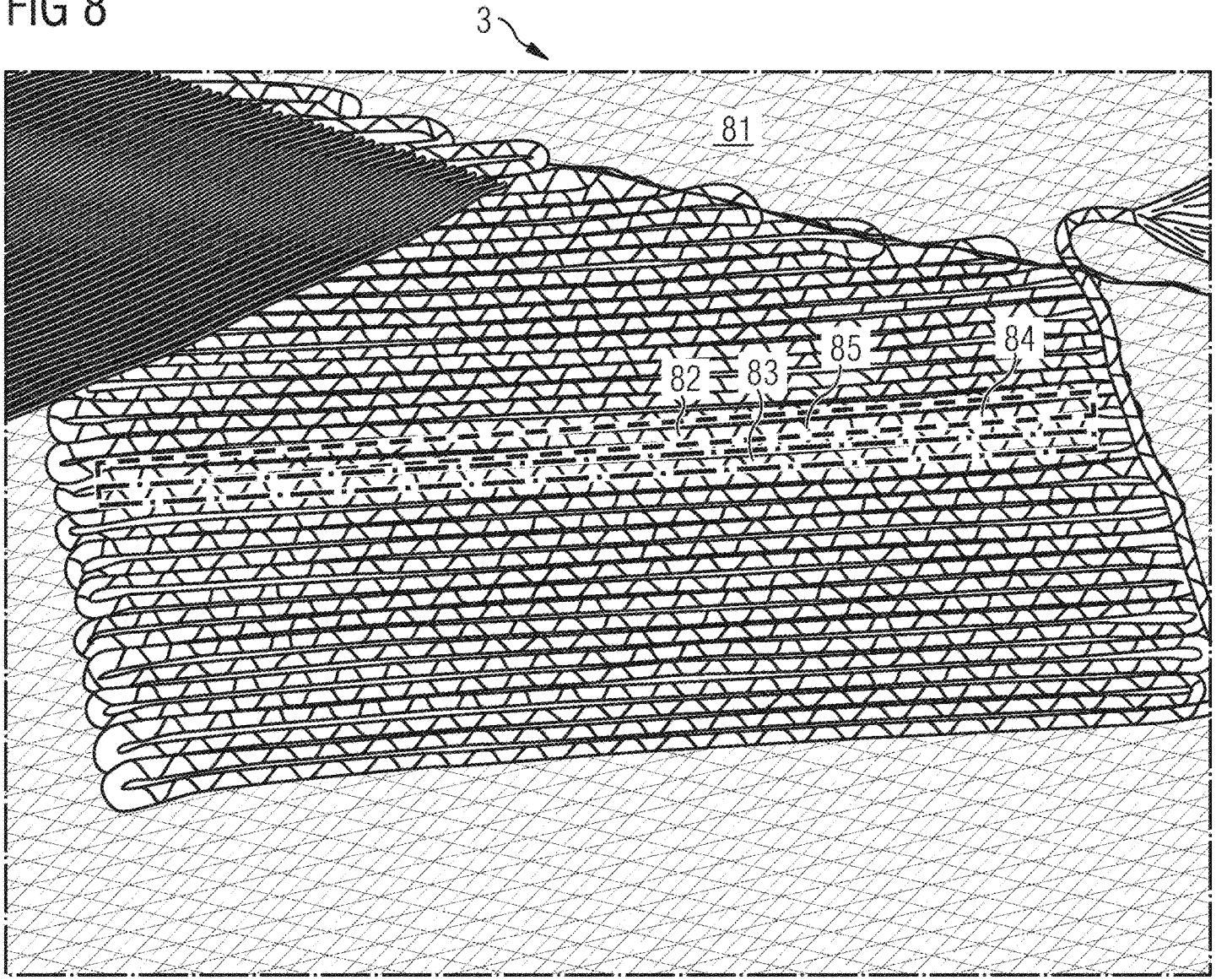
FIG. 8 is a detailed view of a shoe upper, according to certain embodiments of the present invention.

FIG. 8 shows a detail of exemplary embodiments of a shoe upper 3 according to the invention. The shoe upper 3 comprises a first layer 81 with a first surface and an opposing second surface. In these embodiments, as illustrated in FIG. 8, the first layer 81 is a mesh. In general a weft knit, warp knit, woven, textile, leather, artificial leather, or similar may be used. As shown in FIG. 8, the first surface of the first layer is facing the observer. Accordingly, the surface of the first layer 81 facing away from the observer is the second surface.

According to the invention, the shoe upper three comprises a first yarn section with a first diameter, wherein the first yarn section is arranged on the first surface of the first layer. An exemplary first yarn section is encircled in FIG. 8 and denoted by the reference numeral 82. The first yarn section 82 comprises a first diameter which is determined by the yarn of the first yarn section 82.

Further, the shoe upper three comprises a second yarn section with a second diameter, wherein the second yarn section is arranged on the first side of the first layer. An exemplary second yarn section is encircled in FIG. 8 and denoted by the reference numeral 83. The second yarn section 83 comprises a second diameter which is determined by the yarn of the second yarn section 83.

The first yarn section 82 and the second yarn section 83 comprise at least one parallel portion in which the first yarn section is substantially parallel to the second yarn section. As shown in FIG. 8, the first yarn section 82 and the second yarn section 83 are substantially parallel over the entire lengths. Accordingly, the parallel portion is substantially as long as both yarn sections. Generally, the parallel portion may however also be shorter than both yarn sections. Furthermore, it is possible that both yarn sections comprise several parallel portions in which the yarn sections are parallel to each other.

The distance between the first yarn section 82 and the second yarn section 83 is smaller than the larger of the first diameter and the second diameter. As shown in FIG. 8 the first yarn section 82 and the second yarn section 83 contact each other. Accordingly, the distance between both yarn sections is 0 mm.

In certain embodiments, as shown in FIG. 8, the first yarn section and the second yarn section are sections of the same yarn 84. Accordingly, the yarn 84 is folded between the first yarn section 82 and the second yarn section 83 in an angle of 180°. However, in the context of the present invention, it is also possible that the first yarn section 82 is arranged on a first yarn and that the second yarn section 83 is arranged on a second yarn, or that the angle in case of a single yarn is smaller or larger than 180°.

The yarn 84 may be arranged on the first layer 81 by means of an embroidery machine as described above. The thread fixing the yarn layers 82 and 83 is visible in FIG. 8 and denoted by the reference numeral 85. The thread 85 is a sewing thread with a diameter smaller than the yarn 84.

As shown in FIG. 8, the first yarn section 82 and the second yarn section 83 have been chosen as an example. In fact, in FIG. 8 a plurality of yarn sections with parallel portions is visible which are arranged in a row and which form an area in the shape of a patch with parallel yarn sections. This area may for example be arranged in a heel area or in a toe area as a reinforcement.

Figure 9A:
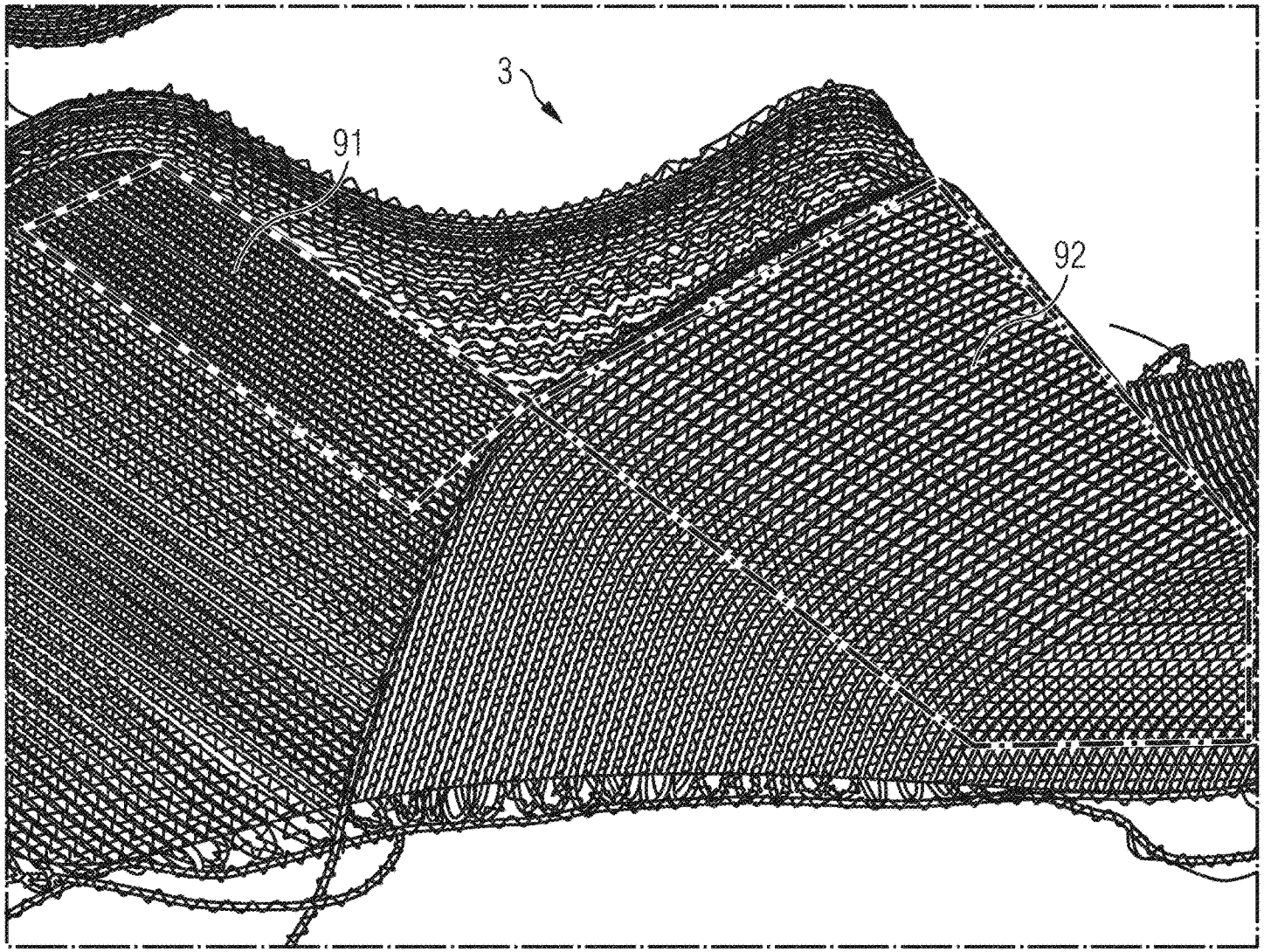
FIGS. 9*a*-9*c* are detailed views of a shoe upper, according to certain embodiments of the present invention.
Figure 9B:
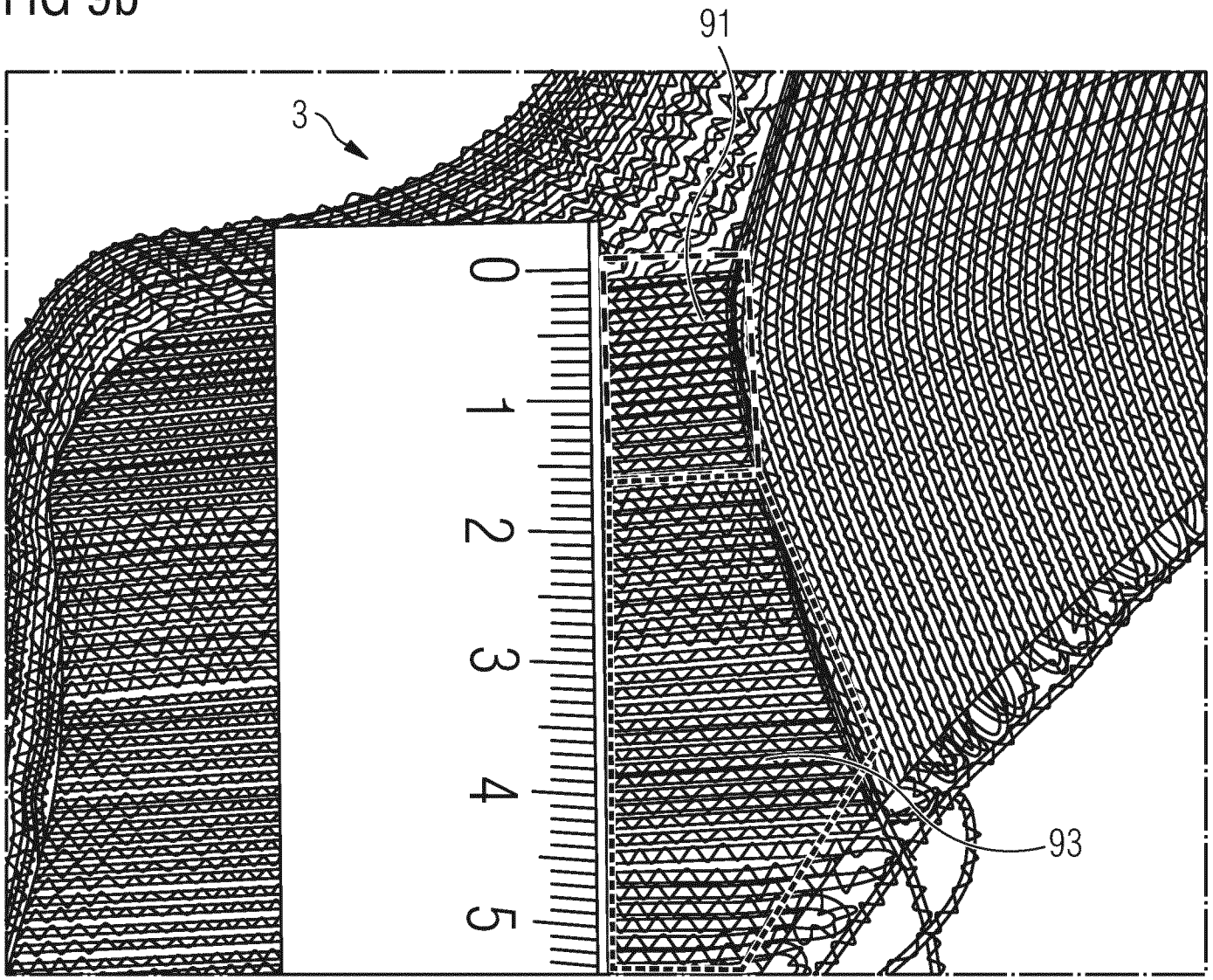
Figure 9C:
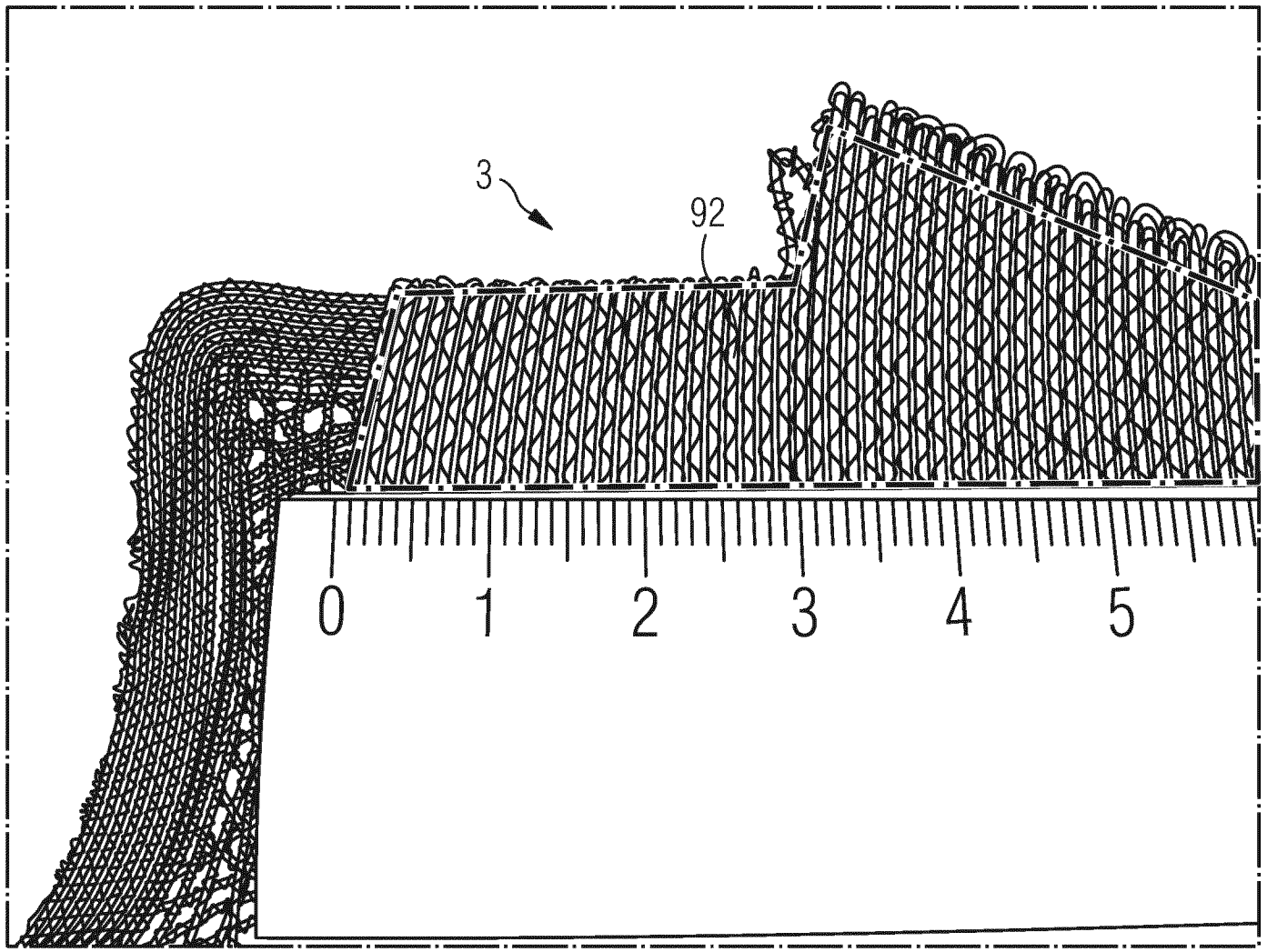

FIGS. 9*a*, 9*b* and 9*c* show details according to further embodiments of a shoe upper 3 according to the invention. A first area with parallel yarn sections is encircled in FIG. 9*a* and is denoted by the reference numeral 91, whereas a second such area is also encircled and is denoted by the reference number 92. FIG. 9*b* shows the area 91 in a detailed view. By means of the depicted ruler, a yarn density of about 10 yarns per cm results.

In FIG. 9*b*, an area 93 with a substantially lower yarn density is also shown in which the distance between the yarns is larger than their diameter.

FIG. 9*c* shows an area 92 in a detailed view. By means of the depicted ruler a yarn density of about 10 yards per centimeter results.

The yarns of the yarn sections may be arranged on the first layer by means of an embroidery machine 1 as described above. The thread fixing the yarn sections is a sewing thread with a smaller diameter than the yarn of the yarn sections.

Figure 10:
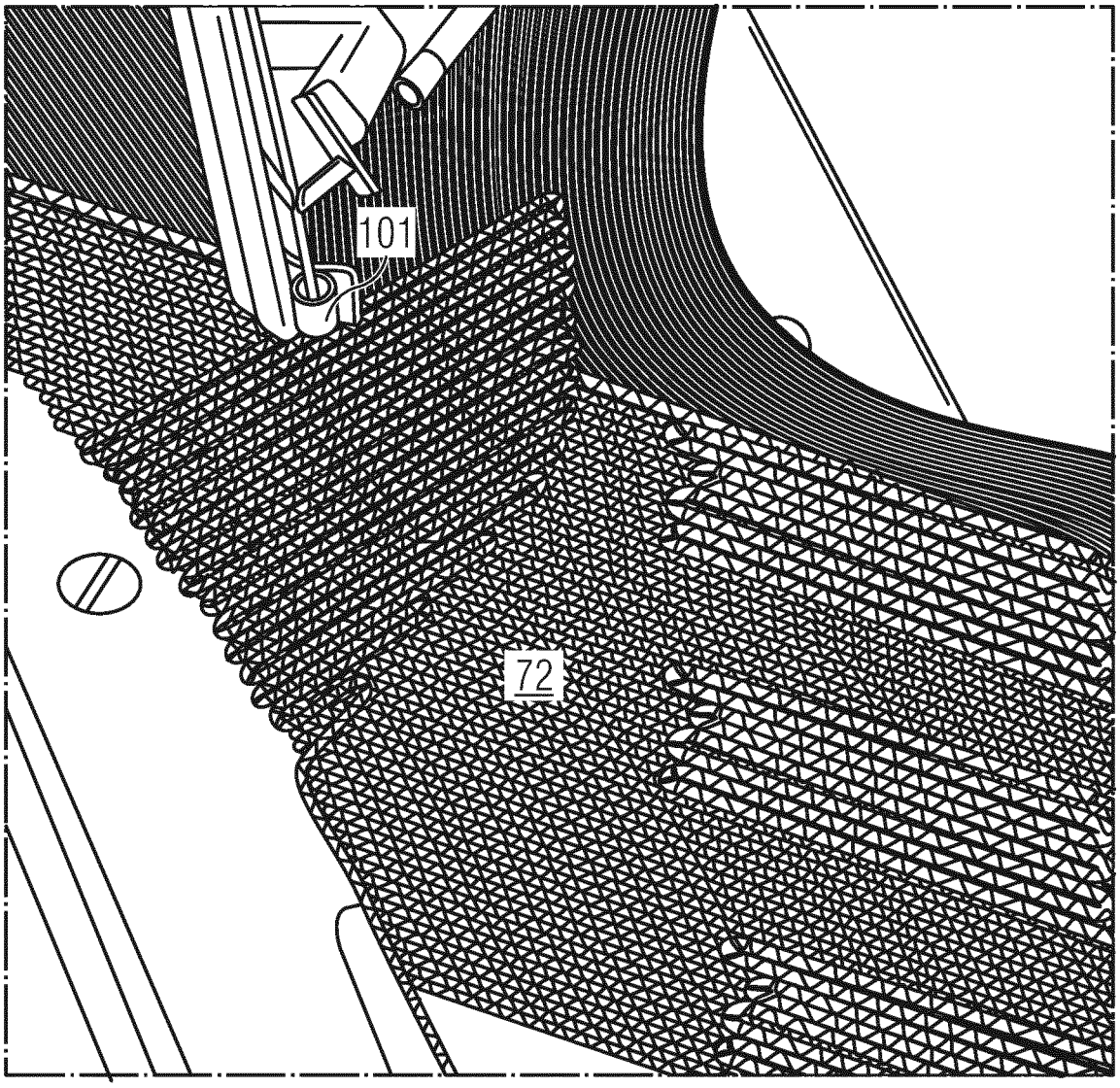
FIG. 10 is an image of an embroidery head manufacturing an area of a shoe upper, according to certain embodiments of the present invention.

FIG. 10 shows an embroidery head 101 during manufacturing an area of a shoe upper according to the invention comprising at least a first yarn section and at least a second yarn section with the powder portion. The embroidery head 101 is an embroidery head which is similar to the embroidery heads 2*a*, 2*b* and 2*c* shown in FIG. 1.

The embroidery head 101 fixes a continuous yarn on the first layer 81 by means of a thread. The at least one first yarn section and the at least one second yarn section are arranged on the continuous yarn. The first layer 81 is also made from yarn as described above in detail.

Figure 11A:
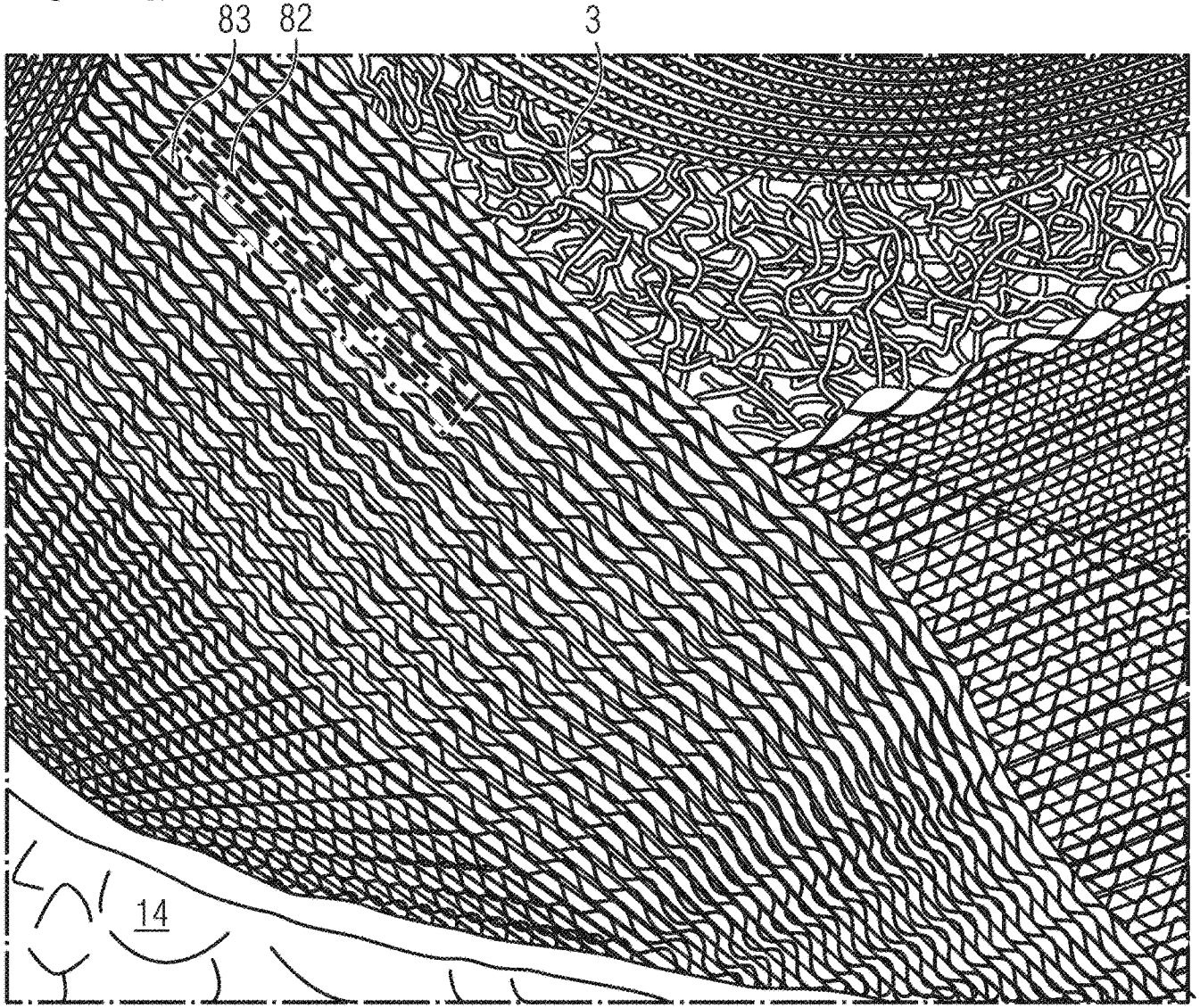
FIGS. 11*a*-11*b* are partial side views of a sports shoe, according to certain embodiments of the present invention.
Figure 11B:
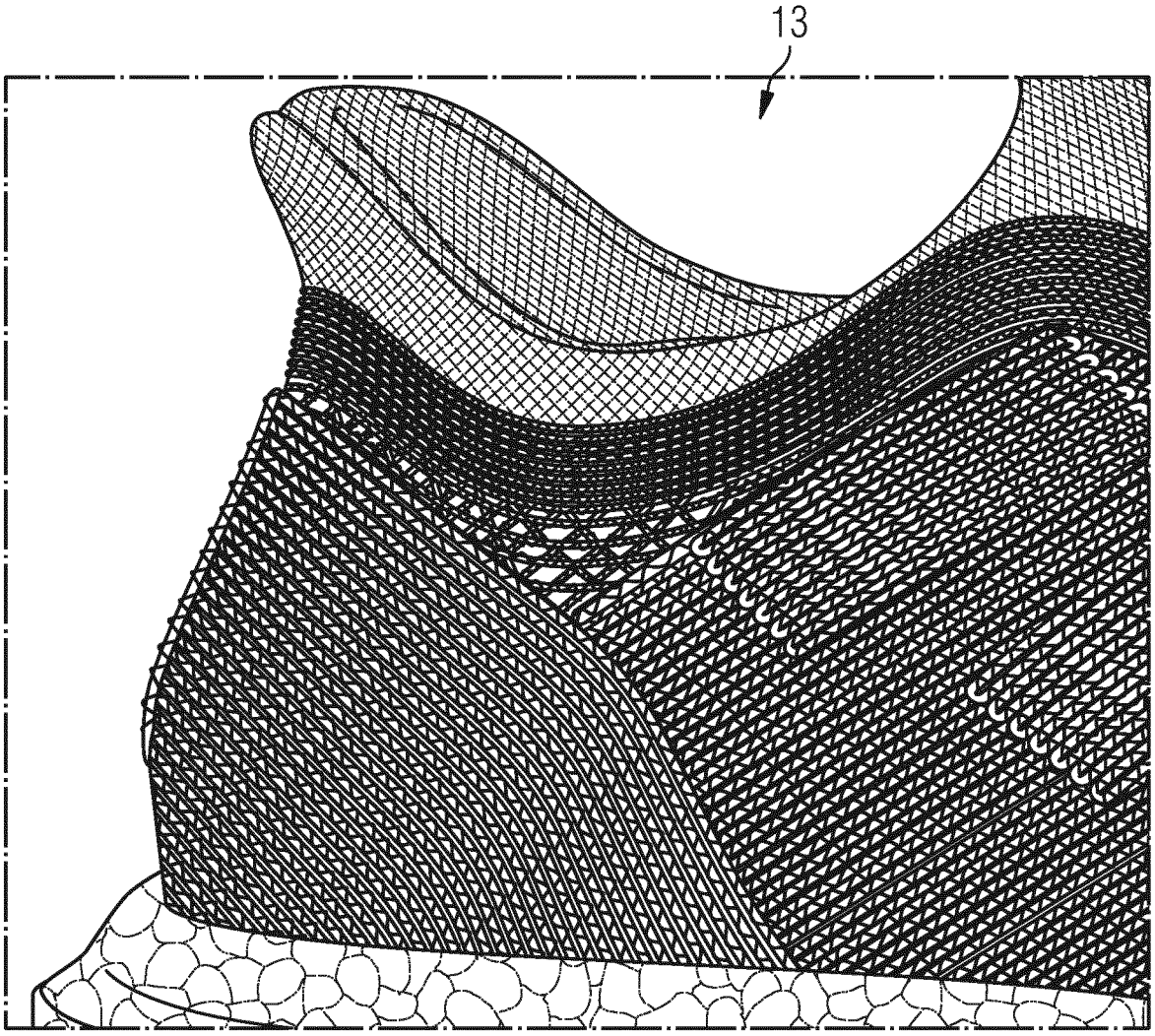

FIGS. 11*a* and 11*b* shown views of a sports shoe 13 according to the invention comprising a shoe upper 3 according to the invention. Furthermore, the sports shoe 13 comprises a sole structure 14. With respect to the sole structure 14 and with respect to connecting the shoe upper 3 to the sole structure 14 what has been said with respect to FIGS. 4*a* and 4*b* is analogously valid.

As can in particular be seen in FIG. 11, the shoe upper 3 comprises at least a first yarn section 82 and at least a second yarn section 83. The first yarn section 82 and the second yarn section 83 comprise at least one parallel portion in which the first yarn section is substantially parallel to the second yarn section. The distance between the first yarn section 82 and the second yarn section 83 is smaller than the larger of the first diameter and the second diameter. As illustrated in FIGS. 11*a* and 11*b* the first yarn section 82 of the second yarn section 83 touch each other. Accordingly, the distance between both yarn sections is 0 mm.

As shown in FIGS. 11*a* and 11*b*, the first yarn section 82 and the second yarn section 83 are shown as an example. In fact, a plurality of yarn sections with parallel portions is visible in FIGS. 11*a* and 11*b* which are arranged in a row and which form an area in the shape of a patch with parallel yarn sections. This area is arranged in a heel section of the shoe upper 3 for reinforcement and fulfils the function of a heel counter, i.e. in this area the substantially parallel yarn sections decrease the stretchability and increase the stability of the shoe upper 3.

The yarn of the yarn sections may be arranged on the first layer as described above by an embroidery machine 1. The thread fixing the yarn sections is a sewing thread with a smaller diameter than the yarn of the yarn sections.

Figure 12:
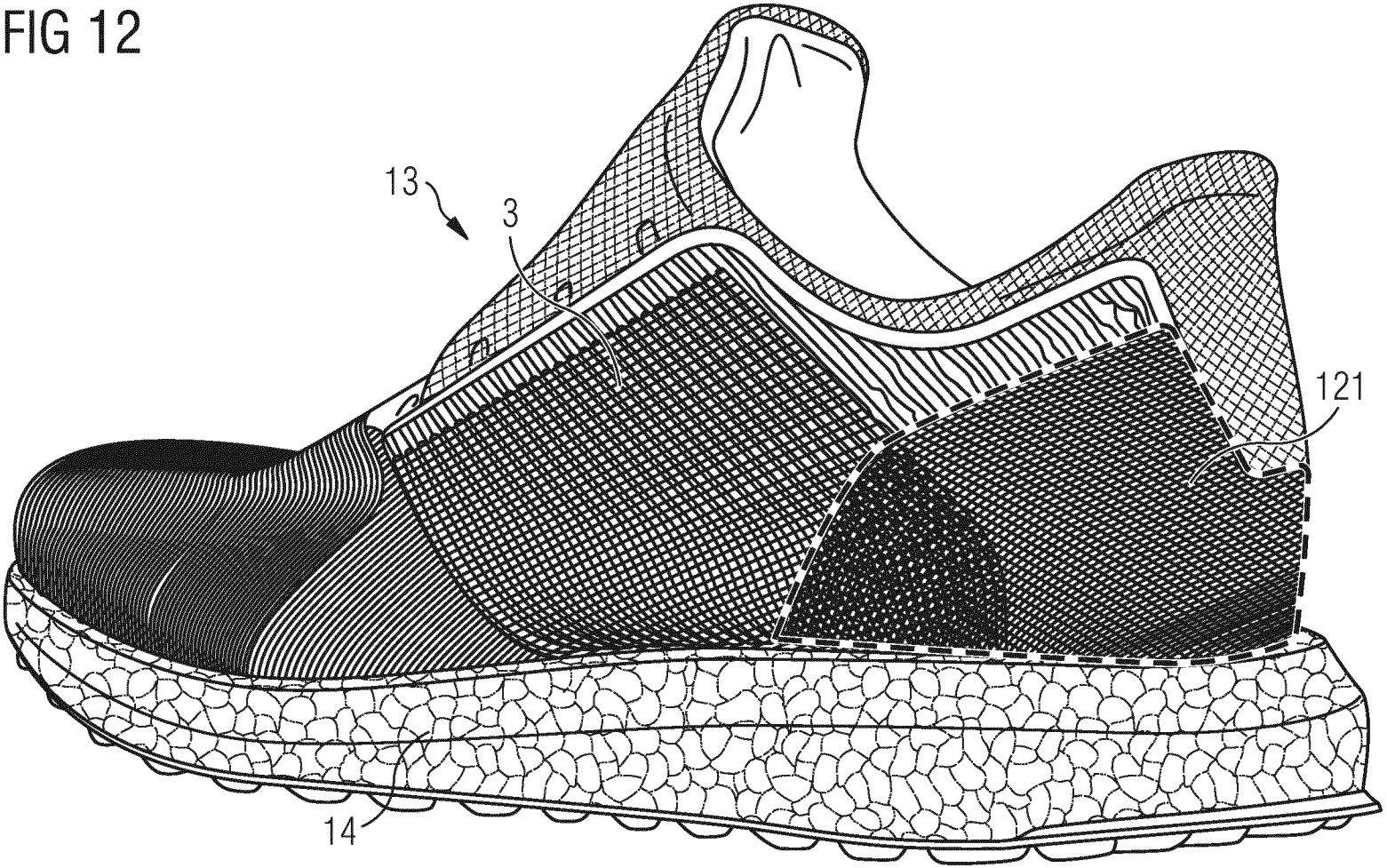
FIG. 12 is a perspective view of a sports shoe, according to certain embodiments of the present invention.

FIG. 12 shows further embodiments of a shoe 13 with a shoe upper 3 according to the invention and a sole structure 14 attached thereto. Regarding the sole structure 14 and regarding the connection of the shoe upper 3 with the sole structure 14, what has been said with respect to FIGS. 4*a* and 4*b* is analogously valid.

Just like the shoe upper 3 illustrated in FIGS. 11*a* and 11*b*, the shoe upper 3 illustrated in FIG. 12 comprises an area 121 with a plurality of substantially parallel yarn sections. This area is also arranged in a heel section of the shoe upper 3 for reinforcement and fulfils the function of a heel counter, i.e. in this area the substantially parallel yarn sections decrease the stretchability and increase the stability of the shoe upper 3.

The yarn of the yarn sections may be arranged on the first layer by means of an embroidery machine 1 as described above. The thread fixing the yarn sections may be a sewing thread with a smaller diameter than the yarn of the yarn sections.

Variations of the Idea of the Present Invention

In the following, variations of the inventive idea of the present invention are described. Generally, those variations of the invention can be combined with one another and with the invention, i.e. the features of certain variations of the invention can provide further embodiments and/or exemplary embodiments and/or variations of the present invention together with the features of additional variations of the present invention and/or with the invention, without the combination of these features being explicitly mentioned herein.

Certain variations relate to a method of manufacturing a shoe upper for a sports shoe, comprising the steps: providing a carrier layer, arranging a yarn or multiple yarns on the carrier layer, such that the yarn or the multiple yarns substantially define the shape of the shoe upper, and sewing the yarn or at least one of the multiple yarns to the carrier layer.

By providing a carrier layer instead one or several sheets of material, a considerable amount of material usually required in the manufacture of shoe uppers for sports shoes is saved, in the first place. The carrier layer serves the purpose of arranging the yarn or the multiple yarns in the desired shape and fixing them while the method is carried out. However, the shoe upper is substantially formed by the yarn or the multiple yarns.

Further, considerable saving of material follows from the fact that the yarn or the multiple yarns are arranged such on the carrier layer that the yarn or the multiple yarns substantially define the shape of the shoe upper. Thus, the yarn or the yarns specify the shape of the shoe upper and substantially fill it, i.e. with the exception of unavoidable manufacturing tolerances. There is substantially, i.e. with the exception of unavoidable manufacturing tolerances, no yarn outside the shoe upper. Thus, a part of the carrier layer accumulates as waste at most. The yarn or the multiple yarns are incorporated into the shoe upper almost entirely, with the exception of yarn residues caused by the manufacture and manufacturing tolerances, and they do not accumulate as waste.

Arranging the yarn or the multiple yarns on the carrier layer includes arranging it/them above or below the carrier layer on one side and, in some embodiments, arranging yarn above and below the carrier layer on both sides.

Since the yarn or the multiple yarns can furthermore be oriented almost freely within the shape of the shoe upper, stretchability of the shoe upper can be prescribed in almost any desired direction. For example, stretchability in the area of the heel can be reduced to a minimum by the yarn or the multiple yarns running vertically so as to provide support to the heel during pushing-off motion of the foot. In the area of the toe joints, a corresponding course of the yarn or the multiple yarns can support the rolling-off motion by a certain stretchability of the shoe upper.

The yarn or the multiple yarns can be arranged in at least two layers. Due to this measure, stiffness of the shoe upper can be improved.

Each of the at least two layers can comprise a different yarn. For example, a first layer can comprise a relatively inelastic yarn so as to further improve stiffness of the shoe upper. A second layer could comprise a rubberized yarn which increases friction, e.g. with regard to a sports ball, so as to enable better control of the ball.

By the arrangement of the yarn or the multiple yarns corresponding to the desired shape of the shoe upper, the shape of the shoe upper can be personalized rather easily. For example, the width of the shoe upper can simply be adjusted by the yarn arrangement being selected accordingly. By using yarns of different colors and arranging the yarn or the multiple yarns in a targeted manner, the shoe upper can also easily be personalized optically. For example, a pattern could be formed in the shoe upper by arranging a yarn accordingly.

In certain embodiments of these variations of the invention, the method comprises the step of dissolving the carrier layer, such that the shoe upper is formed substantially by the yarn or the multiple yarns. This improves breathability of the shoe upper, since the exchange of air and moisture is impaired less. Additionally, the shoe becomes lighter, since the weight of the carrier layer is removed.

In certain embodiments of these variations of the invention, the carrier layer is a textile, leather or artificial leather. These materials already roughly specify certain properties of the shoe upper, such as stretchability, stability or breathability/water permeability. The shape of the shoe upper is defined by the arrangement of the yarn or the multiple yarns. It is only the arrangement of the yarn or the multiple yarns which provides the shoe upper with the desired properties of the finished sports shoe, defining its shape, stretchability and breathability, for example. In these embodiments, the production waste is also reduced to the waste of the carrier layer necessary for production reasons.

In certain embodiments of these variations, the yarn or the multiple yarns are sewed up using a sewing thread. The desired properties of the shoe upper are thus defined by the yarn or the multiple yarns, with it being possible to select the sewing thread such that it fixes the yarn or the multiple yarns as well as possible and is easy to process.

In certain embodiments of these variations of the invention, the sewing thread is thinner than the yarn or the multiple yarns. This allows the sewing thread to be processed well by a corresponding machine, whereas the yarn or the multiple yarns ensure the necessary profile thickness of the shoe upper.

In certain embodiments of these variations of the invention, the yarn or the multiple yarns are sewed up substantially along the entire length of the yarn or the multiple yarns to the carrier layer. In this regard, "substantially" means with the exception of manufacturing tolerances and possibly unavoidable yarn-feed residues. This fixes the yarn or the multiple yarns on the carrier layer and with respect to one another and it provides the shoe upper with the desired shape.

In certain embodiments of these variations of the invention, the step of arranging includes arranging a first yarn and a second yarn. The yarns can be selected with certain properties so as to provide certain functions, such as stability or watertightness, in certain areas of the shoe upper. It is possible to use melting yarns, for example, which melt when heat is applied and stiffen as they cool down. In this way, stiffness of the shoe upper can be improved. Another option is using reflecting yarns which reflect incoming light. In this way, the shoe is better noticeable in the dark and safety of the wearer can be improved. Moreover, reflecting yarns provide further possibilities of improving the optical appearance of the shoe.

In certain embodiments of these variations of the invention, the method further comprises the step of sewing up the first yarn with the second yarn. In this way, the two yarns are tightly fixed to one another and the shoe upper is provided with stability.

The first yarn can be arranged in a first layer and the second yarn can be arranged in a second layer. The first and the second layers can overlap at least partially. Due to the use of two layers, the shoe can be pointedly provided with certain properties. For example, the first layer can comprise a relatively inelastic yarn so as to further improve stiffness of the shoe upper. The second layer could comprise a rubberized yarn which increases friction, e.g. with regard to a sports ball, so as to enable better control of the ball.

In certain embodiments of these variations of the invention, the first yarn is sewed up substantially along the entire length of the first yarn to the second yarn. In this regard, "substantially" means with the exception of manufacturing tolerances and possibly unavoidable yarn-feed residues. In this way, the first yarn and the second yarn are fixed with respect to one another and the shoe upper is given the desired shape.

In certain embodiments of these variations of the invention, the method further comprises the step of sewing up the first yarn with itself. In one embodiment of the invention, the first yarn is sewed up with itself substantially along its entire length. In this regard, "substantially" means with the exception of manufacturing tolerances and possibly unavoidable yarn-feed residues. Stability and rigidity of the shoe upper are increased by these steps.

In certain embodiments of these variations of the invention, the first yarn is arranged in a first layer and the second yarn is arranged in a second layer at least partially on top of each other. By the arrangement in layers, the shoe upper can be pointedly provided with functionality in certain places. For example, a melting yarn can be used in the second layer in the toe area, in the heel area, on a lateral or medial side or in any desired area of the shoe upper so as to pointedly provide these areas with stability. In another example, a particularly abrasion-resistant yarn is used in the second layer in order to increase resilience of the shoe upper.

In certain embodiments of these variations of the invention, the first layer is arranged substantially in the entire shoe upper. In a further embodiment of the invention, the second layer is arranged in selected locations of the shoe upper. In a still further embodiment of the invention, the second layer is arranged in the heel area, in the toe area or in the area of the shin, on a lateral or medial side. Generally, the second layer can be arranged in a specific area of the shoe upper. Due to this, the first layer defines the shape of the shoe upper, while the second layer can provide enforcement, for example, in selected places.

In certain embodiments of these variations of the invention, the method further comprises the step of arranging at least one reinforcing element between the first layer and the second layer. In a further embodiment of the invention, the reinforcing element is a heel counter, toe counter, shin guard, lateral or medial reinforcing element. Generally, the reinforcing element can be arranged in any desired area of the shoe upper. In a still further embodiment of the invention, the reinforcing element is made from plastic, textile, leather or artificial leather. In this way, the shoe upper can be reinforced without its optical appearance being impaired. The reinforcement can simply be placed over a finished first layer during the manufacturing process and the second layer can then be arranged above it.

In certain embodiments of these variations of the invention, the first yarn and the second yarn are arranged to create at least one tunnel or pocket. A reinforcing element could be pushed into the tunnel or pocket, for example.

In certain embodiments of these variations of the invention, the first yarn is a melting yarn. In addition or alternatively, the second yarn is a melting yarn. In a still further embodiment of the invention, the method further comprises the step of warming at least a part of the shoe upper, such that the melting yarn melts at least partially. Thus, the shoe upper can be reinforced easily by the melting yarn melting by the application of heat and stiffening as it cools down subsequently. Subsequent reinforcement, e.g. by parts which are glued on, is thus not necessary. Nonetheless, subsequently gluing, sewing or welding parts, e.g. a heel or toe counter, onto the shoe upper is not precluded.

In certain embodiments of these variations of the invention, the first yarn is a filament yarn. Filament yarns are particularly suitable for the pointed reinforcement of the shoe upper or for reducing stretchability of the shoe upper. Due to the filament yarn being worked in during the arrangement of the yarns, an additional step of reinforcing or reducing stretchability is dispensed with.

In certain embodiments of these variations of the invention, the filament yarn comprises carbon fibers. Carbon fibers enable a particularly strong and durable reinforcement of the shoe upper.

In certain embodiments of these variations of the invention, the yarn or the multiple yarns is/are reflecting yarn. Reflecting yarns improve visibility of the shoe upper in darkness, thus contributing to the safety of the wearer. The reflecting yarn can be arranged in very specific areas of the shoe upper. For example, the reflecting yarn can be arranged on a lateral and/or medial side of the shoe upper in order to improve safety when crossing a road, by the headlights of approaching cars being reflected. Generally, a reflecting yarn can be arranged in the entire shoe upper. It is conceivable that the shoe upper almost exclusively comprises reflecting yarn. It is also possible for certain areas of the shoe upper to be highlighted optically by a reflecting yarn. An area comprising an additional reinforcement could be highlighted optically by a reflecting yarn, for example.

In certain embodiments of these variations of the invention, the yarn or the multiple yarns is/are based on Kevlar®. Kevlar® is based on aromatic polyamides (also referred to as aramids) and is usually used in form of fibers. The fibers have the distinction of comprising very high rigidity, high impact resistance, high fracture strain, good vibration reduction as well as resistance with respect to acids and alkaline solutions.

In certain embodiments of these variations of the invention, the method further comprises the step of applying resin, to stiffen the yarn or the yarns. The shoe upper can be made extremely resilient by resin especially in combination with filament yarns such as carbon.

In further embodiments of these variations of the invention, the method comprises the step of applying UV glue to the shoe upper. UV glue is activated by being irradiated with UV light and glues the yarn or the yarns in the places in which the glue was applied. In this way, certain areas of the shoe upper can be subsequently stiffened, reinforced or made more watertight. Moreover, use of a melting yarn can be done without. The UV glue can be applied to the shoe upper by spraying on, coating with a doctor knife, laying on, printing on, sintering, ironing on or spreading.

Further embodiments of these variations of the present invention relate to a shoe upper for sports shoes which was manufactured in accordance with a method according to these variations of the invention as presented above.

Further embodiments of these variations of the present invention relate to a sports shoe which comprises a shoe upper and a sole structure which is connected to the shoe upper, with the shoe upper having been manufactured in accordance with a method according to certain variations of the invention as presented above.

In the following, embodiments of these variations of the invention will be described in more detail. These embodiments are described with reference to FIGS. 1 to 6.

As mentioned above, certain variations of the present invention relate to a method of manufacturing a shoe upper for a sports shoe, comprising the steps: providing a carrier layer, arranging a yarn or multiple yarns on the carrier layer, such that the yarn or the multiple yarns substantially define the shape of the shoe upper, and sewing the yarn or at least one of the multiple yarns to the carrier layer.

The method according to the invention can generally be carried out on an embroidery machine. An embroidery machine allows machine sewing in or sewing on of yarn on woven fabrics or other carrier layers through which a needle of the embroidery machine can pass.

FIG. 1 shows a multi-head industrial embroidery machine 1 carrying out the method according to certain variations of the invention, by way of example. Embroidery heads 2*a*, 2*b* and 2*c*, each of which is involved in the manufacture of one shoe upper 3 according to these variations of the invention, respectively, can be seen in FIG. 1. The embroidery machine can generally be equipped with any desired number of embroidery heads. The embroidery heads 2*a*, 2*b* and 2*c* are at least moveable in a horizontal level, for example electromechanically or pneumatically, and they enable any desired positioning of the needle and the yarn.

In a first step of the method according to certain variations of the invention, a carrier layer is provided, which is almost transparent and labeled with reference number 4 as shown in FIG. 1. This can be foil, woven fabric, textile, leather, artificial leather or plastic. Generally, any type of extensive structure through which a needle can pass during embroidery can be used.

It is also conceivable that the carrier layer 4 is a foil, which dissolves at least partially under certain conditions, for example when it gets into contact with water. Then, the result of the method according to these variations of the invention will be a shoe upper 3 which no longer comprises the carrier layer 4 at all or at least no longer completely comprises it. In that case, the shoe upper 3 is substantially formed from a yarn 5 or the multiple yarns 5.

The carrier layer 4 can be coiled up on a roll, for example, and it is uncoiled at least partially and positioned under one or multiple embroidery heads 2*a*, 2*b* and 2*c* for the method according to these variations of the invention to be carried out.

The method according to certain variations of the invention further comprises the step of arranging a yarn 5 or multiple yarns 5 on the carrier layer 4, such that the yarn 5 or the multiple yarns 5 substantially define the shape of the shoe upper 3. According to certain variations of the invention, a single yarn 5 or multiple yarns 5 can be used. When using multiple yarns 5, they can differ as regards their material properties, diameter, color, etc. The yarn 5 or the yarn 5 can be supplied to an embroidery head 2*a*, 2*b*, 2*c* via a respective yarn supply roll 6*a*, 6*b*, 6*c*.

When a yarn 5 is arranged on the carrier layer 4, it can come into contact with the latter. Generally, however, the step of arranging a yarn 5 does not necessarily involve the yarn 5 having to come into contact with the carrier layer 4. For example, as will still be explained later with regard to FIG. 3, a first yarn 5*a* can be arranged on a carrier layer 4, first of all. Said yarn 5*a* comes into contact with the carrier layer 4. A second yarn 5*b* is then arranged above the first yarn 5*a*. Although said second yarn 5*b* does not come into contact with the carrier layer 4 directly, it is arranged on the carrier layer 4.

As can be seen in FIG. 1, each of the three embroidery heads 2*a*, 2*b* and 2*c* arranges one or multiple yarns 5 for one shoe upper 3, respectively. In this regard, the shape of the respective shoe upper 3 is defined by the yarn 5 or the multiple yarns 5. Thus, the yarn 5 or the yarns 5 specify the shape of the shoe upper 3 and fill it substantially, i.e. with the exception of unavoidable manufacturing tolerances. There is substantially, i.e. with the exception of unavoidable manufacturing tolerances, no yarn 5 outside the shoe upper 3.

FIG. 2 is an exemplary top view of a shoe upper 3 manufactured by means of the method according to certain variations of the invention. The shape of the shoe upper 3 is prescribed by the yarn 5. The thread residues which cannot be avoided due to the thread feeder, three of which are labeled with reference number 7 by way of example, can be removed by cutting them off, for example. Cutting off can be carried out by means of high-frequency alternating current or laser, for example.

The yarn 5 or the yarns 5 can be based on natural fibers, such as cotton, or on synthetic fibers, such as nylon, polyester, mixtures of natural and synthetic fibers, mixtures of polyester and nylon, etc. Moreover, the yarn 5 or the yarns 5 can be melting yarn. The melting yarn can be melted at least partially by warming at least a part of the shoe upper 3. During subsequent cooling, the melting yarn hardens, providing the shoe upper 3 with stability.

As shown in FIG. 2, the yarn 5 is furthermore arranged in two layers. In this regard, a first, bottom layer fills the shape of the shoe upper and defines it. A second layer in the heel and toe areas of the shoe upper is arranged above said first layer and reinforces it in said areas. Generally, the second layer can also be arranged in other areas of the shoe upper, for example on a lateral and/or medial side.

It is also conceivable that the yarn 5 or the yarns 5 are filament yarn. Such yarn may comprise carbon fibers, for example. The filament yarn can be stiffened by subsequent treatment with resin, e.g. an epoxy-based one, UV glue or the use of melting yarns. Further example of fibers, yarns and threads which can be used in the scope of these variations of the present invention were already explained in the sections "Fibers" and "Yarns and threads". In general, however, any type of yarn or thread may be used in the context of these variations of the present invention.

The method according to certain variations of the invention further comprises the step of sewing the yarn 5 or at least one of multiple yarns 5 to the carrier layer 4. For this purpose, a thread (not discernible in the Figures) is guided through the carrier layer 4 and around the yarn 5 or the yarns 5 by means of a needle of an embroidery head 2*a*, 2*b* or 2*c* such that the yarn 5 or the yarns 5 are fixed to the carrier layer 4. In this regard, the stitches can be placed at a distance of from merely a few millimeters to several centimeters.

The thread can generally be thinner than the yarn or the yarns 5. It is also conceivable that the thread has the same or a larger diameter than the yarn 5 or the yarns 5. A sewing thread can be used as the thread. This can be based on natural fibers, such as cotton, or on synthetic fibers, such as nylon, polyester, mixtures of natural and synthetic fibers, mixtures of polyester and nylon, etc. Examples of fibers, yarns and threads to be used were explained in the sections "Fibers" and "Yarns and threads".

The yarn 5 or the yarns 5 can be sewed up with the carrier layer 4 substantially along their entire length, i.e. with the exception of manufacturing tolerances and possibly unavoidable yarn-feed residues.

As was already mentioned, multiple yarns 5 can be used when carrying out the method according to certain variations of the invention. As shown in FIG. 3, a first yarn 5*a* and a second yarn 5*b* are used. The first yarn 5*a* and the second yarn 5*b* are arranged on the carrier layer 4. Although the second yarn 5*b* does not come into contact with the carrier layer 4 directly, it is arranged on the carrier layer 4, as was already explained.

When using multiple yarns 5, they can be sewed up with each other. For example, as shown in FIG. 3, the first yarn 5*a* is sewed up with the second yarn 5*b*. With respect to multiple yarns 5 being sewed up with each other, the statements made with regard to sewing up with the carrier layer 4 apply analogously. For example, as shown in FIG. 3, the yarn 5*a* can be sewed up with the yarn 5*b* substantially along the entire length, i.e. with the exception of manufacturing tolerances and possibly unavoidable yarn-feed residues.

For sewing the yarns 5 up with each other, the same thread can be used as for sewing the yarns 5 up with the carrier layer. With regard to the embodiments illustrated in FIG. 3, for example, the yarn 5*a* and the yarn 5*b* can be sewed up with the carrier layer 4 and the yarn 5*a* with the yarn 5*b* simultaneously with a single thread stitch. However, it is also possible that only the yarn 5*a* is sewed up with the carrier layer 4 and that the yarn 5*b* is sewed up with the yarn 5*a* but not with the carrier layer 4. For sewing the yarns 5 up with each other, it is also possible to use another thread than for sewing a yarn 5 up with the carrier layer 4.

A yarn 5 can also be sewed up with itself. If the yarn 5 is arranged in loops or circumferentially on the carrier layer 4, as suggested in FIG. 3, for example, then adjacent places of the yarn 5 can be sewed up with each other. This can occur substantially along the entire length of the yarn 5, i.e. with the exception of manufacturing tolerances and possibly unavoidable yarn residues, or alternatively only in prespecified areas of the shoe upper 3.

As was shown with regard to the embodiments illustrated in FIG. 3, in case of use of multiple yarns 5, they can be arranged in layers. As shown in FIG. 3, the first yarn 5*a* forms a first layer 8*a*, which substantially corresponds to the shape of the shoe upper 3, i.e. with the exception of manufacturing tolerances and possibly unavoidable yarn residues, whereas the second yarn 5*b* forms a second layer 8*b* arranged above the first layer 8*a*. Thus, the first layer 8*a* is arranged substantially in the entire shoe upper 3, whereas the second layer 8*b* is arranged in a partial area of the shoe upper 3.

As shown in FIG. 3, the second layer 8*b* is arranged substantially, i.e. with the exception of manufacturing tolerances and possibly unavoidable yarn residues, completely above the first layer 8*a*. However, it is also conceivable that the second layer 8*b* is arranged partially above the first layer 8*a* and is in direct contact with the carrier layer 4 in another area, for example.

The second layer 8*b* can be arranged in selected places of the shoe upper 3. For example, as shown in FIG. 4*a*, which will still be explained in more detail, a second layer 8*b* is arranged above a first layer 8*a* only in the heel area 9 and in the midfoot area 10. In shoe uppers according to these variations of the invention which extend beyond the ankle (not shown in the figures), it is also conceivable that a second layer is arranged in the area of the shin.

At least one reinforcing element can be arranged between the first layer 8*a* and the second layer 8*b*. In the schematic view of certain embodiments illustrated in FIG. 5, for example, a reinforcement was arranged above a first layer in the heel area 9, in the area 11 of the lace eyelets and in the toe area 12, respectively, and the second layer was then arranged above that. The enforcing element could also be a shin guard if the shoe upper extends beyond the ankle (not shown in the figures).

Other shoe components, such as eyelets, decoration elements, decoration stripes, abrasion protection elements, rib elements, stiffening elements, supporting elements, cushioning elements and fiber elements can generally also be arranged between the first layer 8*a* and the second layer 8*b* additionally or alternatively. For example, lace eyelets, through which the laces are threaded, could be arranged between the first layer 8*a* and the second layer 8*b*. The eyelets could be tightly connected with the yarn of the first layer 8*a* and the second layer 8*b* using melting yarn or a polymer coating. Alternatively, the eyelets could be fixed by means of UV glue (or other glue).

Another example is arranging a heel counter between the first layer 8*a* and the second layer 8*b* in the heel area of the shoe upper. The heel area of the shoe upper is subject to particularly high mechanical stress due to the rolling-off motion of the foot, so that the shoes are frequently reinforced with a heel counter in the heel area. According to certain variations of the invention, a heel counter can be integrated into the shoe upper by the heel counter being arranged between the two layers. Additionally or alternatively, a toe counter can also be arranged between the two layers. The shoe upper can generally be reinforced by additional reinforcing elements in any places.

A still further example is arranging support for the midfoot area between the first layer 8*a* and the second layer 8*b*. The midfoot area of the human foot requires support by the footwear so as to avoid lowering of the midfoot. A corresponding supporting element could be arranged between the two layers and fixed by melting yarn or glue (e.g. UV glue), for example. It is also conceivable that the supporting element is welded to and or sewed up with the first layer 8*a* and/or the second layer 8*b*.

Generally, additional components can be placed between the two layers manually, semi-automatically or fully-automatically (e.g. by means of a robot arm). For example, the first layer 8*a* and the second layer 8*b* can form a tunnel or a pocket into which an additional component is pushed. It is also possible that the additional component is sewed up with, glued (e.g. by means of UV glue) or welded to the first layer 8*a* and/or the second layer 8*b* manually or automatically. Alternatively, melting yarns can be used for fixing.

Reinforcing elements and other shoe components can be arranged on the shoe upper 3 by machine and largely fully-automatically by a processing station, as described in the German patent applications of the present applicant with application number 10 2013 221 018 and 10 2013 221 020, for example.

The at least one reinforcing element can be manufactured from plastic, textile, leather, artificial leather or metal. It can be cut out from these materials or it can be molded or injection-molded, e.g. in case of plastic. The use of composites, e.g. on the basis of carbon fibers, glass fibers, etc. or of corresponding non-woven materials is also possible.

Targeted stiffening of the shoe upper 3 can also be achieved by applying resin or polymer, as previously described in the section "Polymer coating". Alternatively, UV glue or melting yarn can be used for stiffening, as was already described above.

FIG. 6 shows further embodiments of a shoe upper 3 according to these variations of the invention. In these embodiments, the shoe upper 3 comprises lace eyelets, three of which are labeled with reference number 16 by way of example. One or several lace/s can be pulled through the lace eyelets 16 so as to be able to lace up the finished sports shoe, as shown in FIG. 4*a* by way of example.

As illustrated in FIG. 6, the lace eyelets 16 are formed directly when the yarn or the yarns 5 is/are arranged, i.e. no yarn 5 is arranged in the position of the respective lace eyelet 16, so that a corresponding opening remains which forms the lace eyelet 16. It is conceivable that the opening is additionally reinforced with the yarn 5 at its edge, so as to prevent fraying. Alternatively or additionally, the edge of the opening can be sewed up with the yarn used for sewing up the yarn 5 or for sewing up multiple yarns 5.

In further embodiments, the lace eyelets are formed subsequently in the shoe upper 3, e.g. by die-cutting. Additionally, the lace eyelets could be reinforced with an eyelet made from metal or plastic so as to prevent fraying. Said additional eyelet could be pressed into the shoe upper 3.

It is conceivable that apart from lace eyelets 16, other openings in the shoe upper 3 are also formed, e.g. ventilation openings. These openings can also be formed directly when arranging the yarn or the yarns 5 or alternatively subsequently, e.g. by die-cutting.

Generally, the manufacturing method for the shoe upper 3 according to certain variations of the invention allows simple and cost-efficient personalization by the shape of the shoe upper 3 being adjusted to the foot of a wearer of the finished sports shoe by arranging the yarn or the yarns 5 accordingly. The width of the shoe upper can be adjusted to the shape of the foot, for example. The foot of the wearer can be measured for this purpose, e.g. by means of a 3D scanner. Alternatively, the foot could be measured manually, using a measuring tape. The determined measurements could then be transformed into a program for an embroidery machine by corresponding software. This could occur in the embroidery machine or in a separate computer. The program is then read into the embroidery machine and the latter manufactures the shoe upper 3 in accordance with the previously determined measurements of the foot.

However, optical personalization by a corresponding selection of colors of the yarns or decoration in the way of embroidery is also conceivable. Yarns of different colors could be used for this. It is also conceivable to use reflecting yarns in certain areas of the shoe upper in order to achieve an optical effect in darkness when light shines thereon. Moreover, fluorescent or phosphorescent yarns can be used. Fluorescent yarns glow when irradiated with IV light, for example, as is frequently used in discotheques. Phosphorescent yarns continue to glow after they have been irradiated with light and can thus be "charged". Thus, a shoe with phosphorescent yarn can glow in the dark of its own accord.

Generally, yarns with optical properties can be used only in certain areas of the shoe upper or in the entire shoe upper.

This first variation of the invention also relates to a sports shoe 13 comprising a shoe upper 3 manufactured in accordance with the method according to these variations of the invention. Embodiments of such a sports shoe 13 are shown in FIG. 4*a*. The sports shoe 13 comprises a shoe upper 3 according to these variations of the invention and a sole structure 14. The statements made in this description apply with regard to the shoe upper 3 and its manufacture.

The sole structure 14 comprises an outsole. In some embodiments, the sole structure 14 furthermore comprises a midsole and an insole, if applicable. The insole can either be removable or firmly connected to the shoe. As shown in FIG. 4*a*, the sole structure 14 comprises studs, three of which are labeled with reference number 15 by way of example. The sole structure 14 can be connected to the shoe upper 3 by sewing, gluing, welding (particularly ultrasonic welding) or similar connecting techniques.

FIG. 4*b* shows further embodiments of a sport shoe 13 according to certain variations of the invention. This is a soccer shoe. Accordingly, the shoe 13 comprises studs, three of which are labeled with reference number 15 by way of example. The studs 15 are attached to a sole plate 14 which is rather stiff. As shown in FIG. 4*b*, the studs are firmly connected to the sole plate 14. However, it is also conceivable that they are screwing studs which are screwed into the sole plate 14. As shown in FIG. 4*b*, the studs comprise transparent ends, three of which are labeled with reference number 41 by way of example. The ends 41 are injection-molded to the base of the studs 15. However, it is also conceivable that the ends are glued on or welded on.

A shoe upper 3 manufactured according to certain variations of the invention is attached to the sole plate 14. The shoe upper 3 is glued to the sole plate 14. However, it is also conceivable that the shoe upper 3 is welded or sewed to the sole plate 14. In FIG. 4*b*, the shoe upper comprises three layers of yarns, as can be seen in the detailed view of FIG. 4*c*. The first layer is formed by a yarn 42. This layer is the outermost layer. A layer lying below it is formed by the yarn 43. This is the middle layer. The bottommost layer is formed by the yarn 44. The yarns 42, 43 and 44 are kept together by a thread 45.

As shown in FIG. 4*b*, the three layers overlap along the entire shoe upper 3. However, it is also conceivable that the three layers overlap merely in partial areas of the shoe upper 3, e.g. where contact with a football usually occurs, that is, above the toes and in the area of the instep, for example. In this way, the shoe upper 3 could become stiffer and thicker by the three-layer construction in these areas.

The three-layer construction of the shoe upper 3 furthermore provides the necessary stability and stiffness of the shoe upper 3. Moreover, the shoe upper 3 could be stiffened and reinforced by means of melting yarn, a polymer coating, UV glue or resin. It is also conceivable that reinforcing elements are arranged between the layers formed by the yarns 42, 43 and 44, as was already described.

It is also possible that the yarns 42, 43 and 44 differ with regard to their properties. For example, the yarn 43 could be a melting yarn which liquefies under application of heat and connects the layers formed by the yarns 42 and 44 to each other when it cools down subsequently. The yarns 42 of the outermost layer could be a rubberized yarn or rubber yarn which increases friction with the ball so as to enable good control of the ball. The yarn 44 of the innermost layer could be a moisture-absorbing yarn which transports moisture away from the foot.

Instead of three layers, less layers of yarns or more layers of yarns could also be used.

The statements made with regard to the other embodiments generally apply analogously with regard to the shoe upper 3 shown in FIG. 4*b*.

Further variations of the idea of the present invention relate to a method of manufacturing a shoe upper for a sports shoe, comprising the steps: providing a carrier layer, arranging a yarn or multiple yarns on the carrier layer, such that the yarn or the multiple yarns define at least a partial area of the shoe upper, and sewing the yarn or at least one of the multiple yarns to the carrier layer.

Figure 13:
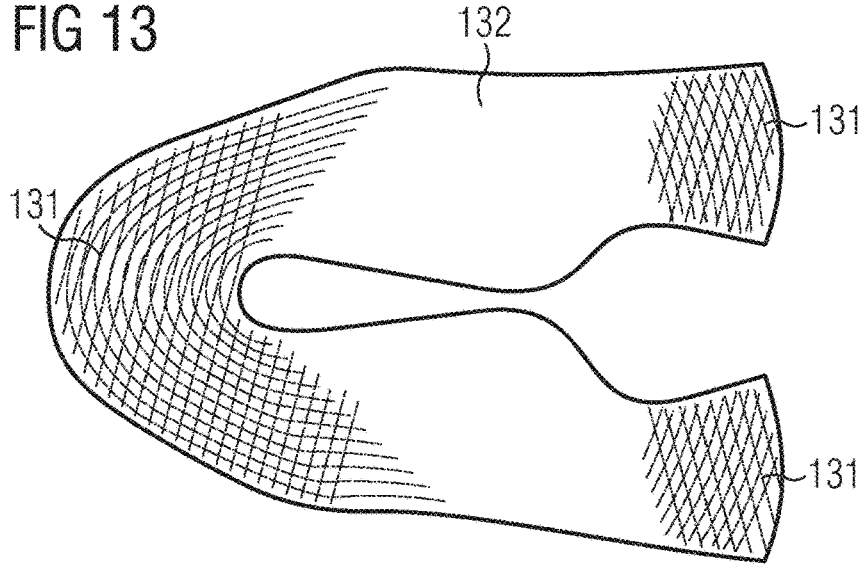
FIG. 13 is a top view of a shoe upper, according to further embodiments of the present invention.

FIG. 13 shows certain embodiments of variations of the idea of the present invention. In FIG. 13, a yarn 131 is arranged on a carrier layer 132. In this regard, the carrier layer 132 defines the shape of a sole. The carrier layer 132 can be leather or a textile, for example. The yarn is arranged in specific places of the shoe upper, that is, in the toe and heel areas. Generally, the yarn 131 can be arranged in any places of the shoe upper, depending on the desired function. As shown in FIG. 13, the yarn 131 reinforces the toe and heel areas. However, it is also conceivable that the yarn reinforces other areas, such as a lateral or medial area, for example.

It is also possible that the yarn 131 provides other functions. For example, it could be a rubberized yarn or rubber yarn which increases friction with a ball so as to enable better control of the ball.

The yarn 131 could also fulfill decorative functions. It could be a reflecting, phosphorescent or fluorescent yarn, for example.

Further variations of the present idea of the invention relate to a method of manufacturing a sole for a sports shoe, comprising the steps: (a.) Providing a carrier layer; (b.) Arranging a yarn or multiple yarns on the carrier layer, such that the yarn or the multiple yarns substantially define the shape of the sole of the sports shoe; and (c.) Sewing the yarn or at least one of the multiple yarns to the carrier layer. Thus, the yarn or the yarns specify the shape of the sole and fill it substantially, i.e. with the exception of unavoidable manufacturing tolerances. However, it is also conceivable that the yarn or the yarns are only arranged in certain areas of the sole, e.g. in the heel or toe areas. It is also possible to leave certain areas of the sole void of yarn so as to create openings.

The carrier layer can remain in the sole or, alternatively, it can be dissolved, e.g. in water.

It is conceivable that the yarns only define a partial area of the sole, for example a heel or toe area. Accordingly, the method would be suitable for manufacturing a sole portion.

The sole or the sole portion obtained in accordance with certain variations of the present idea of the invention could be additionally reinforced with melting yarn. For this purpose, the yarn could be a melting yarn which is heated up and stiffens as it subsequently cools down. Rubber could be applied to the sole obtained in this way, at least partially, e.g. by gluing. Stiffness of the sole could be increased by the melting yarns such that a sole plate, e.g. for a soccer shoe, is obtained.

Figure 14:
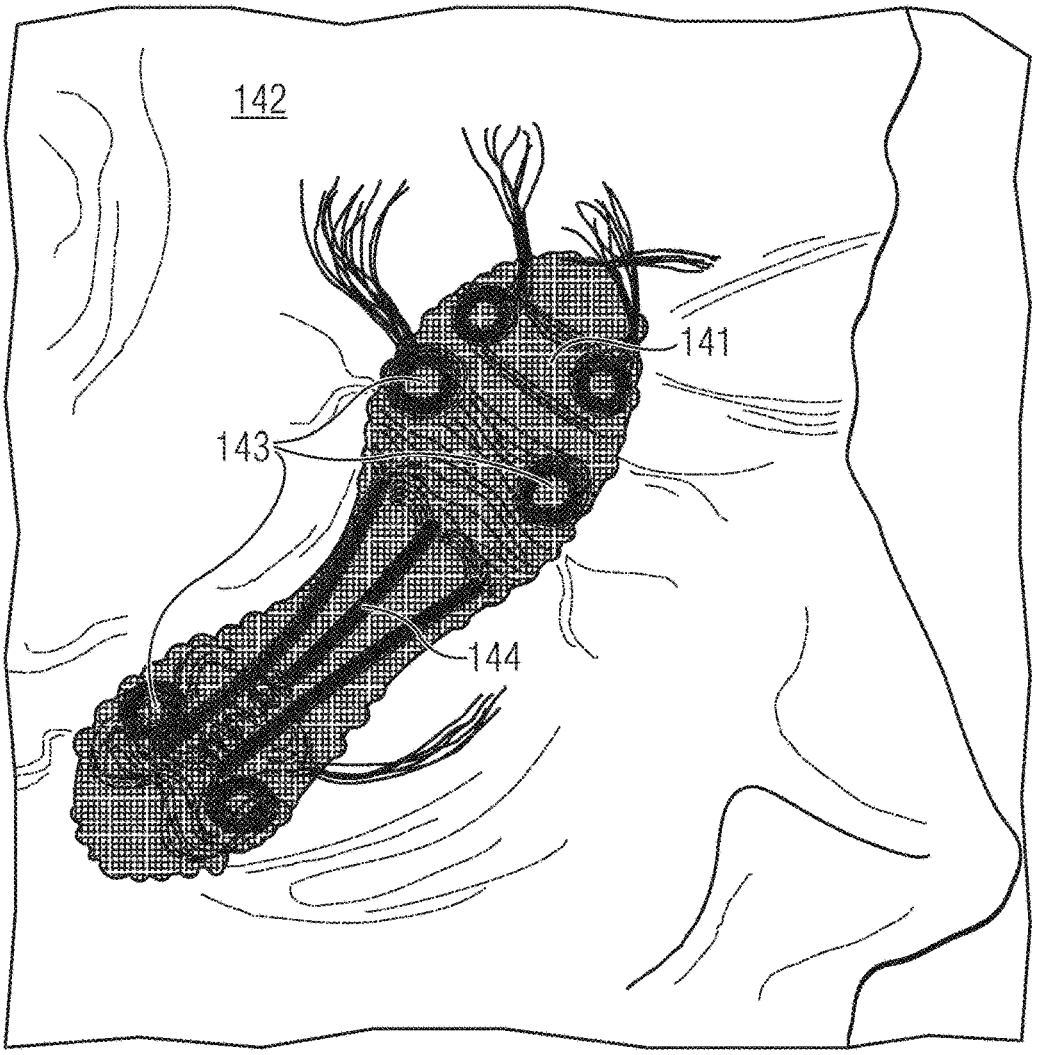
FIG. 14 is a top view of a sole plate for a sports shoe, according to certain embodiments of the present invention.

Certain embodiments for these aspects are shown in FIG. 14. This is a sole plate 181 for a soccer shoe. The sole plate 141 comprises yarns which are arranged on a carrier layer 142 by the yarns being embroidered onto the carrier layer 142. The sole plate 141 comprises studs, three of which are labeled with reference number 143 by way of example. The studs 143 are an integral part of the sole plate 141 and they are formed by the yarns.

The sole plate moreover comprises an integral reinforcing element 144 in the midfoot area, which is also formed by yarns. The reinforcing element 144 comprises three ribs and connects the forefoot area with the heel area of the sole plate 141. Other arrangements and designs of the reinforcing element are conceivable. The sole plate 141 may also not comprise such a reinforcing element.

The carrier layer 142 could be a water-soluble foil which dissolves in water, so that the sole plate 141 remains. Alternatively, the protruding portions of the carrier layer 142 could be cut off or the sole plate 141 could be punched out.

For reinforcement, the sole plate 141 could be dipped into a polymer or epoxy-resin bath. At least one of the yarns could be based on carbon fibers, for example. By dipping it into epoxy resin, a particularly stiff and stable sole plate is thus created.

Alternatively, the sole plate 141 could comprise a melting yarn which melts under application of heat and stiffens as it cools down subsequently. It is also conceivable that the sole plate 141 is connected to a shoe upper by means of the melting yarn. For this purpose, the sole plate could e.g. comprise melting yarn in an edge region or consistently.

In certain variations of the present idea of the invention, it is also conceivable that the sole manufactured in this way is an insole which is placed inside a shoe. It is also conceivable that the sole or the sole portion is placed in a mold and imbedded in plastic (e.g. EVA, TPU, eTPU) by means of compression-molding. The sole bond obtained in this way would be extremely stiff. When using a sole portion, the sole bond obtained in this way could be reinforced and stiffened in a targeted manner, for example in the places which are especially strained during walking or running.

Instead of a mold being used, plastic could also be injection-molded to the sole or the sole portion obtained in accordance with certain variations of the present idea of the invention. For example, studs or reinforcing areas could be injection-molded to the sole or the sole portion.

A further aspects of certain variations of the present idea of the invention relate to a sole for a sports shoe manufactured according to the method as presented in the paragraph above as well as a sports shoe comprising such a sole and a shoe upper. The following statements apply equally to the method, the obtained sole and the sports shoe.

The sole can be a strobel sole, outsole or middle sole. An outsole, which is preferably manufactured from TPU or rubber, can be attached to the sole. The sports shoe can further comprise a shoe upper connected to the sole. The sole can further comprise at least one stripe comprising a section of the yarn or at least one of the multiple yarns. The stripe can extend into the area of the shoe upper and be connected to it.

The sports shoe can further comprise a layer of meltable material arranged at least partially between the sole and the shoe upper. The meltable material can be melted by heat so as to connect the sole to the shoe upper. Additionally or alternatively, the sole can be fixed in its shape by the use of meltable material and the application of heat.

The yarn or the at least one of the yarns can be dual-component yarn. A first component can be meltable under application of heat, whereas a second component is not meltable. Alternatively, the second component is also meltable but has a higher melting point than the first component. The first component can be arranged in the yarn around the second component. The second component then forms the core of the yarn, whereas the first component surrounds the core. The method can comprise the step of at least partially heating up the sports shoe so as to melt the first component of the yarn.

A layer can be arranged at least partially on one side of the sole. The layer can be Elastollan. Generally, however, the use of any material, including a water-soluble material, is conceivable. The layer can be arranged between the sole and the shoe upper.

Figure 15:
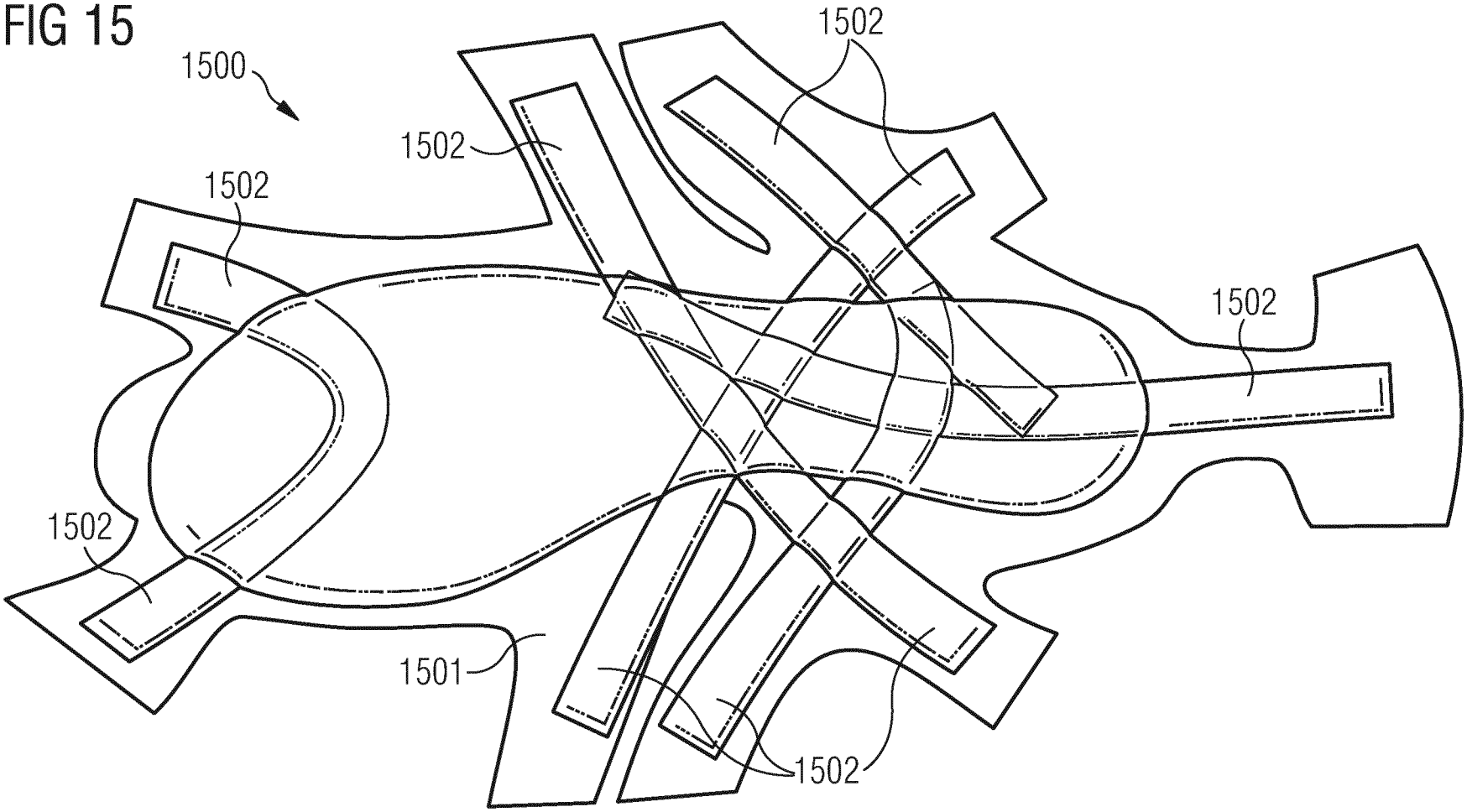
FIG. 15 is a top view of a sole for a sports shoe, according to certain embodiments of the present invention.

FIG. 15 shows an embodiment of a sole 1500 for a sports shoe obtained according to the method according to certain variations of the present idea of the invention. The sole 1500 comprises a carrier layer 1501, on which a yarn is arranged such that the yarn substantially defines the shape of the sole 1500 of the sports shoe. However, it is also conceivable that the yarn only defines a partial area of the sole. The yarn could define a torsion element or a midfoot support, for example.

The yarn is sewed to the carrier layer 1501. The statements made with regard to FIGS. 1 through 7 apply with regard to the carrier layer 1501 and the yarn. The carrier layer 1501 can particularly be a carrier layer similar to the carrier layer 4.

Figure 16:
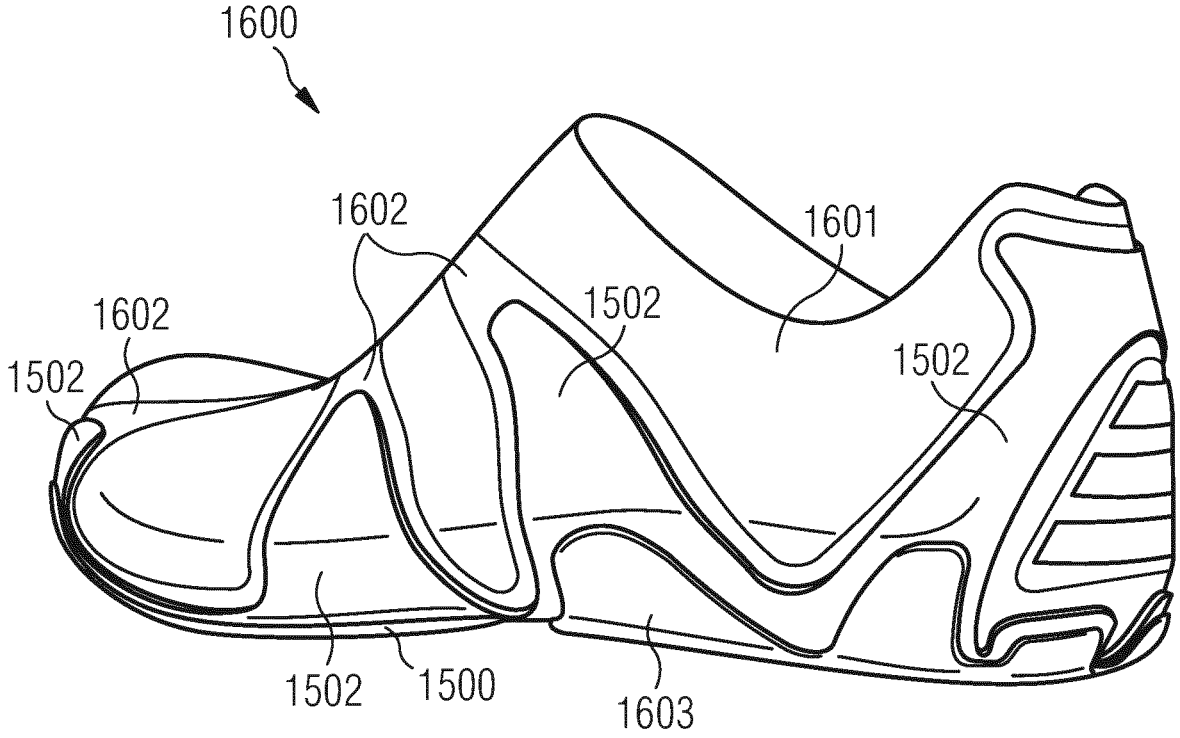
FIG. 16 is a perspective view of a sports shoe, according to certain embodiments of the present invention.

As shown in FIG. 15, the sole comprises a number of stripes 1502 which comprise sections of the yarn. Thus, the yarn does not only define the shape of the sole 1500 but also the shape of the stripes 1502. The stripes 1502 can extend into an area of the shoe upper and be connected to it, as shown in FIG. 16. Any desired other shapes are conceivable instead of stripes, such as round areas, for example.

FIG. 16 shows an embodiment of a sports shoe 1600 in accordance with certain variations of the present idea of the invention. The sports shoe 1600 comprises a sole 1500, which can be the sole 1500 shown in FIG. 15, for example. The sole 1500 comprises a carrier layer (not shown in FIG. 16), on which a yarn (not shown in FIG. 16) is arranged such that the yarn substantially defines the shape of the sole 1500 of the sports shoe 1600. The yarn is sewed to the carrier layer. The statements made with regard to FIG. 15 apply with regard to the carrier layer and the yarn.

As shown in FIG. 16, the sole 1500 comprises a number of stripes 1502 which comprise sections of the yarn. The stripes 1502 extend into an area of the shoe upper 1601 and are connected to it.

The upper 1601 can be a sock-like textile. Other shapes are generally conceivable of course. It is also conceivable that the shoe upper 901 comprises lacing or a hook-and-loop fastener. The shoe upper 1601 is generally not limited to the shoe upper shown in FIG. 16. The same is true with regard to the sole 1500. The textile can be a woven fabric, warp-knitted fabric, weft-knitted fabric or the like, which is stretchable. As shown in FIG. 16, the upper 1601 is printed with thermoplastic polyurethane (TPUI) in the areas labeled with reference number 1602. The upper 1601 is connected to the sole 1500 by a middle layer (not shown in FIG. 16) made from thermoplastic material which melts under the application of heat. Generally, however, other attaching options, such as welding, gluing by means of glue, sewing, etc. are also conceivable.

An outsole 1603 is attached to the sole 1500. The outsoles 1603 is manufactured from TPU as shown in FIG. 16. Generally, other materials, such as rubber, TPU, expanded TPU or combinations thereof can also be used for the outsole 1603.

The shoe 1600 shown in FIG. 16 can additionally also comprise a midsole (not shown in FIG. 16). It can be manufactured from EVA, TPU, expanded TPU or combinations thereof.

The shoe 1600 shown in FIG. 16 could also be a soccer, rugby or football shoe comprising a sole plate with studs.

Further variations of the present idea of the invention relate to a method of shaping a shoe upper for a sports shoe on a cobbler's last, comprising the steps: (a.) Laying out a strand substantially along an edge of a shoe upper which is arranged in the sole area in the finished sports shoe, (b.) Fixing the strand to the shoe upper in one direction in a plurality of places by means of an embroidery machine, (c.) Arranging the shoe upper on a cobbler's last, and (d.)

Pulling on the strand so that the shoe upper adjusts to the shape of the cobbler's last.

In step d., the strand can be pulled on one end, both ends or in any place between the two ends.

Further aspects of this further variation of the present idea of the invention relate to a shoe upper for a sports shoe manufactured according to the method as presented in the paragraph above as well as a sports shoe comprising such a shoe upper and a sole structure. The following statements apply equally to the method, the obtained shoe upper and the sports shoe.

The distance between the places in which the strand is sewed up can be varied along the edge of the shoe upper. For example, the distance can be smaller in the heel and toe areas than in a side area of the shoe upper. The direction can be a direction which is substantially, i.e. with the exception of manufacturing tolerances, rectangular to the edge of the shoe upper. In steps a. and b., the shoe upper can be arranged on a carrier layer. The carrier layer can be a reel on which a plurality of shoe uppers are arranged, for example. Optionally, the shoe upper can be cut from the carrier layer between steps b. and c. Further optionally, a connecting line of the shoe upper can be closed between steps b. and c. in order to obtain a three-dimensional pre-shape from the two-dimensional shoe upper. After step d., the strand can be fixed in such a way that it cannot move relative to the shoe upper, so that the shoe upper will maintain the shape of the cobbler's last.

Figure 17A:
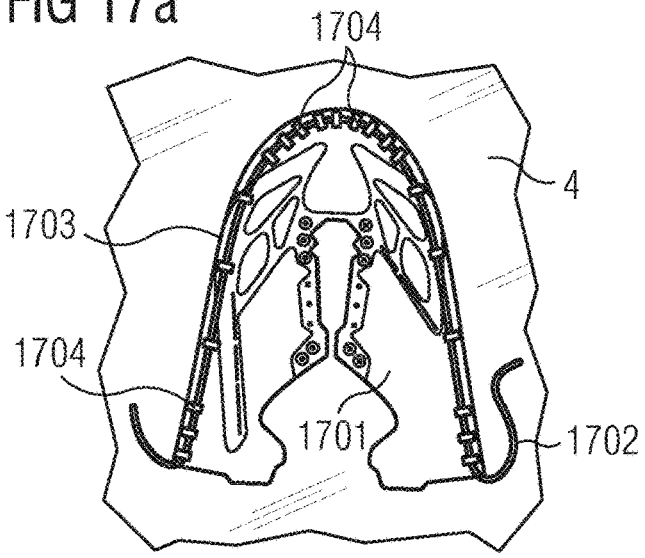
FIGS. 17*a*-17*d* are illustrations of a method of manufacturing, according to certain embodiments of the present invention.

An embodiment of a method in accordance with further variations of the present idea of the invention will be explained by means of FIGS. 10*a* through 17*d* below. As shown in FIG. 17*a*, a shoe upper 1701 is arranged on a carrier layer 4. For example, the shoe upper 1701 could be arranged on the carrier layer 4 as described above, that is, by providing a carrier layer 4, arranging a yarn 5 or multiple yarns 5 on the carrier layer 4, such that the yarn 5 or the multiple yarns 5 substantially define the shape of the shoe upper 1701, and sewing the yarn 5 or at least one of the multiple yarns 5 to the carrier layer 4. The shoe upper 1701 can also be cut out from a textile, such as a woven fabric, weft-knitted fabric, warp-knitted fabric or the like. The carrier layer can be a textile made from artificial yarn or natural yarn, synthetic or natural leather, a non-woven material or the like. The carrier layer can be a reel on which a plurality of shoe uppers are arranged, for example.

As further depicted in FIG. 17*a*, a strand 1702 is laid out substantially along the edge 1703 of the shoe upper 1701. The edge 1703 will be arranged in the sole area in the finished sports shoe. The strand 1702 is fixed in one direction with the shoe upper 1701 in a plurality of places, three of which are labeled with reference number 1704 in FIG. 17*a*, by means of a embroidery machine. Alternatively, the strand 1702 is fixed by means of gluing, sewing or welding.

As shown in FIG. 17*a*, the strand is fixed in a direction which is approximately rectangular to the edge 1703. The strand 1702 is moveable relative to the shoe upper 1701 in another direction, that is, approximately parallel to the edge 1703.

The strand 1702 can be a monofilament made from polymer, a shrinking filament, a melting yarn, a yarn made from natural fibers, a yarn based on metals, or a shape-changing yarn. A shape-changing yarn changes its length e.g. under application of heat. Generally, the word "strand" is to be understood as a generic term for any oblong and flexible structure, for example a lace, a band, a string, a strap, etc.

Figure 17B:
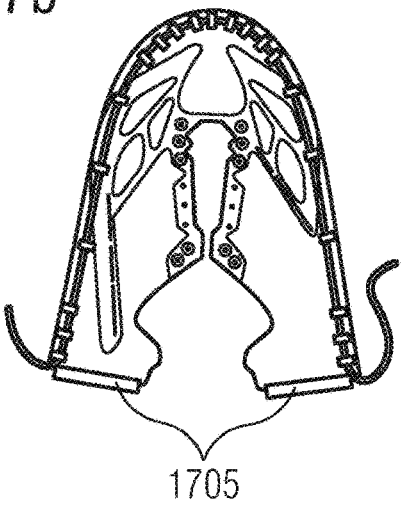
Figure 18:
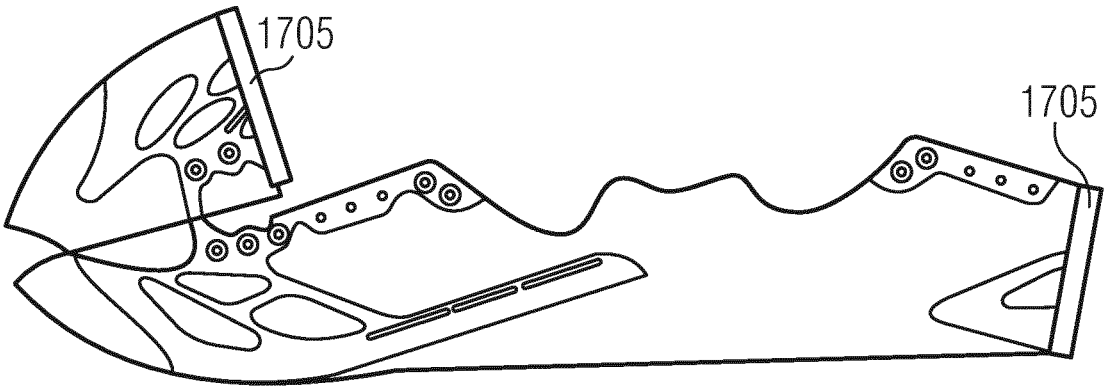
FIG. 18 is a schematic representation of a connecting line of a shoe upper, according to certain embodiments of the present invention.

An optional method step is depicted in FIG. 17*b*, that is, closing the connecting line 1705 of the shoe upper 1701 so as to obtain a three-dimensional pre-shape from the two-dimensional shoe upper 1701. In the embodiment shown in the figures, this connecting line 1705 is arranged on the heel of the shoe upper 1701. Other arrangements of the connecting line 1705 are conceivable, for example in a side area of the shoe upper, as shown in FIG. 18. The connecting line 1705 can be closed by sewing, welding, gluing, by means of hooks or eyelets or the like. The connecting line 1705 can be closed manually or automatically.

Figure 17C:
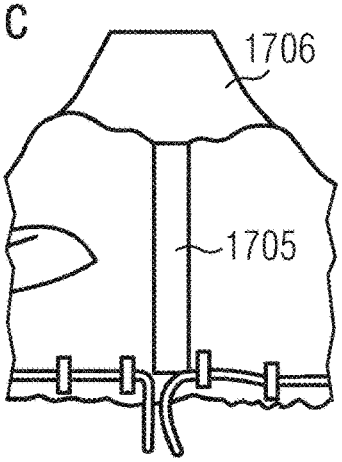

As shown in FIG. 17*c*, the shoe upper is arranged on a cobbler's last 1706. If the shoe upper 1701 was given a three-dimensional pre-shape in a previous step, the shoe upper is arranged on the cobbler's last 1706 in this pre-shape. If the shoe upper 1701 was not given a three-dimensional pre-shape in a previous step, a possibly existing connecting line 1705 can also be closed while the shoe upper 1701 is arranged on the cobbler's last. The connecting line 1705 can be closed by sewing, welding, gluing, by means of hooks or eyelets or the like.

Figure 17D:
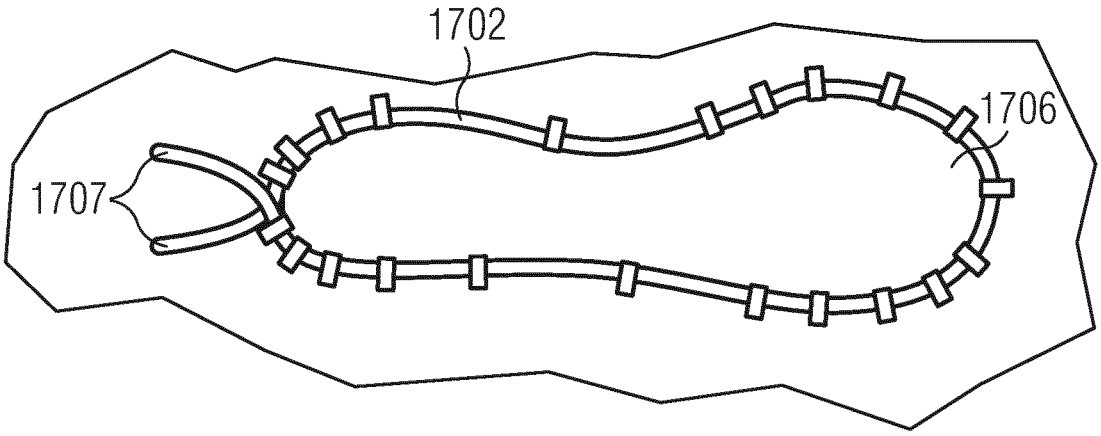

As depicted in FIG. 17*d*, both ends 1707 of the strand 1702 are pulled so that the shoe upper 1701 adjusts to the shape of the cobbler's last 1706. Alternatively, only one end is pulled while the other end of the strand 1702 is fixed to the shoe upper. Further alternatively, both ends are fixed and any place between the two ends is pulled, which results in a loop being formed. By pulling one end or both ends, the material of the shoe upper 1701 is gathered and adjusts to the shape of the cobbler's last in this way. Pulling one end or both ends may be carried out manually, semi-automatically, i.e. a hand-held device pulls the ends, or fully-automatically.

After the end or the ends or any place of the strand 1702 has been pulled, the strand 1702 can be fixed such that it cannot move relatively to the shoe upper 1701 so that the shoe upper 1701 maintains the shape of the cobbler's last. This fixing can e.g. occur by both ends of the strand 1702 or a loop formed from the strand by pulling being tied up. Alternatively, the two ends or the pulled-out loop can be melted or glued together or equipped with a clamp.

Figure 19A:
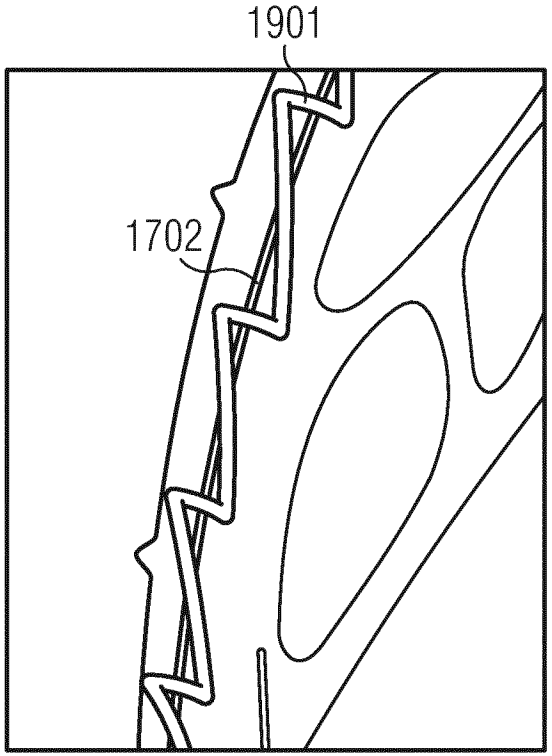
FIGS. 19*a*-19*c* are top views of options for fixing a strand on a shoe upper, according to certain embodiments of the present invention.
Figure 19B:
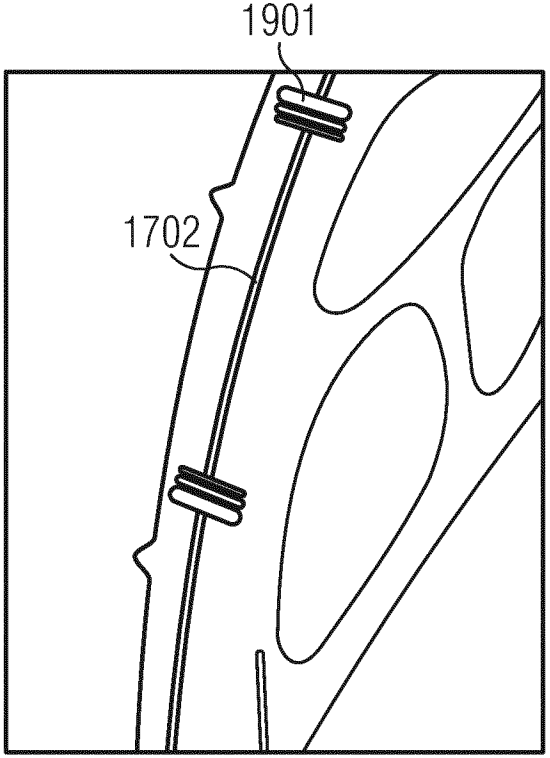
Figure 19C:
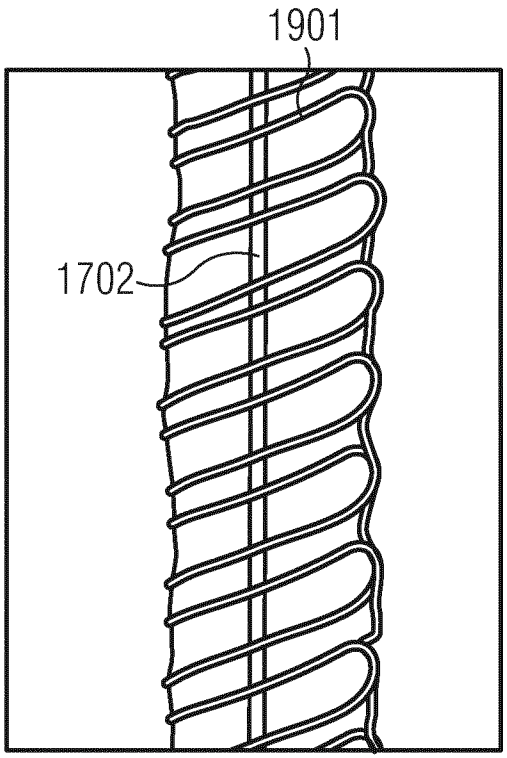

FIGS. 19*a* through 19*c* show various alternative options of fixing the strand 1702 on the shoe upper 1701. FIG. 19*a* shows an elongated zig-zag course of a thread 1901, which fixes the strand 1702 in the places in which the strand 1702 and the thread 1901 intersect. In FIG. 19*b*, the thread 1901 is sewed to the shoe upper 1701 in distanced blocks. In FIG. 19*c*, the thread 1901 is embodied as a whip stitch at the edge 1706 of the shoe upper 1701.

Figure 20:
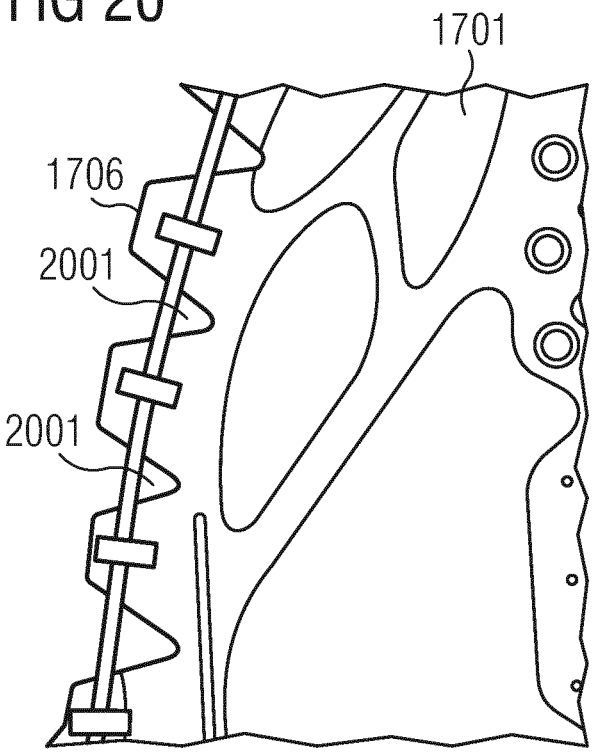
FIG. 20 is a top view of an alternative shape of an edge of a shoe upper, according to certain embodiments of the present invention.

In FIG. 20, an alternative shape of the edge 1706 of the shoe upper 1701 is shown, in which the edge 1706 comprises individual cut-outs 2001. As shown in FIG. 20, the cut-outs 2001 are realized in a triangular shape, but they can generally be of any shape. Cut-outs in the edge 1706 may be beneficial in case of stiff or thick shoe uppers so as to facilitate gathering the edge 1706 on the cobbler's last 1706.

Further variations of the present idea of the invention relate to a method of automatically attaching a lace to a shoe upper for a sports shoe, comprising the step: (a.) Fixing the lace by means of a thread in a plurality of places in the area of the lacing on the shoe upper so that the lace is substantially only moveable in the longitudinal direction in the corresponding place.

Before this step, a first free end of the lace can optionally be fixed to the shoe upper. Further optionally, after this step, the second free end of the lace can be fixed to the shoe upper. Thus, according to certain variations of the present idea of the invention, the lace is generally fixed on the shoe upper at least in a plurality of places in the area of the lacing. The ends or an end of the lace can additionally also be fixed. This can occur before or after fixing in a plurality of places.

Further aspects of these variations of the present idea of the invention relate to a shoe upper for a sports shoe manufactured according to the method as presented in the paragraph above as well as a sports shoe comprising such a shoe upper and a sole structure. The following statements apply equally to the method, the obtained shoe upper and the sports shoe.

Fixing the first free end of the lace and/or the second free end of the lace can occur by sewing or gluing. The first end can be fixed in an area of the shoe upper which is not visible in the finished shoe. Equally, the second end can be fixed in an area of the shoe upper which is not visible in the finished shoe. The places on the shoe upper in which the lace is fixed can be places in which a shoe upper usually comprises lace eyelets. The lace can be fixed by means of a yarn in these places. The lace can extend across a tongue area of the shoe upper in a zig-zag shape.

Figure 21A:
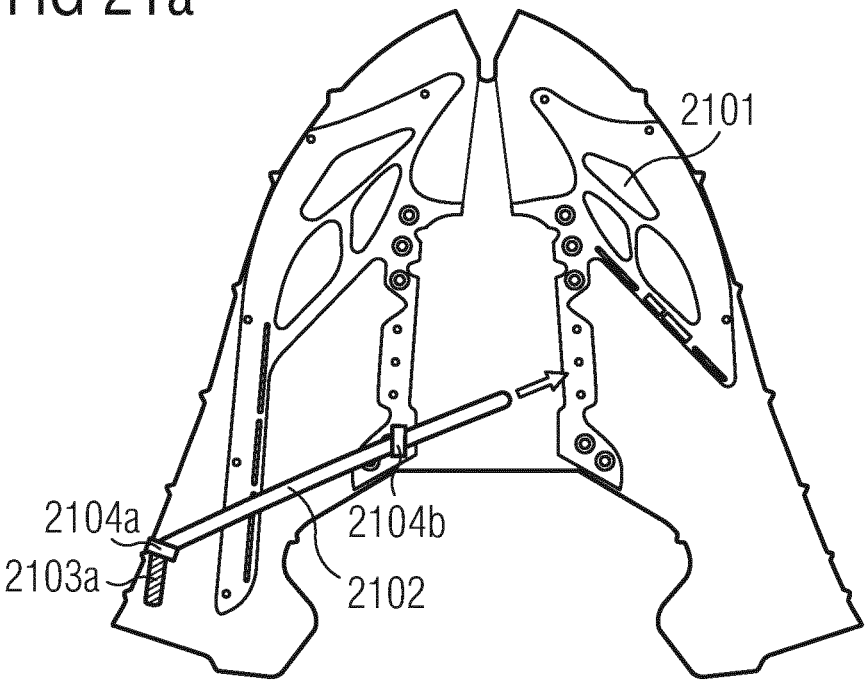
FIGS. 21*a*-21*c* are top views of a lace fixed to a shoe upper, according to certain embodiments of the present invention.

Embodiments of a method in accordance with further variations of the present idea of the invention will be explained by means of FIGS. 21*a* through 21*c* below. As shown in FIG. 21*a*, a shoe upper 2101 is provided. This can be a shoe upper described in this description. For example, the shoe upper 2101 could be arranged on the carrier layer 4 as described above, that is, by providing the carrier layer 4, arranging a yarn 5 or multiple yarns 5 on the carrier layer 4, such that the yarn 5 or the multiple yarns 5 substantially define the shape of the shoe upper 2101, and sewing the yarn 5 or at least one of the multiple yarns 5 to the carrier layer 4. The shoe upper 2101 can also be cut out from a textile, such as a woven fabric, weft-knitted fabric, warp-knitted fabric or the like. Cutting out can occur after fixing of the lace or after it. According to certain variations of the present idea of the invention, a plurality of shoe uppers can be formed on a textile reel, for example. At least one lace is then fixed to each of said shoe uppers according to the invention. Subsequently, the shoe uppers are cut out or punched out from the textile reel. Cutting out can be carried out by means of high-frequency alternating current or laser, for example.

As further shown in FIG. 21*a*, a lace 2102 is fixed on the shoe upper 2101 with a first free end. As shown in FIG. 21*a*, the first end 2103 of the lace 2102 is fixed with a thread 2104*a*. However, it is also conceivable that the first end 2103 of the lace 2102 is glued to the shoe upper 2101.

Generally, the connection between the first end 2103 of the lace 2102 and the shoe upper 2101 should be easy to release later on, e.g. by cutting off the thread 2104*a*. Thus, the fixing of the first end 2103 of the lace 2102 is a provisional fixing, so as to prevent dangling of the end 2103 during further, particularly automatic processing steps of the shoe upper 2101, for example cutting out or punching out shoe uppers from a reel. Moreover, by fixing the end 2103, the free length, i.e. the section of the lace 2102 to be tied up, can be defined. Generally, fixing the first free end 2103 of the lace 2102 is an optional step.

As further shown in FIG. 21*a*, the lace 2102 is fixed in one place on the shoe upper in the further course with a thread 2104*b*. In this place, the uppermost lace opening is usually located in a shoe upper. The lace 2102 is fixed such in this place that the lace 2102 is substantially only moveable in the longitudinal direction there. In a manner similar to a lace eyelet, the lace can thus later be pulled through the fixing formed by the thread 2104*b*.

Figure 21B:
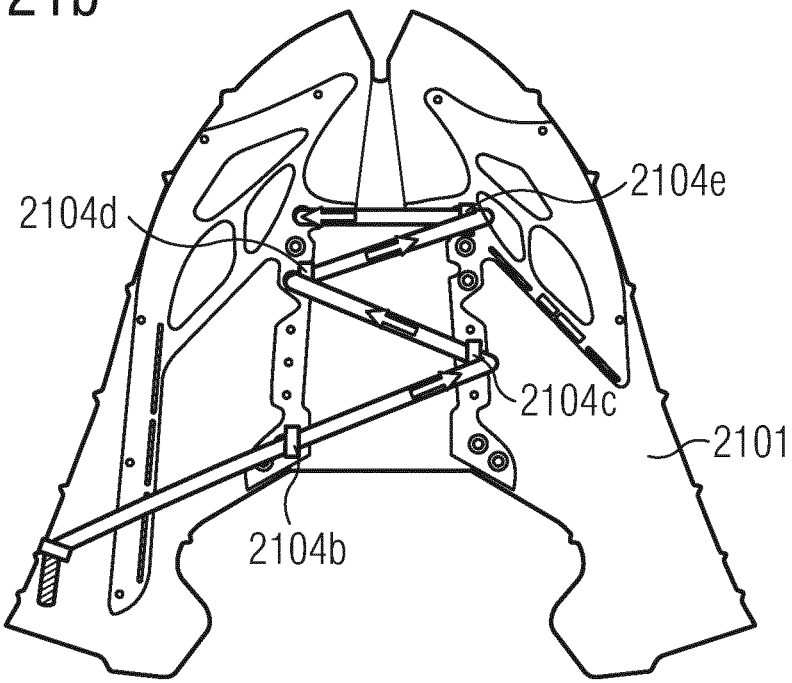

As depicted in FIG. 21*b*, the lace is fixed in further places in the lace area of the shoe upper 2101 such that the lace 2102 is substantially only moveable in the longitudinal direction there. Further threads 2104*c*, 2104*d* and 2104*e* are used for this, which can also be sections of a single thread, however. In this regard, the lace is arranged and fixed on the shoe upper 2101 in a zig-zag pattern in the direction suggested by the arrows. Generally, lacing patterns other than zig-zag can also be used, for example a parallel or diagonal guiding of the lace 2102.

Figure 21C:
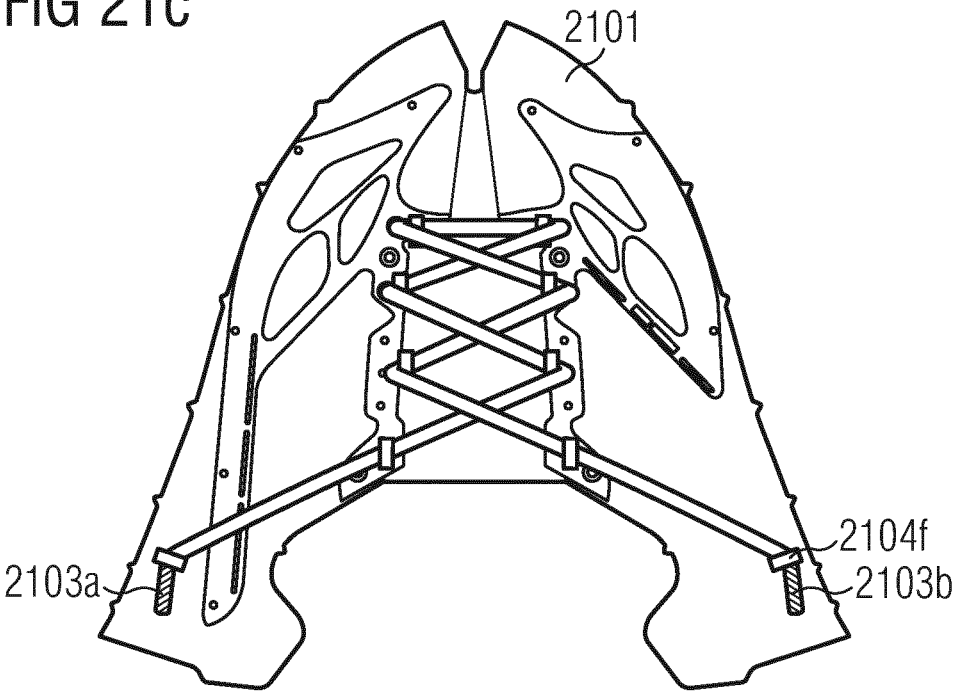

As shown in FIG. 21*c*, due to the fact that it is fixed to the shoe upper 2101, the lace 2102 is finally in accordance with the crossed arrangement conventional in case of laces. Generally, however, different arrangements of the lace 2102 are also conceivable. As further shown in FIG. 14*c*, the second free end 2103*a* of the lace 2102 is also fixed to the shoe upper 2101. The statements made with regard to the first free end 2103*a* apply with regard to this fixing. A thread 2104*f* is used for the fixing, which can also be a further section of the thread used in places 2104*a* through 2104*e*. Generally, fixing the second free end 2103*a* of the lace 2102 is an optional step.

Figure 22:
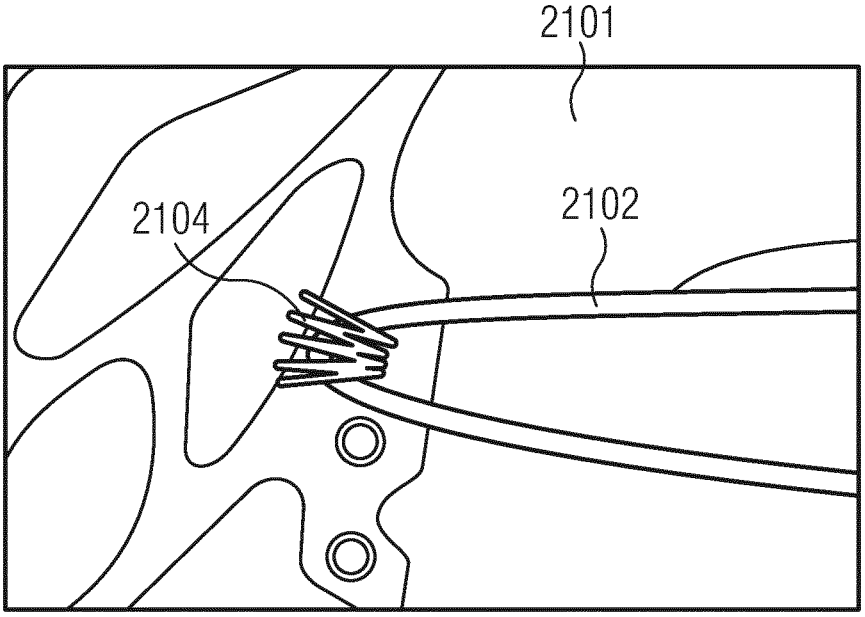
FIG. 22 is a detailed view of a lace fixed to a shoe upper, according to certain embodiments of the present invention.

FIG. 22 shows fixing of the lace 2102 on the shoe upper 2101 in detail. As illustrated in FIG. 22, the thread 2104 can form multiple loops by which the lace 2102 is fixed. Alternatively, it is also possible that only a single loop is formed, provided that the thread 2104 is correspondingly tearproof.

Figure 23:
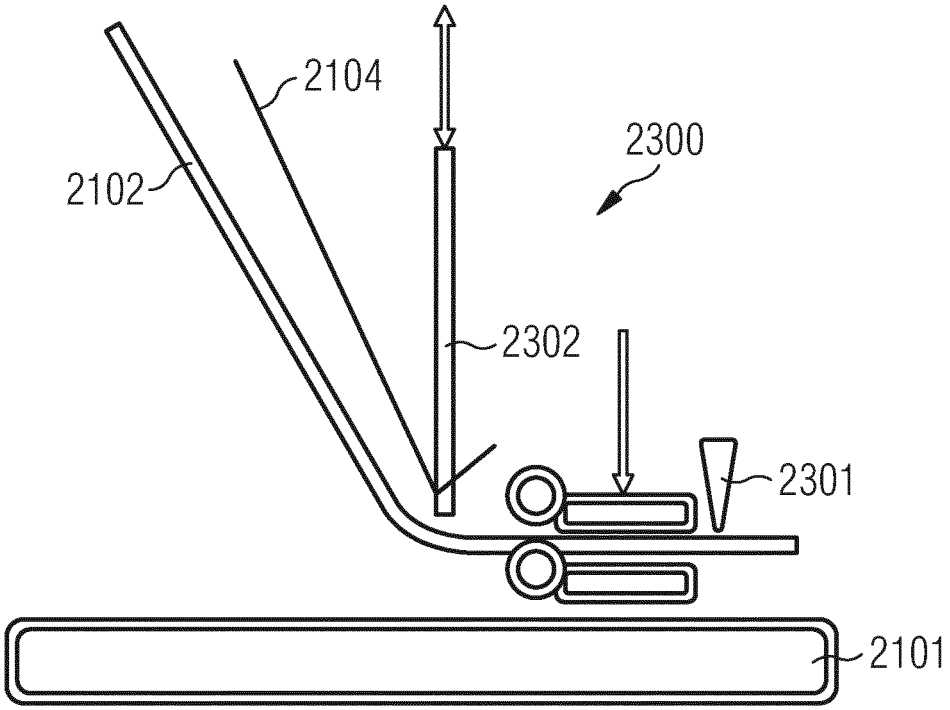
FIG. 23 is a schematic view of a head of an embroidery machine that may be used to perform a method according to certain embodiments of the present invention.

FIG. 23 shows a schematic view of a head 2300 of an embroidery machine which can be used for the described method. The lace 2102 is supplied to the embroidery machine in an endless manner or manufactured by a braiding machine located close to head 2300 when required, for example, and automatically cut to the correct length, that is, cut off, by the head 2300 of the embroidery machine. Cutting off can be carried out by a knife 2301, as depicted in FIG. 23, but also by heat, e.g. hot air, by a laser or by high-frequency alternating current or the like. The knife can be a rotating knife.

The free ends 2103*a*, 2103*b* automatically undergo a finish in the head 2300, which prevents the free ends 2103*a*, 2103*b* from frizzing. For this purpose, the free ends 2103*a*, 2103*b* can be heated up, for example, so as to melt the fibers of the lace 2102 if they are thermoplastic fibers or a combination of thermoplastic fibers and thermoset or natural fibers. Alternatively, the free ends 2103*a*, 2103*b* can be equipped with a cap, e.g. by crimping. Further alternatively, a polymer spray which cures can be used. A still further alternative is the use of a shrinking hose which is pulled over the ends 2103*a*, 2103*b* and contracts and wraps tightly around the ends 2103*a*, 2103*b* due to the application of heat. A still further alternative is dipping the ends 2103*a*, 2103*b* into a liquid polymer which cures after dipping.

As further depicted in FIG. 23, the head 2300 of the embroidery machine has a needle 2302 with which the thread 2104 is guided so as to fix the lace 2102 on the shoe upper 2101.

With regard to the presented variations of the present idea of the invention, all explanations in this description apply analogously. The features of all preferred embodiments and embodiments can particularly be transferred to the variations of the invention and vice versa to the extent to which this is useful from a technical point of view. All resulting technical effects and advantages of all preferred embodiments and embodiments can also be transferred to the variations of the idea of the invention and vice versa to the extent to which this is useful from a technical point of view.

Figure 24:
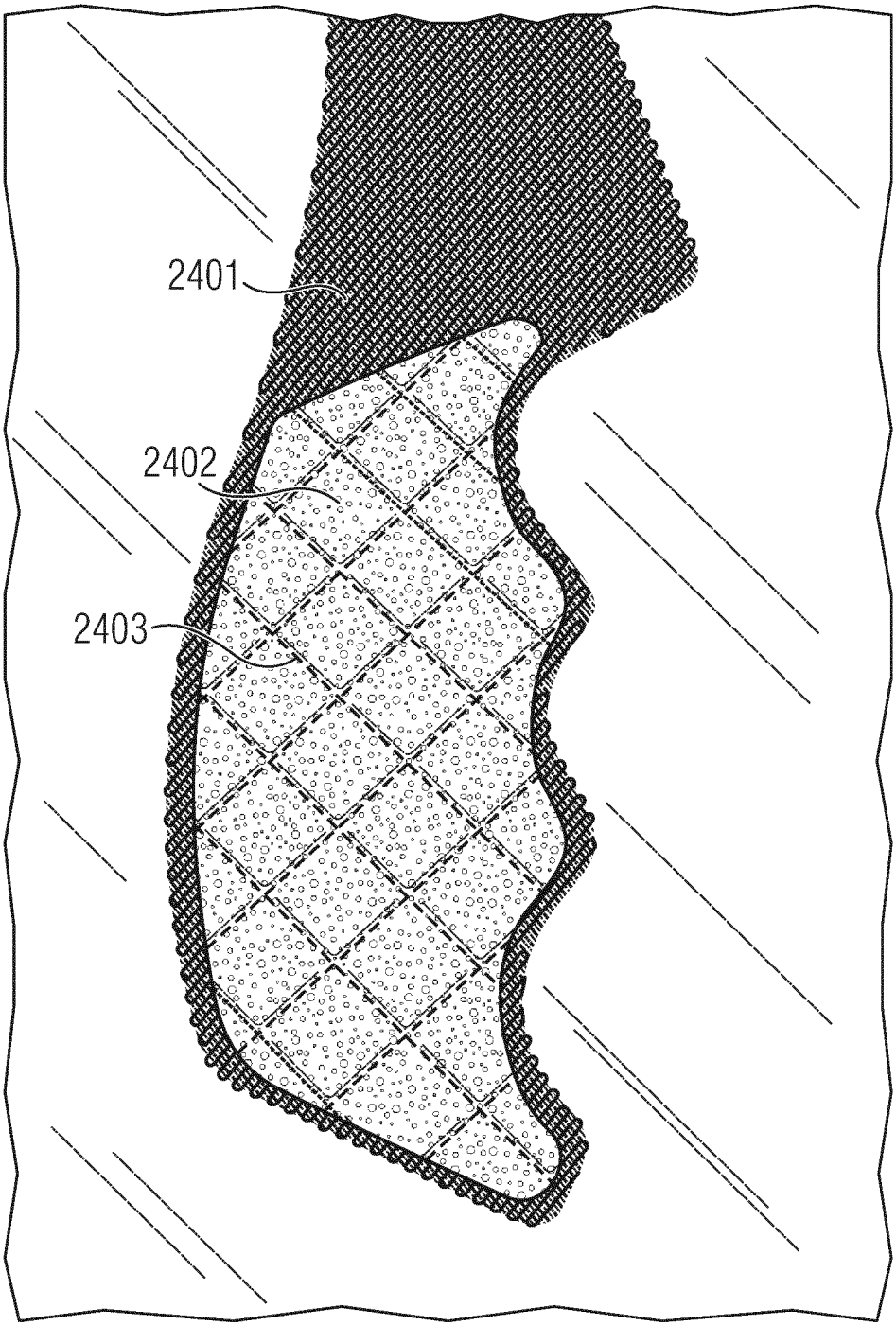
FIG. 24 is a top view of a section of a shoe upper, according to certain embodiments of the present invention.

FIG. 24 shows embodiments of the present invention, which are also applicable to the variations described herein. FIG. 24 shows a section 2401 of a shoe upper manufactured according to the present invention. A foam-material part 2402 is arranged in the heel area of the shoe upper, which is fixed to the shoe upper by means of a yarn 2403. The yarn 2403 could be the same yarn as the one from which the section 2401 of the shoe upper is formed. Alternatively, it is a separate yarn. The foam-material part 2402 can be fixed to the shoe upper during manufacture of the latter e.g. on an embroidery machine. The foam-material part 192 could be embroidered into the shoe upper, for example.

The foam-material part 2402 serves the purpose of padding the heel. The foam material can be foamed polyethylene or polypropylene. Generally, the foam-material part 2402 could also be placed in any other places of the shoe upper, e.g. in a heel area. Instead of a foam-material part, a reinforcing element could be used, which is placed on a side or an instep section of the shoe upper, for example. Such a reinforcing element could comprise holes for the yarn 2403 so as to enable fixing to the shoe upper.

Generally, in analogy to the embodiments of FIG. 24, any desired elements can be fixed in any desired places of the shoe upper so as to provide functions such as padding, reinforcement, stiffening, stability, support, etc., for example.

In particular, instead of or in combination with a cushioning foam, a tube-like yarn may be used. The tube is compressible and may be made of an elastic material (e.g. rubber). The tube may be supplied via an embroidery head 1 as described herein and may be attached to a carrier layer by means of a sewing thread. If more cushioning is desired, several layers of the tube may be provided. If less cushioning is desired, a single layer of the tube may be provided. In this way, the level of cushioning may be adapted to the specific needs and the padding may be better integrated in the shoe or apparel with transitions on its edges from multiple layers of tubes to single layers of tube.

The tube may for example be provided in the heel area of a shoe upper or in the toe area. In general, the tube may be provided at any location of a shoe upper or apparel where cushioning is needed.

A method according to further variations of the present invention, comprises the steps of (a.) arranging a yarn on a carrier layer, (b.) sewing the yarn to the carrier layer with a sewing thread in a first portion of the yarn, (c.) sewing the yarn to the carrier layer with the sewing thread in a second portion of the yarn, wherein the first portion and the second portion are spaced apart. In particular, the first portion and the second portion may be spaced apart by at least 5 mm, in particular by at least 1 cm.

What has been said above with respect to the carrier layer, yarns and threads, is valid for certain variations of the present inventive idea as well. Thus, each of the features described herein with respect to the invention and its variations may be applied to certain variations of the invention.

The yarn may be a bundle of filaments. The yarn may be an elastic yarn. The yarn may have slack between the first portion and the second portion.

Figure 25A:
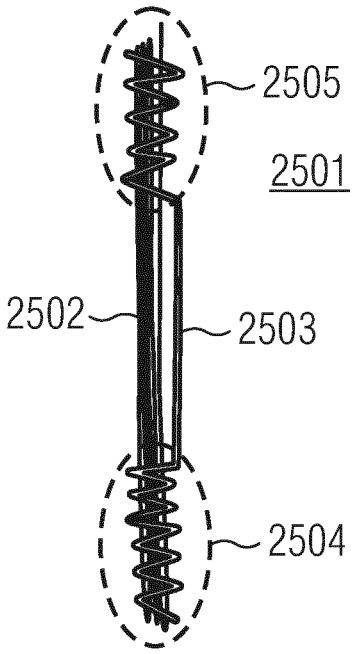
FIGS. 25*a*-25*b* are schematic views of a carrier layer, a yarn, and a sewing thread, according to certain embodiments of the present invention.
Figure 25B:
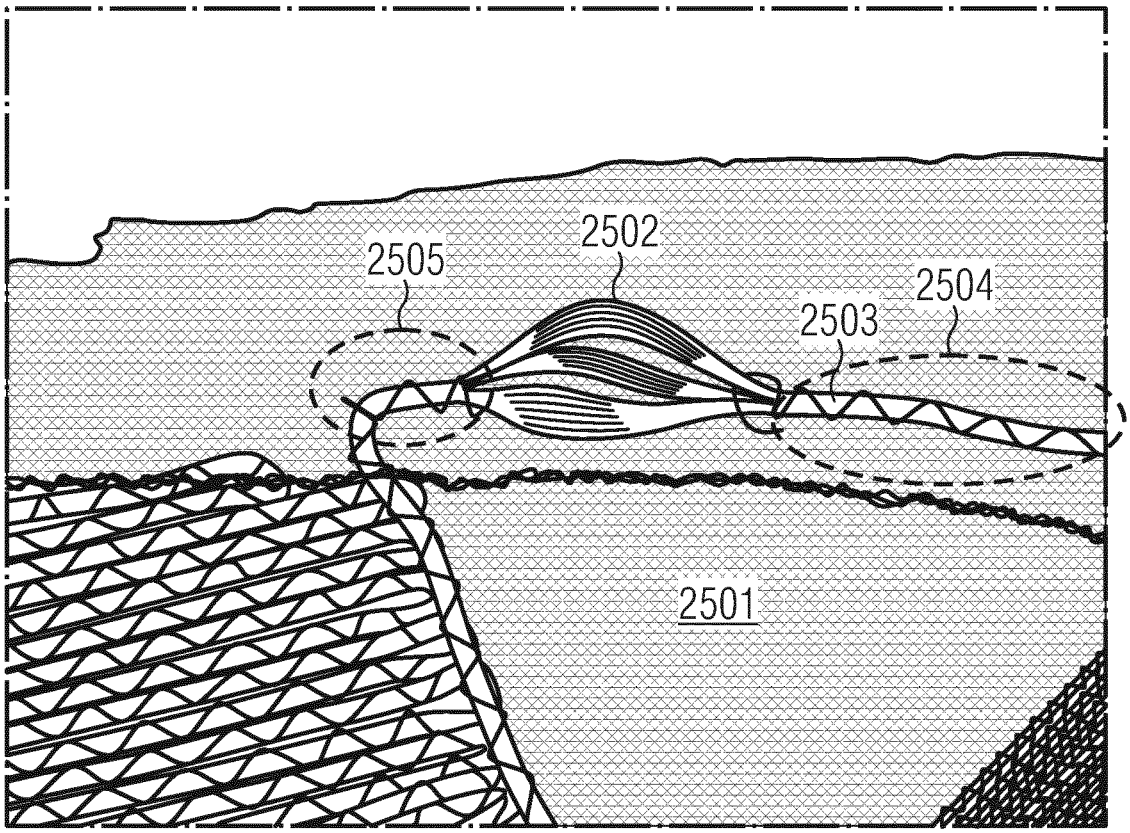

Embodiments of certain variations are described with respect to FIGS. 25*a* and 25*b*. FIG. 25*a* is a schematic drawing showing a carrier layer 2501, a yarn 2502 and a sewing thread 2503. The sewing thread 2503 fixes the yarn 2502 to the carrier layer 2501 in a first portion 2504 of the yarn 2502 and in a second portion 2505 of the yarn 2502. The first portion 2504 and the second portion 2505 are spaced apart by a certain distance, thereby forming a slack portion. Contrary to FIG. 25*a*, in the slack portion the sewing thread 2503 and the yarn 2502 may be placed on opposite faces of the carrier layer 2501, such that only the yarn 2502 is visible on one face of the carrier layer 2501.

The first portion 2504 and the second portion 2505 may be arranged in the area of a joint of a human. For example, the first portion 2504 and the second portion 2505 may be arranged in the area of an elbow of a human. Thus, the gap between the first portion 2504 and the second portion 2505 allows some slack of the yarn 2502. The yarn 2502 may for example be an elastic yarn, such that energy may be stored in the yarn 2502 when the joint (e.g. the elbow) is in a first position (e.g. bent). The stored energy may then be released to support a movement toward a second position. Also, the resistance provided by the elastic yarn may provide for a training effect of the muscles.

The slack portion of the shoe upper or piece of apparel may comprise a cover layer placed over the slack portion of the yarn (as an outer layer or a liner) to protect the yarn in such slack portion.

In the context of certain variations of the invention, a band is understood as a yarn as well. For example, the band may be an elastic TPU band.

According to further variations of the present inventive idea, a method of manufacturing a shoe upper comprises the steps of (a.) arranging a yarn on a carrier layer, (b.) sewing the yarn to the carrier layer with a sewing thread, such that the yarn forms at least one loop through which a lace may be threaded.

What has been said above with respect to the carrier layer, yarns and threads, is valid for certain variations of the present inventive idea as well. Thus, each of the features described herein with respect to the invention and its variations may be applied to certain variations of the invention.

The yarn may be arranged at an edge of a foot opening of the shoe upper. The lace may be a thread of the carrier layer. The lace may be a portion of the yarn. The yarn may be a bundle of filaments.

Figure 26A:
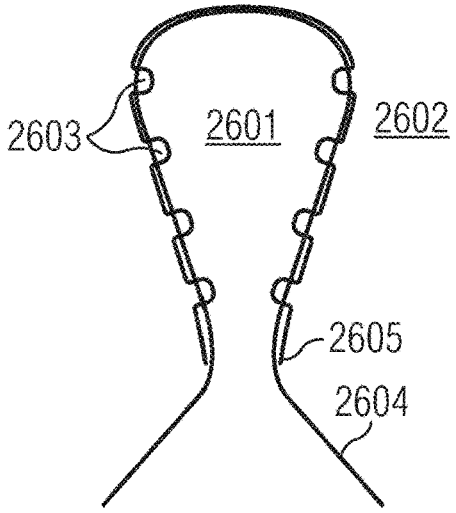
FIGS. 26*a*-26*b* are schematic views of an opening of a shoe upper, according to certain embodiments of the present invention.
Figure 26B:
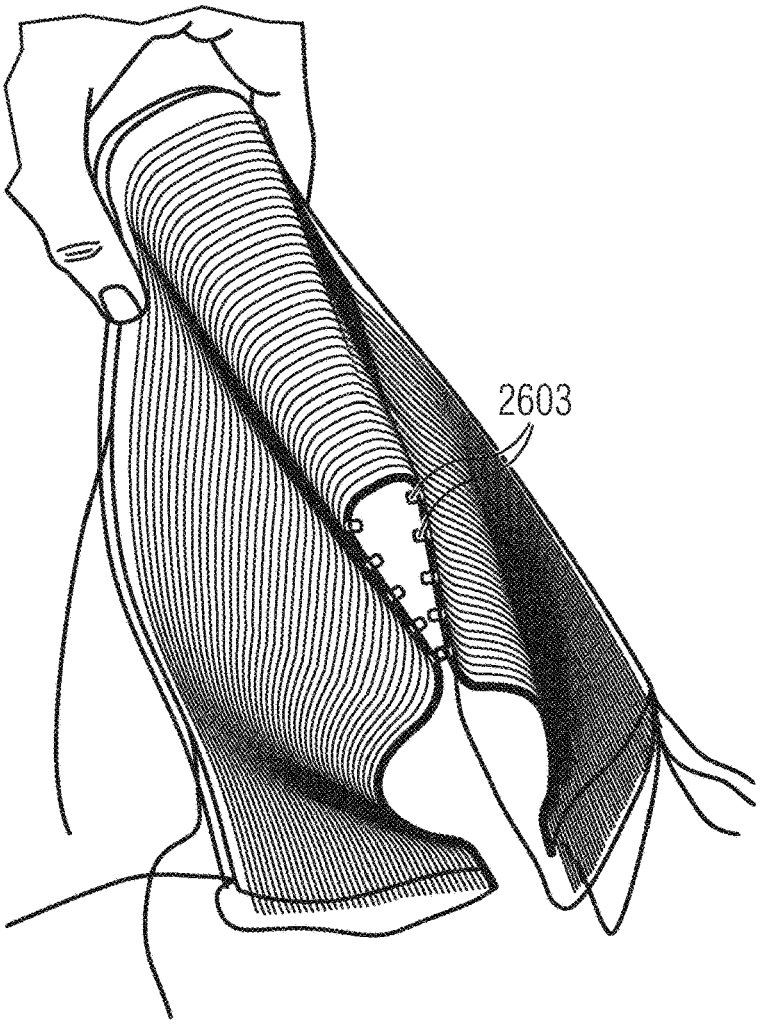
Figure 27:
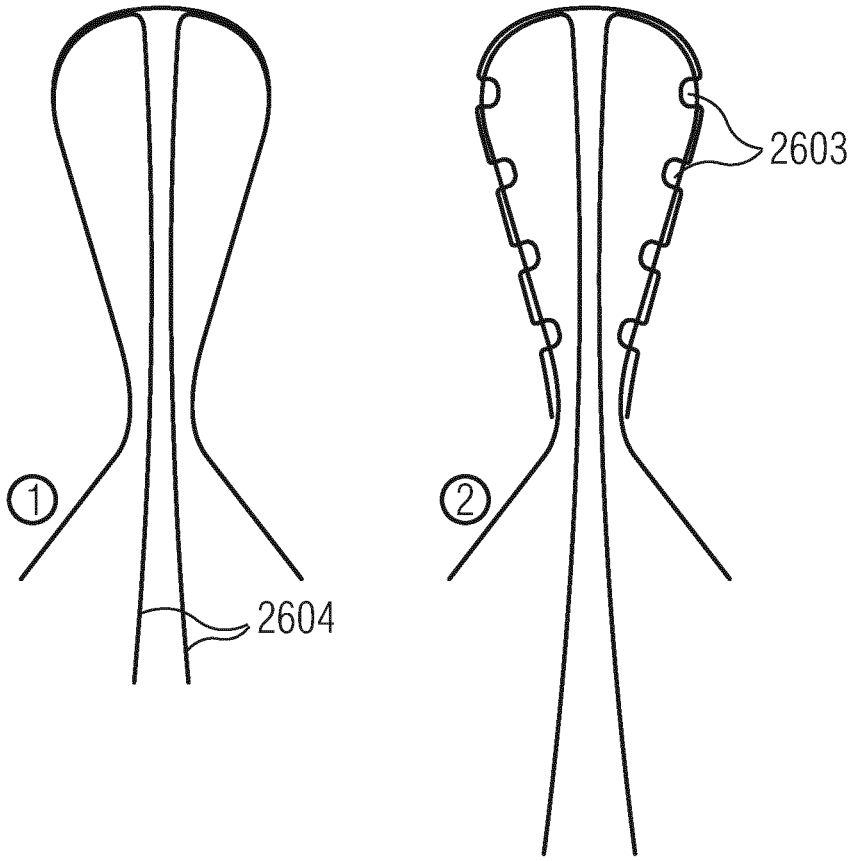
FIG. 27 is a schematic view of an opening of a shoe upper, according to certain embodiments of the present invention.

Embodiments of certain variations are described with respect to FIGS. 26*a*, 26*b* and 27. FIG. 26*a* is a schematic drawing of an opening 2601 of a shoe upper. A yarn is stitched to a carrier layer 2602 of the shoe upper. A first yarn 2604 is placed around the foot opening 2601 of the shoe upper and a second yarn 2605 is placed around the foot opening of the shoe upper, so as to form loops for receiving laces (lace not shown). Two of those loops are exemplarily depicted by the reference numeral 2603. In certain embodiments, the yarn forming loops 2603 is placed between the carrier layer 2602 and the yarn 2604 only going around the foot opening such that the yarn 2604 around the foot opening reinforces the attachment of the loops 2603 to the carrier layer 2602.

The laces are to be threaded through the loops 2603. Thus, when pulling the laces, the lateral and medial sides of the shoe upper respectively on each side of the foot opening 2601 may be tied together to firmly fix the shoe to a foot of a wearer. The yarn is sewn to the carrier layer by means of a sewing thread as described herein. Such construction can also be observed on the different embodiments of FIGS. 31*a* and 31*b*.

FIG. 26*b* shows exemplary embodiments of a shoe upper according to certain variations of the invention. In particular, the loops 2603 can be seen in FIG. 26*b* through which a lace (not shown in FIG. 26*b*) may be threaded.

FIG. 27 shows further embodiments of certain variations of the present invention. According to FIG. 27, a yarn is attached to the shoe upper 2602 on a portion of its length, e.g. by stitching with a sewing thread, and is let free on an end portion forming a lace 2606. As shown in FIG. 27, the yarn 2606 is attached by stitching around the foot opening 2601 of the shoe upper and its end portion is let free from the front edge of the foot opening 2601.

The yarn 2606 that form a lace may be the same yarn 2605 that forms the loops 2603 or it may be a different yarn. Thus, in a first step depicted on the left side of FIG. 27 the laces are formed by the yarn 2606. Then, in a second step, the loops 2603 are formed by a second yarn 2605. In a further step (not shown in FIG. 27), the laces 2606 are threaded through the loops 2603.

According to further variations of the idea of the present invention, a method of manufacturing a shoe upper or apparel comprises the steps of (a.) arranging a melting yarn on a first layer, (b.) sewing the melting yarn to the first layer by a sewing thread, and (c.) applying heat to the melting yarn, such that the melting yarn melts.

What has been said above with respect to the first layer, yarns and threads, is valid for these variations of the present inventive idea as well. Thus, each of the features described herein with respect to the invention and its variations may be applied to these variations of the invention. In particular, the first layer may be a carrier layer as described herein.

The first layer may dissolvable. The first layer may be a textile layer. The first layer may be formed by a second yarn arranged on a substrate. The substrate may be dissolvable.

The melting yarn may be made from a thermoplastic such as a TPU. The melting yarn may comprise a coating made of thermoplastic, and a different core that may or may not be a thermoplastic. For example the yarn may have a core of between 50 Deniers and 300 Deniers, for example of about 125 Deniers, and a total linear mass density of between 70 and 1200 Deniers, for example of about 750 Deniers. The coating may have a thickness of about 350 micrometers. The core of the yarn may be a high tenacity polyester, and the coating a TPU.

The melting yarn may be arranged on the carrier layer to form melted zones.

The method may further comprise the step of melting the melting yarn by UV or infrared light.

Alternatively or in combination, the method may further comprise the step of arranging a second layer above the first layer, such that the melting yarn is arranged between the first layer and the second layer. Thus, the melting yarn may bond both layers together. For example, and as shown in FIG. 31*c*, the first layer may be a base layer (or carrier layer) 3102 of an upper (e.g. a textile or knit) and the second layer may be a layer of embroidered yarn 3103 according to the invention. At least one melting yarn 3105 may be arranged between the second layer and the first layer and may be fixed to the first layer by a sewing thread 3106. The melting yarn is thereby melted for example to attach the second layer to the first layer before the sewing threads of the second layer are dissolved.

The method may further comprise the steps of arranging the melting yarn in a first attachment area of the shoe upper or piece of apparel and of folding a second attachment area of the shoe upper or apparel so that the second area at least partially overlaps the first area. In this way, the first layer (carrying the first attachment area) may be bonded to the second layer (carrying the second attachment area) by means of the melting yarn. The melting yarn may be arranged on the first layer and on the second layer.

Figure 28:
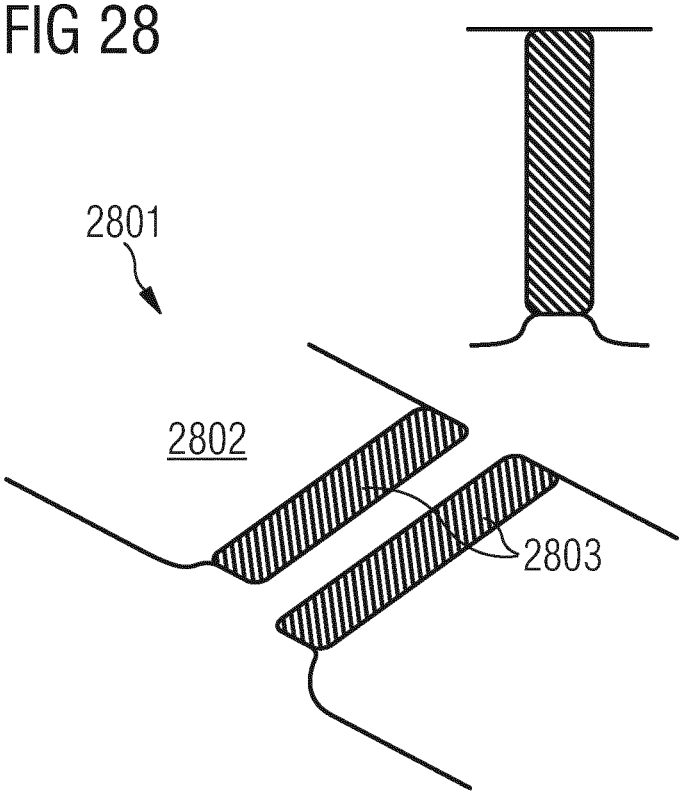
FIG. 28 is a schematic view of a heel area of a shoe upper, according to certain embodiments of the present invention.

FIG. 28 is a schematic drawing of certain embodiments of these variations of the present invention and shows a part of a shoe upper 2801, namely its heel area. Usually uppers are made from a two-dimensional material which is formed into a three dimensional shape. During this process, edges of the shoe upper must be joined to form a finished three-dimensional shape. Usually, this joint is located in the heel area of the shoe upper, although it could be located at any other location of the shoe upper or apparel according to these variations of the inventive idea.

As shown in FIG. 28, a melting yarn 2803 is arranged on both sides of the heel edges of the two-dimensional upper. The melting yarn is arranged on a first layer 2802 which could for example be a textile layer, knit layer, mesh, etc. The melting yarn 2803 is sewn to the first layer 2802 by a sewing thread (not shown in FIG. 28) as described herein in detail so as to form an attachment area. The heel edges are brought into contact and heat is applied to the melting yarn, such that the melting yarn melts. Alternatively heat may be applied first to the melting yarn and then the edges brought together. When cooling down, the melting yarn stiffens and firmly bonds the two heel edges together, such that the shoe upper is maintained in its three-dimensional shape.

In general, in the context of these variations of the invention, arbitrary areas of an apparel or of a shoe upper may be bonded by such melting yarn.

According to further variations of the present invention, a method of manufacturing a shoe upper or apparel comprises the steps of (a.) arranging a first yarn on a carrier layer, (b.) arranging a second yarn on the carrier layer, such that first yarn crosses the second yarn in at least a first point and a second point, wherein in the first point the first yarn passes between the second yarn and the carrier layer and in the second point the second yarn passes between the first yarn and the carrier layer, and (c.) sewing the first yarn and the second yarn to the carrier layer by a sewing thread.

What has been said above with respect to the yarns, sewing thread and carrier layer is applicable to these variations of the invention as well. Thus, each of the features described herein with respect to the invention and its variations may be applied to these variations of the invention.

According to these variations of the invention, the first yarn and the second yarn are fixed to the carrier layer in a kind of braided arrangement which provides stability to the shoe upper or apparel.

The method could further comprise the step of dissolving the carrier layer. Thus, the braided structure of the two yarns remains stable. The method could further comprise the step of dissolving the sewing thread. Thus, the first yarn and the second yarn are held together by their braided arrangement.

The method may further comprise the step of feeding the first yarn and the second yarn by separate heads of an embroidery machine.

This variation of the present invention is described with respect to two yarns which are arranged on a carrier layer in a braided fashion. However, the method may generally be performed with more than two yarns, for example with three yarns. In general, the yarns may be arranged on the carrier layer in any known braiding pattern.

According to these variations of the invention, a yarn with a varying thickness of filaments in different parts of the shoe upper or apparel may be used. Thus, thicker filament could for example be used in areas with high mechanical stress such as the heel portion of a shoe upper.

The apparel or shoe upper could be made from at least two parts, wherein each part comprises yarns in a braided arrangement as described above.

In general, by these variations of the invention, the stretchability of the apparel or shoe upper can be controlled by a corresponding arrangement of the yarns. For example, the yarns could be arranged with more slack in between the first point and the second point. This would allow for more stretchability. Vice versa, if the two yarns are close to each other between the first point and the second point, the stretchability (or elasticity) is limited.

The first yarn and the second yarn may be present only at selected locations of the apparel or shoe upper. Thus, the apparel or shoe upper may have more stretchability in locations without the yarns, whereas other locations (comprising the yarns) may have limited stretchability.

Figure 29:
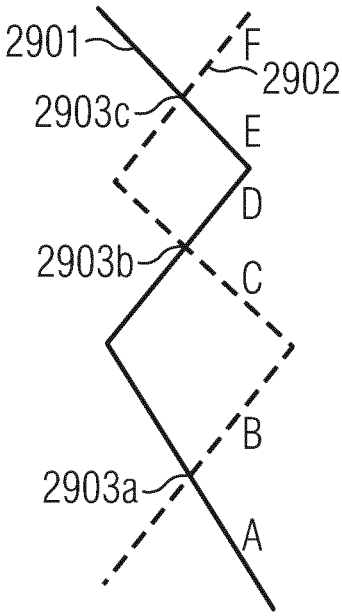
FIG. 29 is a schematic illustration of a first yarn and a second yarn arranged on a carrier layer, according to certain embodiments of the present invention.

FIG. 29 shows a schematic illustration of these variations of the present invention. FIG. 29 shows a first yarn 2901 and a second yarn 2902 arranged on a carrier layer (not explicitly shown in FIG. 29). The first yarn 2901 and the second yarn 2902 are fixed to the carrier layer by a sewing thread (not shown in FIG. 29). The usage of a sewing thread has been described herein in detail. For example, an embroidery machine as described above could be used to fix the first yarn 2901 and the second yarn 2902. The first yarn and the second yarn cross each other in the points 2903*a*, 2903*b* and 2903*c*.

In point 2903*a* the first yarn 2901 passes between the second yarn 2902 and the carrier layer, i.e. the second yarn 2902 is above the first yarn 2901. In point 2903*b*, the situation is reversed, i.e. the second yarn 2902 passes between the first yarn 2901 and the carrier layer, i.e. the first yarn 2901 is above the second yarn 2902. Finally, in point 2903*c* the situation is similar to point 2903*a*, i.e. the first yarn 2901 passes between the second yarn 2902 and the carrier layer, i.e. the second yarn 2902 is above the first yarn 2901. Such arrangement may be obtained with a machine comprising multiple stitching heads, each stitching head stitching a yarn to the carrier layer, and the heads stitching a yarn alternatively one after the other over a stitched yarn previously stitched by another head. In the example of FIG. 29 the yarn section A is first laid and stitched to the carrier layer by a first stitching head, then yarn sections B and C are laid and stitched by a second stitching head, then yarn sections D and E are laid and stitched by the first stitching head and yarn section F is then laid and stitched by the second stitching head. This may be obtained by alternatively varying the speeds of the stitching head. In this way, a braided arrangement of the first yarn 2901 and the second yarn 2902 is obtained.

In the context of FIG. 29, the carrier layer may be a dissolvable layer as described herein. Alternatively, the carrier layer may be a non-dissolvable layer like for example a textile, knit, woven, non-woven, etc.

Figure 30A:
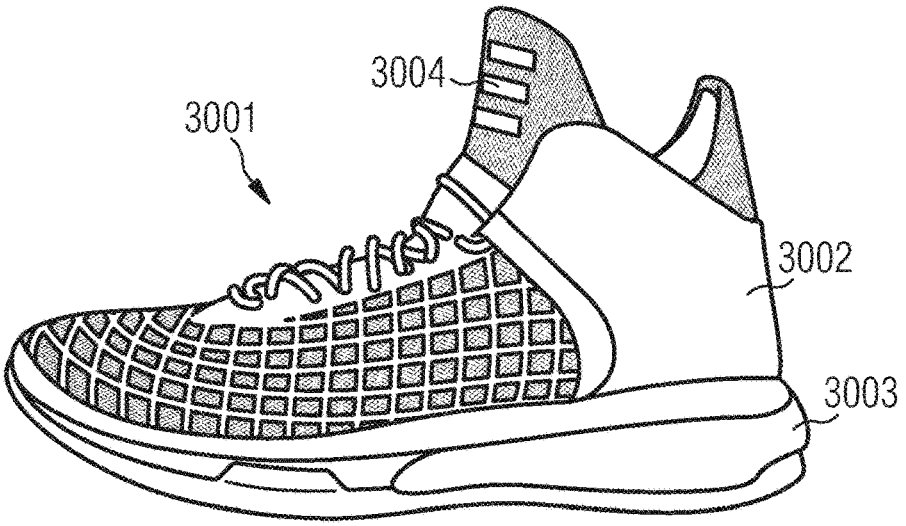
FIGS. 30*a*-30*c* are side and top views of a shoe, according to certain embodiments of the present invention.
Figure 30B:
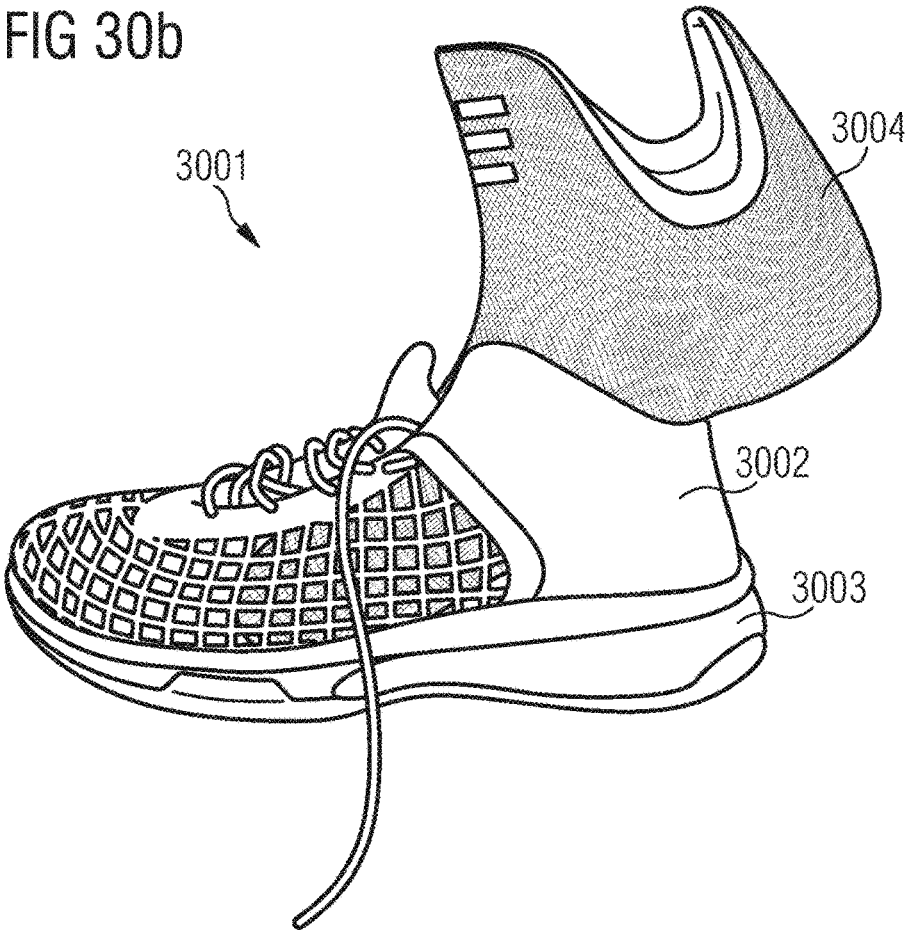
Figure 30C:
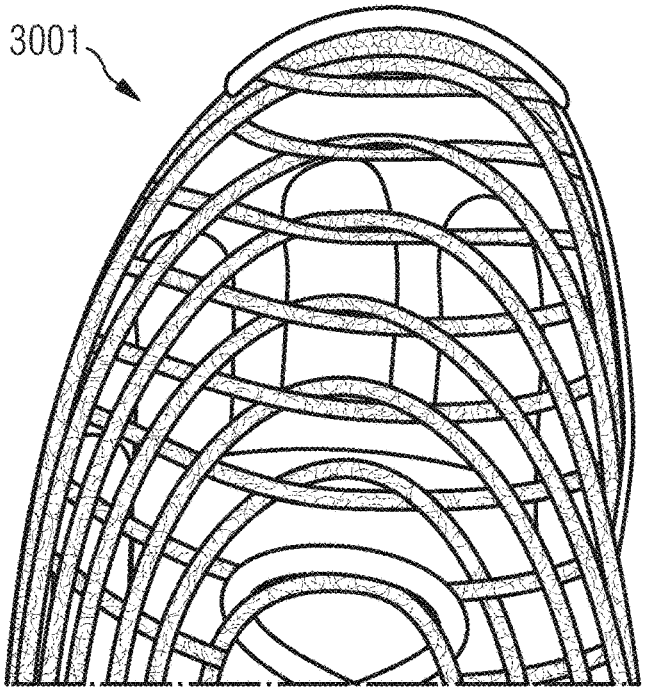

FIGS. 30*a*, 30*b* and 30*c* show embodiments of a shoe 3001 according to the present invention and its variations presented herein. The shoe 3001 comprises an upper 3002 and a sole structure 3003. The shoe 3001 also comprises a removable sock 3004 which can best be seen in FIG. 30*b*. The sock is made from a textile material. However, any suitable material may be used. The upper 3002 forms a cage-like structure around the sock 3004 which can best be seen in FIG. 30*c* in which the sock 3004 has been removed. The carrier layer has been dissolved, such that the inner of the shoe upper 3002 is visible when the sock 3004 is removed. A choice of sufficiently stiff yarns provide stability to the shoe upper, such that the foot is well supported.

The cage-like structure of the upper 3002 has been obtained by stitching (or sewing) at least one yarn to a carrier layer with a sewing thread and by subsequently dissolving the carrier layer, such that the cage-like structure formed by the yarn remains as shown in FIGS. 30*a* and 30*b*. Thus, what has been said above with respect to the yarns, sewing thread and carrier layer is applicable to these variations of the invention as well. Thus, each of the features described herein with respect to the invention and its variations may be applied to these variations of the invention.

In general, according to the present invention and its variations, a component may be made by stitching a yarn to a carrier layer by means of a sewing thread. The carrier may be dissolvable or non-dissolvable as described herein. The component may be attached, in particular by stitching or sewing, to a base layer of an upper or apparel (for example a sock). In particular, the structure may surround a part or all of the upper or apparel, so as to provide support. The component may form a structure around an internal sock of an upper.

Figure 31A:
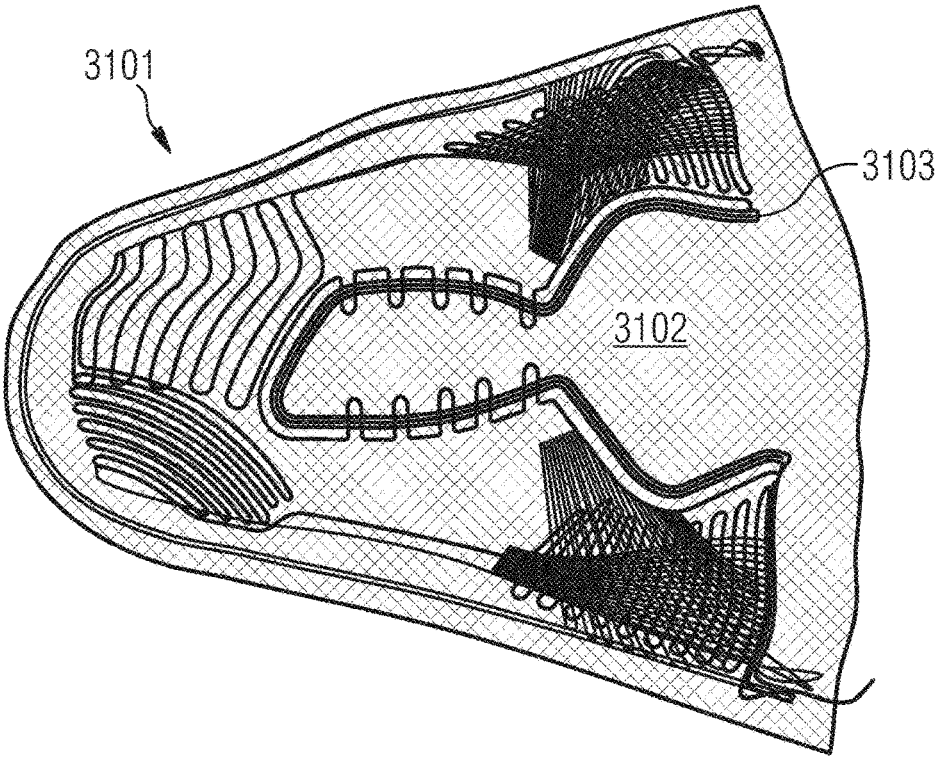
FIGS. 31*a*-31*c* are top views of a shoe upper, according to certain embodiments of the present invention.
Figure 31B:
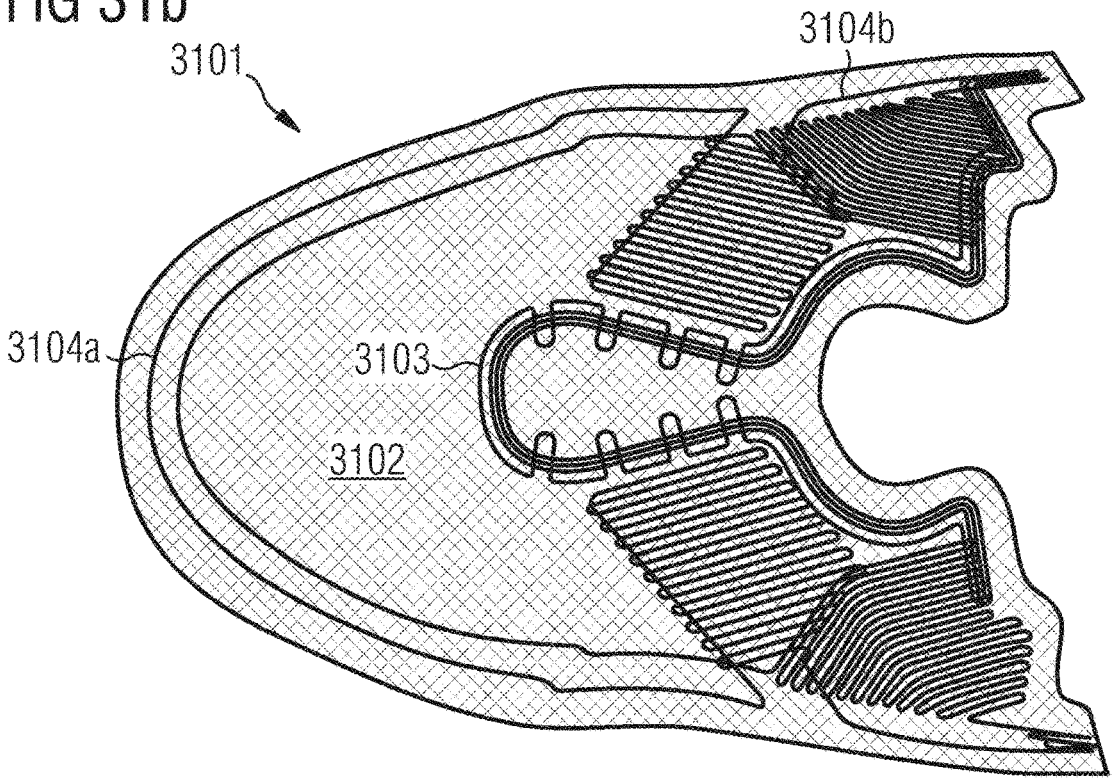
Figure 31C:
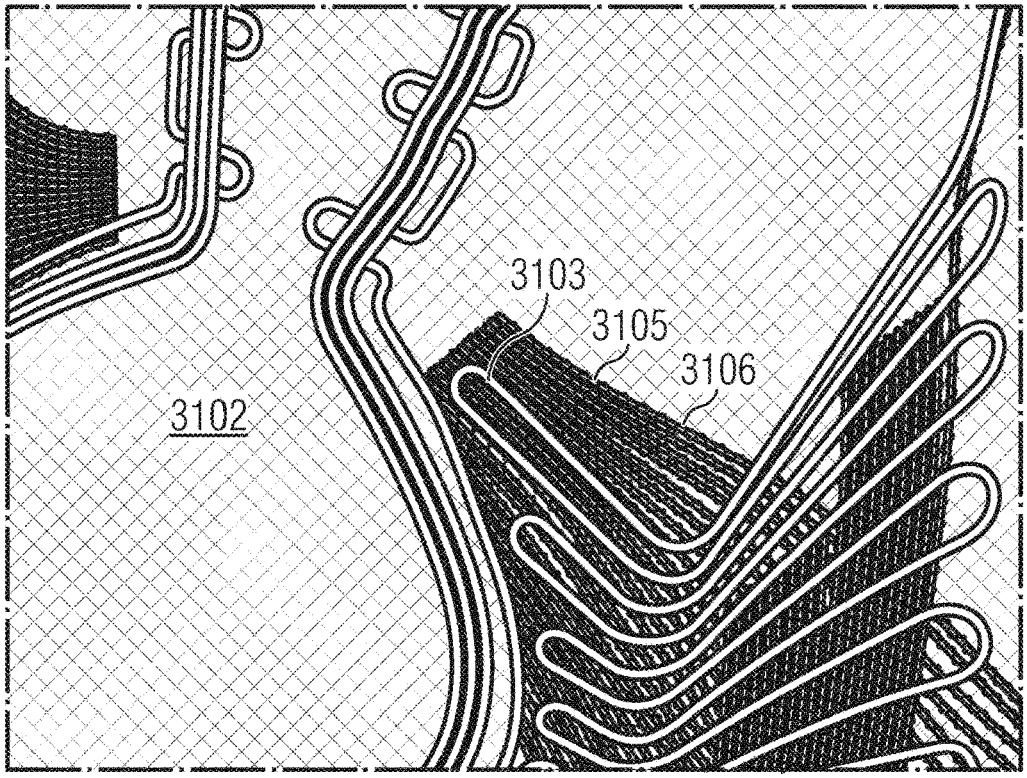

FIGS. 31*a* and 31*b* show exemplary embodiments of the invention and its variations. These embodiments comprise a shoe upper 3101 with a textile carrier layer 3102. However, any type of carrier layer could be used as well. In these embodiments, a yarn 3103 is sewn to the carrier layer 3102 with a sewing thread (not visible in FIGS. 31*a* and 31*b*). The yarn 3103 is sewn to the carrier layer 3102 at the edge of the shoe upper 3101 forming the foot opening. Thus, the yarn 3103 surrounds the foot opening to be cut out of the carrier layer 3102. In this way, an unraveling of the textile material of the carrier layer 3102 is avoided and the edges of the finished upper are reinforced against abrasion and mechanical stress. The yarn 3103 may run around the foot opening more than once, e.g. twice or three times as depicted in FIGS. 31*a* and 31*b*.

Instead of a single yarn 3103, at least two different yarns may be used to finish the edge of the upper. A first yarn of a first material and/or thickness may be laid first at the edge, then a second yarn of a different material and/or thickness may be laid at said edge. Also, many different yarns may be laid together (with the same stitching yarn). These yarns may be of different material and/or of different thickness.

FIG. 31*a* also shows the advantage of providing different stiffness to different areas of the shoe by having different density of the yarns on the upper. Thereby in this example the front lateral side has a different yarn density than the front medial side.

FIG. 31*c* shows variations of the embodiments of FIGS. 31*a* and 31*b*. In these embodiments, the base layer (or carrier layer) 3102 is a knit and a first layer of a melting yarn 3105 is stitched to the carrier layer 3102 by means of a sewing thread 3106 according to the invention. The melting yarn 3105 may be made from a thermoplastic such as a TPU. The melting yarn may comprise a coating made of thermoplastic, and a different core that may or may not be a thermoplastic. For example the yarn may have a core of between 50 Deniers and 300 Deniers, for example of about 125 Deniers, and a total linear mass density of between 70 and 1200 Deniers, for example of about 750 Deniers. The coating may have a thickness of about 350 micrometers. The core of the yarn may be a high tenacity polyester, and the coating a TPU.

Further, as shown in FIG. 31*c*, a second yarn 3103 forming a second layer is arranged on top of the first layer by means of a further sewing thread. By melting the melting yarn 3105, the second yarn 3103 is firmly bonded to the carrier layer 3102.

The density of yarns in an area, and/or the orientation of the yarns in an area, and/or the size of each area according to one of the variations of the invention may be customized depending on data relative to a user. The data relative to the user may in particular comprise choices of the user and/or data obtained by static or dynamic measurements of the body of the user.

Alternatively or in combination, the invention also envisions embodiments of manufacturing methods in which a single continuous yarn is used to form different reinforcement areas such as in the exemplary embodiments of FIGS. 31*a*, 31*b* and 31*c*. Such continuous yarns may then be cut or hidden from the outside during a subsequent manufacturing step, as for yarn sections 3104*a* and 3104*b* in FIG. 31*b*. In other specific embodiments, the continuous yarn may remain integral on the shoe upper or piece of apparel. In some embodiments of shoe uppers, the yarns may continuously run all around the shoe upper from the heel to the medial side, to the front side (toe area or instep), to the lateral side and back to the heel. Thereby a higher strength may be obtained in the shoe upper which is particularly advantageous in some sports such as basketball for example.

In general, according to the present invention and its variations, external support components may be manufactured according to a manufacturing method of the invention and/or one of its variations described herein, which may then be attached to an apparel or a shoe, in particular to a shoe upper, for example by stitching, melting yarns, gluing, etc.

Also, the present invention and its variations can be used to place yarns in the form of numbers and letters to provide an apparel or shoe with labeling.

In general, an apparel or shoe upper according to the invention may comprise materials (in particular yarns and threads) reclaimed from the ocean, in particular reclaimed plastics from the ocean. In case such material does not have the same characteristics as unrecycled material, the present invention and its variations is advantageous as the yarns used are much less manipulated during manufacturing and during use. This is in particular true for manufacturing as the yarn undergoes much less flexion, torsion, tension, etc. as compared for example to woven or knitted fabrics.

Also, the fact that the sewing yarns used in the present invention and its variations may be dissolvable may be beneficial as regards to recycling. An upper made of a base or carrier layer and additional structures such as one or more yarns stitched or sewed on it with dissolvable yarn allows to separate very easily the different parts each made of potentially different materials.

According to further variations of the present invention, a first yarn section and a second yarn section may be sections of two distinct yarns. These yarns may for example comprise different characteristics like for example diameter, moisture transport, thermal insulation, tensile strength, etc. In this way, several functions may be provided on a location of the shoe upper. For example a first yarn, on which the first yarn section is arranged, may be very abrasion resistant, while a second yarn on which the second yarn section is arranged, may have good moisture transport properties to transport moisture from the inner of the shoe to the outside. In a further example, the second yarn may be a relatively inelastic yarn to further improve the stiffness of the shoe upper. The second yarn could also be a rubberized yarn which increases friction for example with a sports ball to allow for a better ball control.

According to certain variations of the present invention, the number of stitches per unit of length may vary along the length of the section of a yarn. In particular the number of stitches per unit of length may be higher in portions where the laid yarn forms curves, in particular where it forms curves of 90 degrees or more, for example U-turns (about 180 degrees).

This feature permits to obtain a better fixation of the yarn in the sensible area where it forms curves. Thereby the longevity of the product is improved. This feature may also allow local differences in the mechanical behavior of the shoe upper or apparel. Indeed a different density of stitches may vary the abrasion resistance, the grip, the elasticity, etc. of the results product. Also different aesthetic effects may be obtained for example with a yarn of one color and a sewing thread of another color.

The distance between stitches can vary from a tenth of a millimeter to several centimeters. The distance between stitches may be of about the diameter of the sewing thread, such that the sewing thread locally covers the yarn.

Also, the stitch structure, the knitting stitch and/or the yarn used can be varied on a same yarn and/or yarn section, such that different properties are achieved in different areas of the yarn and/or of the shoe or apparel.

Generally, all embodiments, exemplary embodiments and variations of the invention presented in this description can be combined with one another, i.e. the features of certain embodiments and/or exemplary embodiments and/or variations of the invention can provide further embodiments and/or exemplary embodiments and/or variations of the present invention together with the features of other embodiments and/or exemplary embodiments and/or variations of the present invention, without the combination of these features being explicitly mentioned herein.

In the following, further examples are described to facilitate the understanding of the invention:

1. Shoe upper for a sports shoe, comprising:
   a. a first layer with a first surface and an opposing second surface;
   b. a first yarn section with a first diameter, wherein the first yarn section is arranged on the first surface of the first layer;
   c. a second yarn section with a second diameter, wherein the second yarn section is arranged on the first surface of the first layer;
   d. wherein the first yarn section and the second yarn section comprise at least one parallel portion in which the first yarn section is substantially parallel to the second yarn section, and
   e. wherein the distance between the first yarn section and the second yarn section is smaller than the larger of the first diameter and the second diameter.
2. Shoe upper according to example 1, wherein the distance between the first yarn section and the second yarn section is smaller than half the larger of the first diameter and the second diameter.
3. Shoe upper according to one of the preceding examples, wherein the distance between the first yarn section and the second yarn section is smaller than one third of the larger of the first diameter and the second diameter.
4. Shoe upper according to one of the preceding examples, wherein the first yarn section and the second yarn section contact each other.
5. Shoe upper according to the preceding example, wherein the first yarn section and the second yarn section contact each other over the entire length of the parallel portion.
6. Shoe upper according to one of the preceding examples, wherein the length of the parallel portion is at least 1 cm.
7. Shoe upper according to one of the preceding examples, wherein the first yarn section and the second yarn section are sections of a single continuous yarn.
8. Shoe upper according to one of examples 1-6, wherein the first yarn section and the second yarn section are sections of two distinct yarns.
9. Shoe upper according to one of the preceding examples, comprising a plurality of first yarn sections and second yarn sections with corresponding parallel portions.
10. Shoe upper according to the preceding example, wherein the parallel portions are arranged in a row and the distance between the respective first yarn sections and the respective second yarn sections decreases along the row.
11. Shoe upper according to one of the preceding examples, further comprising a first area in which the first yarn section and the second yarn section are arranged, comprising a yarn density of 5 to 20 yarns per centimeter.
12. Shoe upper according to one of the preceding examples, further comprising a plurality of areas with different yarn densities.
13. Shoe upper according to example 11, wherein the yarn density of the areas increases in a certain direction along a surface of the shoe upper.
14. Shoe upper according to one of the preceding examples, wherein the first diameter and the second diameter are between 0.3 mm and 2 mm.
15. Shoe upper according to one of the preceding examples, wherein the first yarn section and the second yarn section are arranged in a heel area, an area of the foot opening, a lacing area, or a toe area of the shoe upper.
16. Shoe upper according to one of the preceding examples, wherein the yarn or the yarns, respectively, on which the first yarn section and the second yarn section are arranged is/are sewn to the first layer.
17. Shoe upper according to one of the preceding examples, wherein the first yarn section and the second yarn section are sewn to each other.
18. Shoe upper according to one of examples 16 or 17, wherein a sewing thread is used for sewing.
19. Shoe upper according to the preceding example, wherein the sewing thread is thinner than the yarn or the yarns, respectively.
20. Shoe upper according to one of the preceding examples, wherein the first layer comprises yarn.
21. Shoe upper according to the preceding example, wherein the first layer comprises a first yarn, and the first yarn section and the second yarn section are formed on a second yarn arranged in a second layer, wherein the first layer and the second layer are arranged partially above each other.
22. Shoe upper according to example 21, wherein the second layer is arranged in the heel area, in the toe area, or in the area of the shin.

23. Shoe upper according to one of examples 21 or 22, wherein at least one reinforcing element is arranged between the first layer and the second layer.
24. Shoe upper according to example 23, wherein the reinforcing element is a heel counter, a toe counter or a shin guard.
25. Shoe upper according to example 24, wherein the reinforcing element is made from plastic, textile, leather or artificial leather.
26. Shoe upper according to one of examples 21 to 25, wherein the first yarn and/or the second yarn is a melting yarn.
27. Shoe upper according to one of examples 21 to 25, wherein the first yarn and/or the second yarn is a filament yarn.
28. Shoe upper according to example 27, wherein the filament yarn comprises carbon fibres.
29. Shoe upper according to one of the preceding examples, wherein the first layer is arranged substantially in the entire shoe upper.
30. Shoe upper according to one of the preceding examples, wherein the first layer substantially defines the shape of the shoe upper.
31. Shoe comprising a shoe upper according to one of the preceding examples.
32. Method of manufacturing a shoe upper according to one of examples 1 to 30, comprising the steps:
   a. Providing a first layer with a first surface and an opposing second surface;
   b. Providing a first yarn section with a first diameter on the first surface of the first layer;
   c. Providing a second yarn section with a second diameter on the first surface of the first layer,
   d. such that the first yarn section and the second yarn section comprise at least one parallel portion in which the first yarn section is substantially parallel to the second yarn section, and
   e. such that the distance between the first yarn section and the second yarn section is smaller than the larger of the first diameter and the second diameter.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. Shoe upper for a sports shoe, comprising:

a first layer with a first surface;

a first continuous yarn comprising a first yarn section having a central axis and a second yarn section having a central axis, wherein the first yarn section and the second yarn section are each arranged on and substantially parallel to the first surface;

a second continuous yarn comprising a third yarn section having a central axis and a fourth yarn section having a central axis;

wherein the first yarn section is arranged adjacent to the second yarn section such that the central axes of the first and second yarn sections are substantially parallel to each other, and the third yarn section is arranged adjacent to the fourth yarn section such that the central axes of the third and fourth yarn sections are substantially parallel to each other;

wherein the third yarn section is in contact with the fourth yarn section along an entire length of the third yarn section;

wherein a plurality of the first yarn sections and a plurality of the second yarn sections cover a majority of the first surface of the shoe upper; and wherein a plurality of the third yarn sections and a plurality of the fourth yarn sections are each arranged on at least a portion of the plurality of the first yarn sections and the plurality of the second yarn sections.

2. Shoe upper according to claim 1, wherein a distance between the first yarn section and the second yarn section is smaller than at least one of a diameter of the first yarn section and a diameter of the second yarn section.

3. Shoe upper according to claim 1, wherein a distance between the first yarn section and the second yarn section is smaller than one half of at least one of a diameter of the first yarn section and a diameter of the second yarn section.

4. Shoe upper according to claim 1, wherein the first yarn section and the second yarn section contact each other over at least a portion of a region where the first yarn section is arranged adjacent to the second yarn section such that the central axes of the first and second yarn section are substantially parallel to each.

5. Shoe upper according to the claim 4, wherein the first yarn section and the second yarn section contact each other over an entire length of the region.

6. Shoe upper according to claim 5, wherein the entire length of the region is at least 1 cm.

7. Shoe upper according to claim 1, wherein the plurality of the third yarn sections and the plurality of the fourth yarn sections are arranged in a heel region of the shoe upper extending between a lower edge of the shoe upper and an upper edge of the shoe upper.

8. Shoe upper according to claim 1, wherein the first continuous yarn and the second continuous yarn form a single unitary continuous yarn.

9. Shoe upper according to claim 1, wherein the plurality of first yarn sections and the plurality of second yarn sections cover substantially all of the first surface of the shoe upper.

10. Shoe upper according to claim 1, wherein the central axes of the first and second yarn sections are not substantially parallel to the central axes of the third and fourth yarn sections.

11. Shoe upper according to claim 1, wherein a combined yarn density of the plurality of the first yarn sections and the plurality of the second yarn sections is 5 to 20 yarns per centimeter.

12. Shoe upper according to claim 11, further comprising a plurality of areas with different combined yarn densities.

13. Shoe upper according to claim 12, wherein the combined yarn density of each of the plurality of areas increases in a certain direction along a surface of the shoe upper.

14. Shoe upper according to claim 1, wherein a diameter of the first continuous yarn is between 0.3 mm and 2 mm.

15. Shoe upper according to claim 1, wherein at least one reinforcing element is arranged between the first continuous yarn and the second continuous yarn.

16. Shoe upper according to claim 1, wherein at least one of the first continuous yarn and the second continuous yarn is at least one of a melting yarn or a filament yarn.

17. A shoe comprising the shoe upper according to claim 1.

18. Shoe upper for a sports shoe, comprising:

a first layer with a first surface;

a first continuous yarn comprising a first yarn section having a central axis and a second yarn section having a central axis, wherein the first continuous yarn is arranged on and substantially parallel to the first surface;

a second continuous yarn comprising a third yarn section having a central axis and a fourth yarn section having a central axis, wherein the second continuous yarn is arranged substantially parallel to the first surface;

wherein the first yarn section is arranged adjacent to the second yarn section such that the central axes of the first and second yarn sections are substantially parallel to each other, and the third yarn section is arranged adjacent to the fourth yarn section such that the central axes of the third and fourth yarn sections are substantially parallel to each other;

wherein the third yarn section is in contact with the fourth yarn section along an entire length of the third yarn section;

wherein a plurality of the third yarn sections and a plurality of the fourth yarn sections are arranged in a toe region of the shoe upper extending between a medial side of the shoe upper and a lateral side of the shoe upper; and wherein the plurality of the third and fourth yarn sections are each arranged on at least a portion of the plurality of the first and second yarn sections.

19. Shoe upper according to claim 18, wherein a second plurality of the third yarn sections and a second plurality of the fourth yarn sections are each arranged in a heel region of the shoe upper.

20. Shoe upper for a sports shoe, comprising:

a first layer with a first surface;

a first continuous yarn comprising a first yarn section having a central axis and a second yarn section having a central axis, wherein the first yarn section and the second yarn section are each arranged on and substantially parallel to the first surface;

wherein the first yarn section is arranged adjacent to the second yarn section such that the central axes of the first and second yarn sections are substantially parallel to each other;

wherein the first yarn section is in contact with the second yarn section along an entire length of the first yarn section; and wherein a plurality of the first yarn sections and a plurality of the second yarn sections cover a majority of the first surface of the shoe upper in which a combined yarn density of the plurality of the first yarn sections and the plurality of the second yarn sections is 5 to 20 yarns per centimeter.

21. Shoe upper according to claim 20, further comprising a plurality of areas with different combined yarn densities.

* * * * *